US005985531A

United States Patent [19]

Nakamine et al.

[11] Patent Number: 5,985,531

[45] Date of Patent: Nov. 16, 1999

[54] SILVER HALIDE COLOR PHOTOGRAPHIC LIGHT-SENSITIVE MATERIAL CONTAINING A DEVELOPMENT INHIBITOR RELEASING COMPOUND

[75] Inventors: Takeshi Nakamine; Hajime Nakagawa; Osamu Uchida; Hideaki Sato; Toshio Kawagishi, all of Minami-Ashigara, Japan

[73] Assignee: Fuji Photo Film Co., Ltd., Kanagawa, Japan

[21] Appl. No.: 08/887,931

[22] Filed: Jul. 3, 1997

[30] Foreign Application Priority Data

Jul. 8, 1996 [JP] Japan ..... 8-195239
Jul. 2, 1997 [JP] Japan ..... 9-190767

[51] Int. Cl.[6] ..... G03C 7/305

[52] U.S. Cl. ..... 430/544; 430/957

[58] Field of Search ..... 430/544, 957

[56] References Cited

U.S. PATENT DOCUMENTS 5,326,680 7/1994 Ohkawa et al. .
5,630,927 5/1997 Kawagishi et al. ..... 430/544

FOREIGN PATENT DOCUMENTS 7133259 5/1995 Japan .

*Primary Examiner*—Janet Baxter
*Assistant Examiner*—Amanda C. Walke
*Attorney, Agent, or Firm*—Birch, Stewart, Kolasch & Birch, LLP

[57] ABSTRACT

A silver halide color photographic light-sensitive material containing a compound represented by formula (I) below formula (I)

$$A—O—C(=O)—N(X_1)—C(X_2)(X_3)—DI$$

wherein A represents a coupler residue, $X_1$ represents a heterocyclic group or a $—C(X_4)(X_5)—Y$ group, Y represents an $—SO_2R^1$, $—SO_2NR^1R^2$, $—CONR^1R^2$, $—CO_2Z$, —CN, $—CF_3$, $—CCl_3$, or $—NO_2$ group, each of $R^1$ and $R^2$ independently represents a hydrogen atom or a substituted or nonsubstituted alkyl, cycloalkyl, alkenyl, aryl, or heterocyclic group, Z represents a hydrogen atom or a substituted or nonsubstituted cycloalkyl, alkenyl, aryl, or heterocyclic group, each of $X_2$, $X_3$, $X_4$, and $X_5$ represents a hydrogen atom or a substituent group, and DI represents a development inhibitor residue which is bonded by a hetero atom and released to form mercaptoazole.

16 Claims, No Drawings

SILVER HALIDE COLOR PHOTOGRAPHIC LIGHT-SENSITIVE MATERIAL CONTAINING A DEVELOPMENT INHIBITOR RELEASING COMPOUND

BACKGROUND OF THE INVENTION

The present invention relates to a silver halide color photographic light-sensitive material containing a novel compound capable of releasing a development inhibitor with a high development inhibiting capacity at an appropriate timing during development.

Recently, as silver halide light-sensitive materials, particularly color light-sensitive materials for photographing, high-speed light-sensitive materials which are superior in graininess, sharpness, and color reproduction and also have a high storage stability are desired. One representative example is an ISO 400 light-sensitive material (Super G-400) having a high image quality equivalent to that of ISO 100.

As a compound which improves the sharpness and does not degrade the storage stability of a light-sensitive material, compounds which imagewise release a development inhibitor via two or more timing groups are described in, e.g., Jpn. Pat. Appln. KOKAI Publication Nos. 60-218645, 60-249148, and 61-156127 and U.S. Pat. No. 4,861,701. However, when any of these compounds is used, the speed (timing) at which the development inhibitor is released or the diffusibility of the development inhibitor is inappropriate. Therefore, the sharpness, graininess, and color reproduction are not satisfactorily improved. Also, many light-sensitive materials containing these compounds significantly increase the fog or decrease the sensitivity when left to stand for long time periods after exposure and before development or when exposed to a high-temperature, high-humidity ambient.

Jpn. Pat. Appln. KOKAI Publication No. 5-313322 has disclosed novel development inhibitor release compounds which can solve these problems. However, the disclosed practical compounds cannot meet recent increasing demands on image quality and are desired to be further improved.

BRIEF SUMMARY OF THE INVENTION

It is an object of the present invention to provide a silver halide color photographic light-sensitive material superior in sharpness, graininess, and color reproduction.

The above object is achieved by a silver halide color photographic light-sensitive material containing a compound represented by formula (I) below.

Formula (I)

$$A—O—C(=O)—N(X_1)—C(X_2)(X_3)—DI$$

wherein A represents a coupler residue, $X_1$ represents a heterocyclic group or a $—C(X_4)(X_5)—Y$ group, Y represents an $—SO_2R^1$, $—SO_2NR^1R^2$, $—CONR^1R^2$, $—CO_2Z$, —CN, $—CF_3$, $—CCl_3$, or $—NO_2$ group, each of $R^1$ and $R^2$ independently represents a hydrogen atom or a substituted or nonsubstituted alkyl, cycloalkyl, alkenyl, aryl, or heterocyclic group, Z represents a hydrogen atom or a substituted or nonsubstituted cycloalkyl, alkenyl, aryl, or heterocyclic group, each of $X_2$, $X_3$, $X_4$, and $X_5$ represents a hydrogen atom or a substituent group, and DI represents a development inhibitor residue which is bonded by a hetero atom and released to form mercaptoazole.

DETAILED DESCRIPTION OF THE INVENTION

The present invention will be described in more detail below.

Details of a compound represented by formula (I) will be described.

In formula (I), A represents a coupler residue and, more specifically, represents a yellow image forming coupler residue, a magenta image forming coupler residue, a cyan image forming coupler residue, a non-dye-forming coupler residue, or a dye release coupler residue. Details of these coupler residues are described in Research Disclosure No. 37038 (February, 1995), pages 80 to 85 and 87 to 89.

When A represents a yellow image forming coupler residue, examples are pivaloylacetanilide type, benzoylacetanilide type, malondiester type, malondiamide type, dibenzoylmethane type, benzothiazolylacetamide type, malonestermonoamide type, benzoxazolylacetamide type, benzoimidazolylacetamide type, benzothiazolylacetamide type, cycloalkanoylacetamide type, and indoline-2-ylacetamide type coupler residues, quinazoline-4-one-2-ylacetamide type coupler residues described in U.S. Pat. No. 5,021,332, benzo-1,2,4-thiadiazine-1,1-dioxide-3-ylacetamide type coupler residues described in U.S. Pat. No. 5,021,330, coupler residues described in European Patent No. 421221A, coupler residues described in U.S. Pat. No. 5,455,149, and coupler residues described in European Patent No. 0622673.

When A represents a magenta image forming coupler residue, examples are 5-pyrazolone type, 1H-pyrazolo[1,5-a]benzimidazole type, 1H-pyrazolo[5,1-c][1,2,4]triazole type, 1H-pyrazolo[1,5-b][1,2,4]triazole type, 1H-imidazo[1,2-b]pyrazole type, and cyanoacetophenone type coupler residues, active propene type coupler residues described in WO 93/01523, enamine type coupler residues described in WO 93/07534, 1H-imidazo[1,2-b][1,2,4]triazole type coupler residues, and coupler residues described in U.S. Pat. No. 4,871,652.

When A represents a cyan image forming coupler residues, examples are phenol type and naphthol type coupler residues, 2,5-diphenylimidazole type coupler residues described in European Patent No. 249453, 1H-pyrrolo[1,2-b][1,2,4]triazole type and 1H-pyrrolo[2,1-c][1,2,4]triazole type coupler residues, pyrrole type coupler residues described in Jpn. Pat. Appln. KOKAI Publication Nos. 4-188137 and 4-190347, 3-hydroxypyridine type coupler residues described in Jpn. Pat. Appln. KOKAI Publication No. 1-315736, pyrrolopyrazole type coupler residues described in U.S. Pat. No. 5,164,289, pyrroloimidazole type coupler residues described in Jpn. Pat. Appln. KOKAI Publication No. 4-174429, pyrazolopyrimidine type coupler residues described in U.S. Pat. No. 4,950,585, pyrrolotriazine type coupler residues described in Jpn. Pat. Appln. KOKAI Publication No. 4-204730, coupler residues described in U.S. Pat. No. 4,746,602, coupler residues described in U.S. Pat. No. 5,104,783, coupler residues described in U.S. Pat. No. 5,162,196, and coupler residues described in European Patent No. 0556700.

A can also be a coupler residue which does not essentially leave any color image. Examples of coupler residues of this sort are indanone type and acetophenone type coupler residues and elution type coupler residues described in European Patent Nos. 443530A and 444501A and Jpn. Pat. Appln. KOKAI Publication Nos. 6-138612, 6-82995, 6-82996, and 6-82998.

Preferable examples of a coupler residue represented by A in formula (I) are coupler residues represented by formulas (Cp-1), (Cp-2), (Cp-3), (Cp-4), (Cp-5), (Cp-6), (Cp-7), (Cp-8), (Cp-9), (Cp-10), (Cp-11), and (Cp-12). These couplers are preferable because of their high coupling speeds.

(Cp-1)

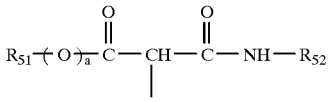

(Cp-2)

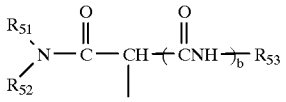

(Cp-3)

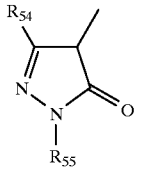

(Cp-4)

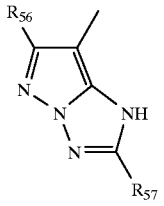

(Cp-5)

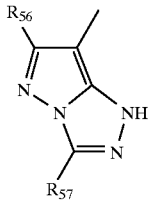

(Cp-6)

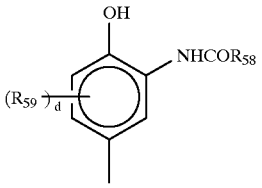

(Cp-7)

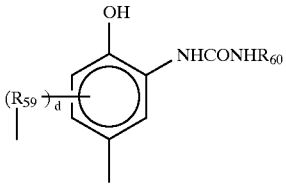

(Cp-8)

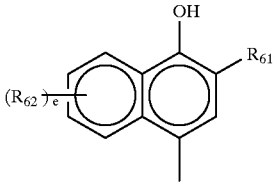

-continued (Cp-9)

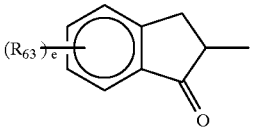

(Cp-10)

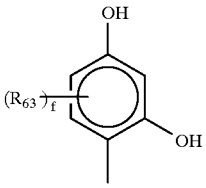

(Cp-11)

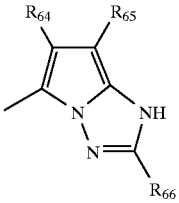

(Cp-12)

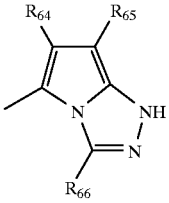

In the above formulas, a free bonding hand stemming from a coupling position represents the bonding position of —O—C(=O)—N($X_1$)—C($X_2$)($X_3$)—DI in formula (I).

In the above formulas, if $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, $R_{63}$, $R_{64}$, $R_{65}$, or $R_{66}$ includes a nondiffusion group, this group is so selected that the total number of carbon atoms is 8 to 40, preferably 10 to 30. In other cases, the total number of carbon atoms is preferably 15 or less. In a bis, telomer, or polymer type coupler, any of the above substituent groups represents a divalent group and connects a repeating unit or the like. If this is the case, the number of carbon atoms can fall outside the defined range.

$R_{51}$ to $R_{66}$, a, b, d, e, and f will be described in detail below.

In the present invention, "substituent groups" include the following groups. Examples of the "substituent groups" are a halogen atom (e.g., a fluorine atom, a chlorine atom, and a bromine atom), an alkyl group (preferably a 1- to 40-carbon, straight-chain or branched-chain alkyl group, e.g., methyl, ethyl, propyl, isopropyl, butyl, t-butyl, 1-octyl, and tridecyl), a cycloalkyl group (preferably a 3- to 40-carbon cycloalkyl group, e.g., cyclopropyl, 1-ethylcyclopropyl, cyclopentyl, cyclohexyl, 1-norbornyl, and 1-adamantyl), an alkenyl group (preferably a 2- to 40-carbon alkenyl group, e.g., vinyl, allyl, and 3-butene-1-yl), an aryl group (preferably a 6- to 32-carbon aryl group, e.g., phenyl, 1-naphthyl, and 2-naphthyl), a heterocyclic group (preferably a 1- to 32-carbon, 5- to 8-membered heterocyclic group, e.g., 2-thienyl, 4-pyridyl, 2-furyl, 2-pyrimidinyl, 1-pyridyl, 2-benzothiazolyl, 1-imidazolyl, 1-pyrazolyl, and benzotriazole-2-yl), a cyano group, a silyl group (preferably a 3- to 40-carbon silyl group, e.g., trimethylsilyl, triethylsilyl, tributylsilyl, t-butyldimethylsilyl, and t-hexyldimethylsilyl), a hydroxyl group, a carboxyl group, a nitro group, an alkoxy group (preferably a 1- to 40-carbon alkoxy group, e.g., methoxy, ethoxy, 1-butoxy, 2-butoxy, isopropoxy, t-butoxy, and dodecyloxy), a cycloalkyloxy group (preferably a 3- to 8-carbon cycloalkyl group, e.g., cyclopentyloxy and cyclohexyloxy), an aryloxy group (preferably a 6- to 40-carbon aryloxy group, e.g., phenoxy and 2-naphthoxy), a heterocyclic oxy group (preferably a 1- to 40-carbon heterocyclic oxy group, e.g., 1-phenyltetrazole-5-oxy, 2-tetrahydropyranyloxy, and 2-furyloxy), a silyloxy group (preferably a 1- to 40-carbon silyloxy group, e.g., trimethylsilyloxy, t-butyldimethylsilyloxy, and diphenylmethylsilyloxy), an acyloxy group (preferably a 2- to 40-carbon acyloxy group, e.g., acetoxy, pivaloyloxy, benzoyloxy, and dodecanoyloxy), an alkoxycarbonyloxy group (preferably a 2- to 40-carbon alkoxycarbonyloxy group, e.g., ethoxycarbonyloxy and t-butoxycarbonyloxy), a cycloalkyloxycarbonyloxy group (preferably a 4- to 40-carbon cycloalkyloxycarbonyloxy group, e.g., cyclohexyloxycarbonyloxy), an aryloxycarbonyloxy group (preferably a 7- to 40-carbon aryloxycarbonyloxy group, e.g., phenoxycarbonyloxy), a carbamoyloxy group (preferably a 1- to 40-carbon carbamoyloxy group, e.g., N,N-dimethylcarbamoyloxy and N-butylcarbamoyloxy), a sulfamoyloxy group (preferably a 1- to 40-carbon sulfamoyloxy group, e.g., N,N-diethylsulfamoyloxy and N-propylsulfamoyloxy), an alkanesulfonyloxy group (preferably a 1- to 40-carbon alkanesulfonyloxy group, e.g., methanesulfonyloxy and hexadecanesulfonyloxy), an arenesulfonyloxy group (preferably a 6- to 40-carbon arenesulfonyloxy group, e.g., benzenesulfonyloxy), an acyl group (preferably a 1- to 40-carbon acyl group, e.g., formyl, acetyl, pivaloyl, benzoyl, and tetradecanoyl), an alkoxycarbonyl group (preferably a 2- to 40-carbon alkoxycarbonyl group, e.g., methoxycarbonyl, ethoxycarbonyl, and octadecyloxycarbonyl), a cycloalkyloxycarbonyl group (preferably a 4- to 40-carbon cycloalkyloxycarbonyl group, e.g., cyclohexyloxycarbonyl), an aryloxycarbonyl group (preferably a 7- to 40-carbon aryloxycarbonyl group, e.g., phenoxycarbonyl), a carbamoyl group (preferably a 1- to 40-carbon carbamoyl group, e.g., carbamoyl, N,N-dibutylcarbamoyl, N-ethyl-N-octylcarbamoyl, and N-propylcarbamoyl), an amino group (preferably an amino group having 32 or less carbon atoms, e.g., amino, methylamino, N,N-dioctylamino, tetradecylamino, and octadecylamino), an anilino group (preferably a 6- to 40-carbon anilino group, e.g., anilino and N-methylanilino), a heterocyclic amino group (preferably a 1- to 40-carbon heterocyclic amino group, e.g., 4-pyridylamino), a carbonamide group (preferably a 2- to 40-carbon carbonamide group, e.g., acetamide, benzamide, and tetradecaneamide), a ureido group (preferably a 1- to 40-carbon ureido group, e.g., ureido, N,N-dimethylureido, and N-phenylureido), an imide group (preferably an imide group having 10 or less carbon atoms, e.g., N-succinimide and N-phthalimide), an alkoxycarbonylamino group (preferably a 2- to 40-carbon alkoxycarbonylamino group, e.g., methoxycarbonylamino, ethoxycarbonylamino, t-butoxycarbonylamino, and octadecyloxycarbonylamino), a cycloalkyloxycarbonylamino group (preferably a 4- to 40-carbon cycloalkyloxycarbonylamino group, e.g., cyclohexyloxycarbonylamino), an aryloxycarbonylamino group (preferably a 7- to 40-carbon aryloxycarbonylamino group, e.g., phenoxycarbonylamino), a sulfonamide group (preferably a 1- to 40-carbon sulfonamide group, e.g., methanesulfonamide, butanesulfonamide, benzenesulfonamide, and hexadecanesulfonamide), a sulfamoylamino group (preferably a 1- to 40-carbon sulfamoylamino group, e.g., N,N-dipropylsulfamoylamino and N-ethyl-N-dodecylsulfamoylamino), an azo group (preferably a 1- to 40-carbon azo group, e.g., phenylazo), an alkylthio group (preferably a 1- to 40-carbon alkylthio group, e.g., ethylthio and octylthio), a cycloalkylthio group (preferably a 3- to 40-carbon cycloalkylthio group, e.g., cyclohexylthio), an arylthio group (preferably a 6- to 40-carbon arylthio group, e.g., phenylthio), a heterocyclic thio group (preferably a 1- to 40-carbon heterocyclic thio group, e.g., 2-benzothiazolylthio, 2-pyridylthio, and 1-phenyltetrazolylthio), an alkylsulfinyl group (preferably a 1- to 40-carbon alkylsulfinyl group, e.g., dodecanesulfinyl), an arenesulfinyl group (preferably a 6- to 40-carbon arenesulfinyl group, e.g., benzenesulfinyl), an alkanesulfonyl group (preferably a 1- to 40-carbon alkanesulfonyl group, e.g., methanesulfonyl and octanesulfonyl), an arenesulfonyl group (preferably a 6- to 40-carbon arenesulfonyl group, e.g., benzenesulfonyl and 1-naphthalenesulfonyl), an alkoxysulfonyl group (preferably a 1- to 40-carbon alkoxysulfonyl group, e.g., methoxysulfonyl and ethoxysulfonyl), a cycloalkyloxysulfonyl group (preferably a 3- to 40-carbon cycloalkyloxysulfonyl group, e.g., cyclopropyloxysulfonyl), an aryloxysulfonyl group (preferably a 6- to 40-carbon aryloxysulfonyl group, e.g., phenoxysulfonyl and p-methylphenoxysulfonyl), a sulfamoyl group (preferably a sulfamoyl group having 32 or less carbon atoms, e.g., sulfamoyl, N,N-dipropylsulfamoyl, and N-ethyl-N-dodecylsulfamoyl), a sulfo group, a phosphonyl group (preferably a 1- to 40-carbon phosphonyl group, e.g., phenoxyphosphonyl, octyloxyphosphonyl, and phenylphosphonyl), and a phosphinoylamino group (diethoxyphosphinoylamino and dioctyloxyphosphinoylamino).

Substituent groups $R_{51}$ to $R_{66}$ and a, b, d, e, and f in formulas (Cp-1) to (Cp-12) will be described in more detail below.

In formula (Cp-1), $R_{51}$ represents an alkyl group, a cycloalkyl group, an aryl group, or a heterocyclic group. a represents 0 or 1. $R_{52}$ represents a hydrogen atom, an alkyl group, a cycloalkyl group, an aryl group, or a heterocyclic group.

In formula (Cp-2), $R_{51}$ represents an alkyl group, a cycloalkyl group, an aryl group, or a heterocyclic group, each of $R_{52}$ and $R_{53}$ independently represents a hydrogen atom, an alkyl group, a cycloalkyl group, an aryl group, or a heterocyclic group, and b represents 0 or 1.

In formula (Cp-3), $R_{54}$ represents an alkyl group, a cycloalkyl group, an aryl group, a heterocyclic group, a carbonamide group, a sulfonamide group, an amino group, an anilino group, an alkylthio group, an arylthio group, an alkoxy group, a cycloalkyloxy group, an aryloxy group, a ureido group, or an alkoxycarbonylamino group. $R_{55}$ represents an alkyl group, a cycloalkyl group, an aryl group, or a heterocyclic group.

In formulas (Cp-4) and (Cp-5), each of $R_{56}$ and $R_{57}$ independently represents a hydrogen atom, an alkyl group, a cycloalkyl group, an aryl group, a heterocyclic group, a carbonamide group, a sulfonamide group, an amino group, an anilino group, an alkylthio group, cycloalkylthio group, an arylthio group, an alkoxy group, a cycloalkyloxy group, an aryloxy group, a ureido group, an alkoxycarbonylamino group, or a cycloalkyloxycarbonylamino group.

In formulas (Cp-6) and (Cp-7), each of $R_{58}$ and $R_{60}$ independently represents an alkyl group, a cycloalkyl group, an aryl group, or a heterocyclic group, $R_{59}$ represents an alkyl group, a cycloalkyl group, an aryl group, a heterocyclic group, a silyl group, a carbonamide group, a sulfonamide group, an amino group, an anilino group, an alkylthio group, a cycloalkylthio group, an arylthio group, an alkoxy group, a cycloalkyloxy group, an aryloxy group, a ureido group, an alkoxycarbonylamino group, a cycloalkyloxycarbonylamino group, or a halogen atom, and d represents any integer from 0 to 3. If d is a plural number, a plurality of $R_{59}$'s represent the same substituent group or different substituent groups.

In formula (Cp-8), $R_{61}$ represents an alkyl group, a cycloalkyl group, an aryl group, a heterocyclic group, a carbamoyl group, an alkoxycarbonyl group, a cycloalkyloxycarbonyl group, an aryloxycarbonyl group, a cyano group, a sulfamoyl group, a carbonamide group, a ureido group, an alkoxycarbonylamino group, a cycloalkyloxycarbonylamino group, an aryloxycarbonylamino group, or a sulfonamide group, $R_{62}$ represents an alkyl group, a cycloalkyl group, an aryl group, a heterocyclic group, a carbonamide group, a sulfonamide group, an amino group, an anilino group, an alkylthio group, a cycloalkylthio group, an arylthio group, an alkoxy group, a cycloalkyloxy group, an aryloxy group, a ureido group, an alkoxycarbonylamino group, a cycloalkyloxycarbonylamino group, or a halogen atom, and e represents any integer from 0 to 4. If e is a plural number, a plurality of $R_{62}$'s represent the same group or different groups.

In formulas (Cp-9) and (Cp-10), $R_{63}$ represents an alkyl group, a cycloalkyl group, an aryl group, a heterocyclic group, a carbonamide group, a sulfonamide group, an amino group, an anilino group, an alkylthio group, a cycloalkylthio group, an arylthio group, an alkoxy group, a cycloalkyloxy group, an aryloxy group, a ureido group, an alkoxycarbonylamino group, a cycloalkyloxycarbonylamino group, or a halogen atom, e represents any integer from 0 to 4, and f represents any integer from 0 to 2. If e or f is a plural number, a plurality of $R_{63}$'s represent the same group or different groups.

In formulas (Cp-11) and (Cp-12), each of $R_{64}$ and $R_{65}$ independently represents a carbamoyl group, an alkoxycarbonyl group, a cycloalkyloxycarbonyl group, an aryloxycarbonyl group, a cyano group, a sulfamoyl group, an alkanesulfonyl group, an arenesulfonyl group, or a nitro group, and $R_{66}$ represents a hydrogen atom, an alkyl group, a cycloalkyl group, an aryl group, or a heterocyclic group.

The numbers of carbon atoms and practical examples of the groups enumerated above in the explanation of substituent groups $R_{51}$ to $R_{66}$ are the same as those of the "substituent groups" described previously. Groups represented by $R_{51}$ to $R_{66}$ can further have substituent groups. Preferable examples of the substituent groups are a halogen atom, an alkyl group, a cycloalkyl group, an alkenyl group, an aryl group, a heterocyclic group, a cyano group, a silyl group, a hydroxyl group, a carboxyl group, a nitro group, an alkoxy group, a cycloalkyloxy group, an aryloxy group, a heterocyclic oxy group, a silyloxy group, an acyloxy group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, an amino group, an anilino group, a heterocyclic amino group, a carbonamide group, an alkoxycarbonylamino group, a cycloalkyloxycarbonylamino group, an aryloxycarbonylamino group, a ureido group, a sulfonamide group, a sulfamoylamino group, an imide group, an alkylthio group, an arylthio group, a heterocyclic thio group, a sulfinyl group, a sulfo group, an alkanesulfonyl group, an arenesulfonyl group, a sulfamoyl group, a phosphonyl group, and a phosphinoylamino group. Preferable carbon numbers and practical examples of these groups are the same as those of the above-mentioned "substituent groups". The substituent groups of groups represented by $R_{51}$ to $R_{66}$ are more preferably a halogen atom, an alkyl group, a cycloalkyl group, an aryl group, a silyl group, a hydroxyl group, a carboxyl group, an alkoxy group, a cycloalkyloxy group, an aryloxy group, an alkoxycarbonyl group, a cycloalkyloxycarbonyl group, a carbamoyl group, a carbonamide group, an alkoxycarbonylamino group, a cycloalkyloxycarbonylamino group, an aryloxycarbonylamino group, a ureido group, a sulfonamide group, an imide group, an alkylthio group, a cycloalkylthio group, an arylthio group, an alkanesulfonyl group, an arenesulfonyl group, a phosphonyl group, and a phosphinoylamino group.

Preferable carbon numbers and practical examples of these groups are the same as those of the above-mentioned "substituent groups".

Preferable ranges of $R_{51}$ to $R_{66}$ and a, b, d, e, and f will be described below.

In formula (Cp-1), if a is 0, $R_{51}$ is preferably an alkyl group, a cycloalkyl group, an aryl group, or a heterocyclic group, and $R_{52}$ is preferably an aryl group. If a is 1, $R_{51}$ is preferably an alkyl group, a cycloalkyl group, or an aryl group, and $R_{52}$ is preferably an aryl group.

In formula (Cp-2), if b is 0, it is preferable that $R_{53}$ be a heterocyclic group, $R_{51}$ be an aryl group, and $R_{52}$ be a hydrogen atom. If b is 1, it is preferable that $R_{53}$ be an aryl group, $R_{51}$ be an aryl group, and $R_{52}$ be an alkyl group, a cycloalkyl group, or a hydrogen atom. If $R_{51}$ is an aryl group and $R_{52}$ is an alkyl group, it is preferable that $R_{51}$ and $R_{52}$ bond to each other to form a 5-membered heterocyclic ring together with a nitrogen atom and that the 5-membered heterocyclic ring be condensed with a benzene ring.

In formula (Cp-3), it is preferable that $R_{54}$ be an alkyl group, a carbonamide group, or an anilino group and $R_{55}$ be a substituted phenyl group. It is more preferable that $R_{54}$ be a carbonamide group or an anilino group and $R_{55}$ be 2,4,6-trichlorophenyl, 2,5-dichlorophenyl, or pentachlorophenyl.

In formulas (Cp-4) and (Cp-5), it is preferable that $R_{56}$ be an alkyl group, a cycloalkyl group, an aryl group, an alkoxy group, a cycloalkyloxy group, or an aryloxy group and $R_{57}$ be an alkyl group, a cycloalkyl group, or an aryl group. It is more preferable that $R_{56}$ be an alkyl group or a cycloalkyl group and $R_{57}$ be an alkyl group, a cycloalkyl group, or an aryl group.

In formula (Cp-6), it is preferable that $R_{58}$ be an alkyl group, a cycloalkyl group, or an aryl group, $R_{59}$ be an alkyl group, a cycloalkyl group, a carbonamide group, a sulfonamide group, a ureido group, an alkoxycarbonylamino group, a cycloalkyloxycarbonylamino group, or a halogen atom, and d be 1 or 2.

In formula (Cp-7), it is preferable that $R_{60}$ be a substituted phenyl group, $R_{59}$ be an alkyl group, a cycloalkyl group, a carbonamide group, a sulfonamide group, a ureido group, an alkoxycarbonylamino group, or a halogen atom, and d be 1 or 2. It is more preferable that $R_{60}$ be a phenyl group in which at least one cyano group or chlorine atom is substituted, $R_{59}$ be a carbonamide group, a sulfonamide group, a ureido group, or an alkoxycarbonylamino group, and d be 1.

In formula (Cp-8), it is preferable that $R_{61}$ be a heterocyclic group, a carbamoyl group, an alkoxycarbonyl group, a cycloalkyloxycarbonyl group, an aryloxycarbonyl group, a cyano group, a sulfamoyl group, a carbonamide group, a ureido group, an alkoxycarbonylamino group, a cycloalkyloxycarbonyl group, an aryloxycarbonylamino group, or a sulfonamide group, $R_{62}$ be a carbonamide group, a sulfonamide group, a ureido group, an alkoxycarbonylamino group, a cycloalkyloxycarbonylamino group, or a halogen atom, and e be any integer from 0 to 2. It is more preferable that $R_{61}$ be a carbamoyl group or a sulfamoyl group, $R_{62}$ be a carbonamide group, a ureido group, or an alkoxycarbonylamino group, and e be 0 or 1.

In formulas (Cp-9) and (Cp-10), it is preferable that $R_{63}$ be an alkyl group, a cycloalkyl group, an aryl group, a carbonamide group, a sulfonamide group, an alkylthio group, a cycloalkylthio group, an arylthio group, an alkoxy group, a cycloalkyloxy group, an aryloxy group, a ureido group, an alkoxycarbonylamino group, or a cycloalkyloxycarbonylamino group, e be 1 or 2, and f be 1 or 2.

In formulas (Cp-11) and (Cp-12), it is preferable that $R_{64}$ be a cyano group, a carbamoyl group, an alkoxycarbonyl group, a cycloalkyloxycarbonyl group, or an aryloxycarbonyl group, $R_{65}$ be a carbamoyl group, an alkoxycarbonyl group, a cycloalkyloxycarbonyl group, an aryloxycarbonyl group, or a cyano group, and $R_{66}$ be an alkyl group, a cycloalkyl group, or an aryl group. It is more preferable that $R_{64}$ be a cyano group, $R_{65}$ be an alkoxycarbonyl group, a cycloalkyloxycarbonyl group, or an aryloxycarbonyl group, and $R_{66}$ be an alkyl group, a cycloalkyl group, or an aryl group.

Preferable carbon numbers and practical examples of the preferable ranges of $R_{51}$ to $R_{66}$ and a, b, d, e, and f are the same as those of the above-mentioned "substituent groups".

In formula (I), $X_1$ represents a heterocyclic group (the same as those of the above-mentioned "substituent groups") or a $—C(X_4)(X_5)—Y$ group.

Y represents an $—SO_2R^1$, $—SO_2NR^1R^2$, $—CONR^1R^2$, $—CO_2Z$, —CN, $—CF_3$, $—CCl_3$, or $—NO_2$ group.

Each of $R^1$ and $R^2$ independently represents a hydrogen atom or a substituted or nonsubstituted alkyl, cycloalkyl, alkenyl, aryl, or heterocyclic group, each of which has the same meaning as defined in the explanation of the above-mentioned "substituent groups". When $R^1$ and $R^2$ have substituent groups, these substituent groups are the same as those of the above-mentioned "substituent groups". $R^1$ and $R^2$ can also bond to each other to form a nitrogen-containing ring.

Each of $R^1$ and $R^2$ is independently preferably a hydrogen atom or a substituted or nonsubstituted alkyl group, and more preferably a hydrogen atom or an alkyl group which has a hydroxyl group and/or a carboxyl group as a substituent group and has 10 or less carbon atoms.

Preferable carbon numbers and practical examples of these preferable $R^1$ and $R^2$ are the same as those of the above-mentioned "substituent groups".

Z represents a hydrogen atom or a substituted or nonsubstituted cycloalkyl, alkenyl, aryl, or heterocyclic group, each of which has the same meaning as that of the above-mentioned "substituent groups". When Z has a substituent group, this substituent group is any of the groups enumerated as the above-mentioned "substituent groups".

Z is preferably a hydrogen atom or a substituted or nonsubstituted aryl group, and more preferably a hydrogen atom or a substituted aryl group having 10 or less carbon atoms. Preferable substituent groups are a halogen atom, a hydroxyl group, and a carboxyl group.

Y is preferably $—CONR^1R^2$, $—CO_2Z$, —CN, or $—CF_3$, and most preferably —CN.

Each of $X_2$, $X_3$, $X_4$, and $X_5$ represents a hydrogen atom or a substituent group. This substituent group is the same as those of the above-mentioned "substituent groups" and can also be further substituted by the groups enumerated above as the "substituent groups".

Each of $X_2$, $X_3$, $X_4$, and $X_5$ is preferably a hydrogen atom or a substituted or nonsubstituted alkyl or aryl group, and most preferably a hydrogen atom.

Preferable carbon numbers and practical examples of these preferable $X_2$, $X_3$, $X_4$, and $X_5$ are the same as those of the above-mentioned "substituent groups".

A compound represented by formula (I) of the present invention is particularly preferably represented by formula (II) below.

Formula (II)

$$A—O—C(=O)—N(—CH_2—Y)—CH_2—DI$$

wherein each of A, Y, and DI has the same meaning as defined in the explanation of formula (I).

Preferable practical examples of a partial structure represented by $—N(X_1)—C(X_2)(X_3)—$ in formula (I) will be presented below, but the present invention is not limited to these examples.

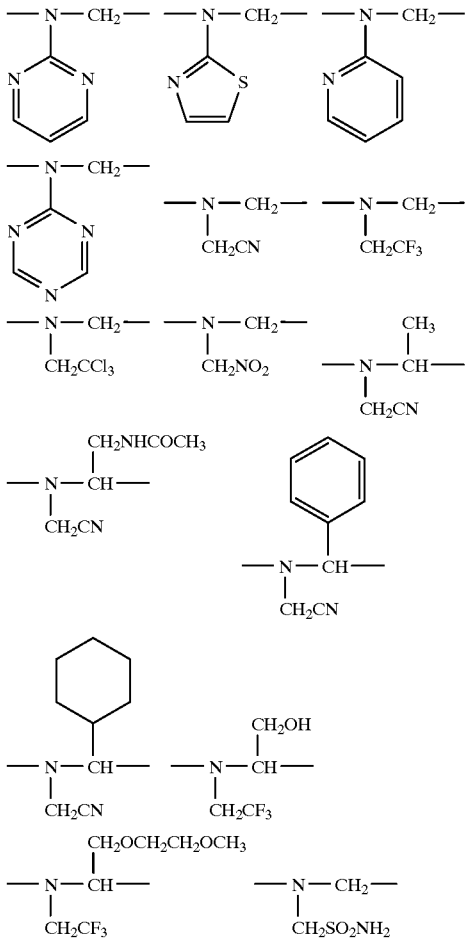

-continued

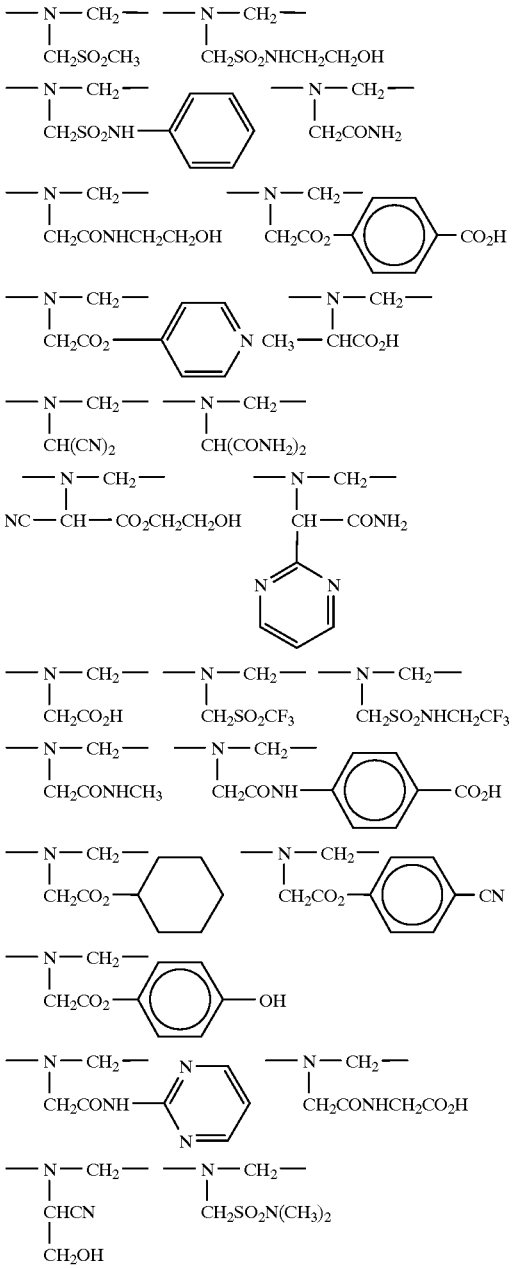

A development inhibitor residue represented by DI in formula (I) will be described below. DI represents a development inhibitor residue which is bonded by a hetero atom and released to form mercaptoazole. Practical examples are mercaptoazole development inhibitors described in Research Disclosure No. 37038 (February, 1995), pages 86 to 88, and in the references cited therein.

Preferable examples of DI are 5-mercaptotetrazolyl, 5-mercapto-1,2,4-triazolyl, 2-mercapto-1,3,4-oxadiazolyl, 2-mercapto-1,3,4-thiazolyl, 2-mercaptobenzothiazolyl, 2-mercaptobenzoxazolyl, 2-mercaptobenzoimidazolyl, and their derivatives. Preferable development inhibitor residues DI are represented by formulas DI-1 to DI-4 below.

DI-1

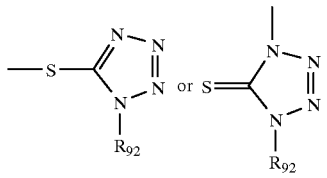

DI-2

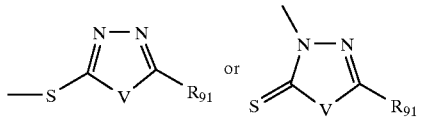

DI-3

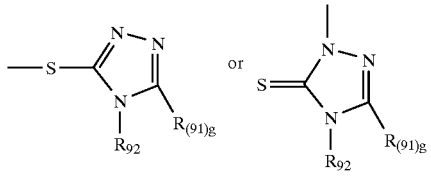

DI-4

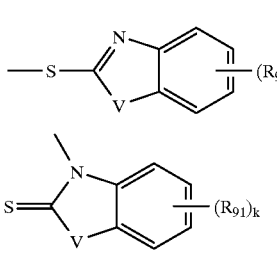

In the above formula, examples of $R_{91}$ are a halogen atom (e.g., a bromine atom and a chlorine atom), an alkyl group (a 1- to 20-carbon, preferably 1- to 10-carbon, straight-chain or branched-chain alkyl group, e.g., methyl, ethyl, butyl, t-butyl, neopentyl, t-amyl, propyloxycarbonylmethyl, butoxycarbonylethyl, 4-methoxybenzyl, and benzyl), a cycloalkyl group (a 3- to 20-carbon, preferably 3- to 10-carbon cycloalkyl group, e.g., cyclopropyl, 1-ethylcyclopropyl, cyclopentyl, cyclohexyl, 1-norbornyl, and 1-adamantyl), an aryl group (a 6- to 20-carbon, preferably 6- to 15-carbon aryl group, e.g., phenyl, naphthyl, 4-hydroxyphenyl, 3-methoxycarbonylphenyl, and 4-ethoxycarbonylphenyl), a heterocyclic group (a 1- to 20-carbon, preferably 1- to 12-carbon, monocyclic or condensed-ring heterocyclic group which contains at least one nitrogen, oxygen, or sulfur atom as a hetero atom and is preferably a 5- or 6-membered ring, e.g., 2-pyridyl, 2-furyl, 1-pyrrolyl, morpholino, and 1-indolinyl), an alkoxy group (a 1- to 20-carbon, preferably 1- to 10-carbon alkoxy group, e.g., methoxy, ethoxy, and benzyloxy), a cycloalkyloxy group (a 3- to 20-carbon, preferably 3- to 10-carbon cycloalkyloxy group, e.g., cyclopropyloxy, 1-ethylcyclopropyloxy, cyclopentyloxy, and cyclohexyloxy), an aryloxy group (a 6- to 20-carbon, preferably 6- to 10-carbon aryloxy group, e.g., phenoxy, 4-methoxyphenoxy, and naphthoxy), a heterocyclic oxy group (preferably a 1- to 10-carbon heterocyclic oxy group, e.g., 1-phenyltetrazole-5-oxy, 2-tetrahydropyranyloxy, and 2-furyloxy), a silyloxy group (preferably a 1- to 12-carbon silyloxy group, e.g., trimethylsilyloxy, t-butyldimethylsilyloxy, and diphenylmethylsilyloxy), an acyloxy group (preferably a 2- to 10-carbon acyloxy group, e.g., acetoxy, pivaloyloxy, benzoyloxy, and dodecanoyloxy), an alkoxycarbonyloxy group (preferably a 2- to 10-carbon alkoxycarbonyloxy group, e.g., ethoxycarbonyloxy and t-butoxycarbonyloxy), a cycloalkyloxycarbonyloxy group (preferably a 4- to 10-carbon cycloalkyloxycarbonyloxy group, e.g., cyclohexyloxycarbonyloxy), an aryloxycarbonyloxy group (preferably a 7- to 12-carbon aryloxycarbonyloxy group, e.g., phenoxycarbonyloxy), a carbamoyloxy group (preferably a 1- to 10-carbon carbamoyloxy group, e.g., N,N-dimethylcarbamoyloxy and N-butylcarbamoyloxy), a sulfamoyloxy group (preferably a 1- to 10-carbon sulfamoyloxy group, e.g., N,N-diethylsulfamoyloxy and N-propylsulfamoyloxy), an alkanesulfonyloxy group (preferably a 1- to 10-carbon alkanesulfonyloxy group, e.g., methanesulfonyloxy and butanesulfonyloxy), an arenesulfonyloxy group (preferably a 6- to 12-carbon arenesulfonyloxy group, e.g., benzenesulfonyloxy), an amide group (a 2- to 20-carbon, preferably 2- to 10-carbon amide group, e.g., acetamide, pentaneamide, hexaneamide, heptaneamide, and benzamide), an alkanesulfonamide group (a 1- to 20-carbon, preferably 1- to 10-carbon alkanesulfonamide group, e.g., methanesulfonamide and butanesulfonamide), an arenesulfonamide group (a 6- to 20-carbon, preferably 6- to 15-carbon arenesulfonamide group, e.g., benzenesulfonamide and p-toluenesulfonamide), an alkoxycarbonylamino group (a 1- to 20-carbon, preferably 1- to 10-carbon alkoxycarbonylamino group, e.g., ethoxycarbonylamino), a cycloalkyloxycarbonylamino group (preferably a 4- to 10-carbon cycloalkyloxycarbonylamino group, e.g., cyclohexyloxycarbonylamino), an aryloxycarbonylamino group (a 7- to 20-carbon, preferably a 7- to 15-carbon aryloxycarbonylamino group, e.g., phenoxycarbonylamino), a ureido group (a 1- to 20-carbon, preferably 1- to 10-carbon ureido group, e.g., N-phenylureido), a nitro group, an acyl group (a 1- to 20-, preferably 2- to 10-carbon acyl group, e.g., acetyl and benzoyl), an alkoxycarbonyl group (a 2- to 20-carbon, preferably 2- to 10-carbon alkoxycarbonyl group, methoxycarbonyl, butoxycarbonylmethoxycarbonyl, and isoamyloxycarbonylmethoxycarbonyl), a cycloalkyloxycarbonyl group (preferably a 4- to 10-carbon cycloalkyloxycarbonyl group, e.g., cyclopropyloxycarbonyl and cyclohexyloxycarbonyl), an aryloxycarbonyl group (a 7- to 21-carbon, preferably 7- to 11-carbon aryloxycarbonyl group, e.g., phenoxycarbonyl), a carbamoyl group (a 1- to 20-carbon, preferably 1- to 10-carbon carbamoyl group, e.g., N-butylcarbamoyl, N,N-diethylcarbamoyl, and N-methylcarbamoyl), a cyano group, an alkylthio group (a 1- to 20-carbon, preferably 1- to 10-carbon alkylthio group, e.g., methylthio, butylthio, and hexylthio), an arylthio group (a 6- to 20-carbon, preferably 6- to 15-carbon arylthio group, e.g., phenylthio and naphthylthio), an alkanesulfonyl group (a 1- to 20-carbon, preferably 1- to 10-carbon alkanesulfonyl group, e.g., methanesulfonyl and butanesulfonyl), an arenesulfonyl group (a 6- to 20-carbon, preferably 6- to 15-carbon arenesulfonyl group, e.g., benzenesulfonyl and p-toluenesulfonyl), an alkoxysulfonyl group (preferably a 1- to 10-carbon alkoxysulfonyl group, e.g., methoxysulfonyl and ethoxysulfonyl), a cycloalkyloxysulfonyl group (preferably a 3- to 10-carbon cycloalkyloxysulfonyl group, e.g., cyclopropyloxysulfonyl), an aryloxysulfonyl group (preferably a 6- to 12-carbon aryloxysulfonyl group, e.g., phenoxysulfonyl and p-methylphenoxysulfonyl), and a sulfamoyl group (a 1- to 20-carbon, preferably 1- to 10-carbon sulfamoyl group, e.g., N-butylsulfamoyl and N,N-dimethylsulfamoyl). Each of the above groups can be either substituted or nonsubstituted. $R_{91}$ can further have substituent groups. Preferable substituent groups are those enumerated as $R_{91}$.

$R_{92}$ represents an alkyl group, a cycloalkyl group, an aryl group, or a heterocyclic group. Preferable practical examples of these groups are the same as those enumerated in the explanation of $R_{91}$. k represents any number from 0 to 4, and g represents 0 or 1. V represents an oxygen atom, a sulfur atom, or —N($R_{93}$)— wherein $R_{93}$ represents a group having the same meaning as $R_{92}$.

DI is particularly preferably DI-1 or DI-2.

Preferable $R_{91}$, $R_{92}$, and V in DI-1 and DI-2 will be described below.

In DI-1, $R_{92}$ is preferably an alkyl group or an aryl group.

Preferable carbon numbers and practical examples of these alkyl and aryl groups are the same as those of the substituent groups enumerated above as $R_{91}$.

$R_{92}$ is particularly preferably represented by —$CH_2CO_2$—R or —$CH_2CH_2CO_2$—R wherein R represents —$C_4$—$H_9$, —$C_5H_{11}$—n, —$C_5H_{11}$—i, —$CH_2CH$=$CHCH_3$, or —$CH_2CH$=$C(CH_3)_2$.

In DI-2, V is preferably an oxygen atom or a sulfur atom. In DI-2, $R_{91}$ is preferably an alkylthio group or an arylthio group. $R_{91}$ is particularly preferably represented by —$SCH_2CO_2$—R, —$SCH_2CH_2CO_2$—R, or —$SCH(CH_3)CO_2$—R wherein R has the same meanings as explained above in the preferable examples of $R_{92}$.

Practical examples of preferable development inhibitors are presented below, but the present invention is not limited by these examples.

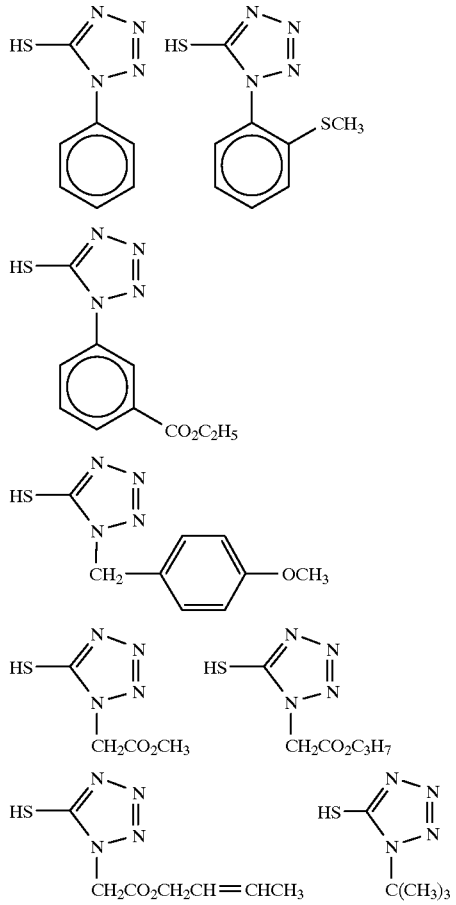

-continued

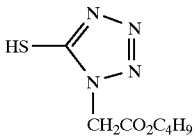

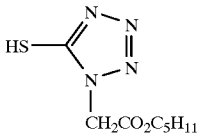

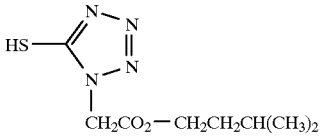

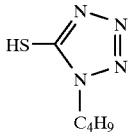

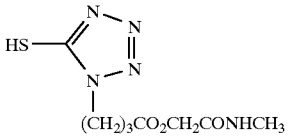

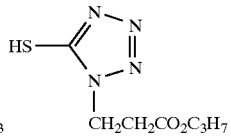

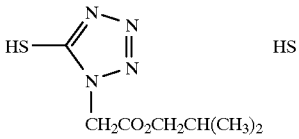

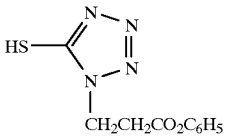

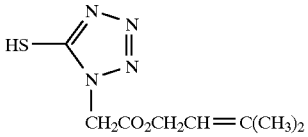

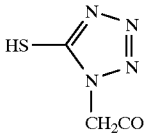

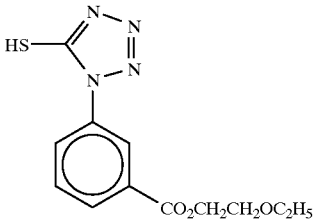

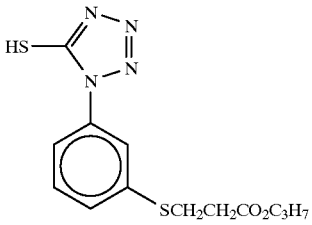

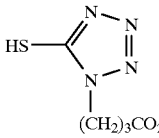

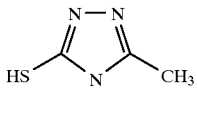

-continued

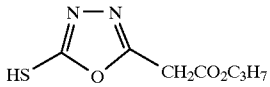

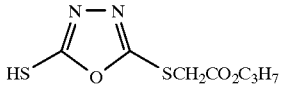

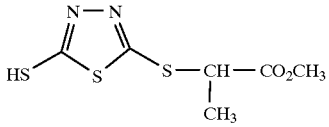

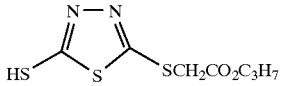

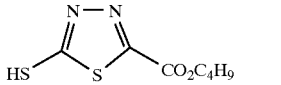

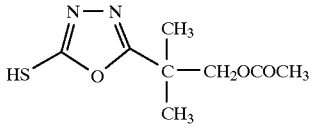

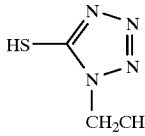

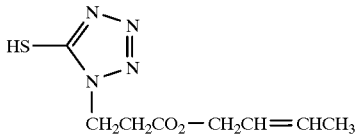

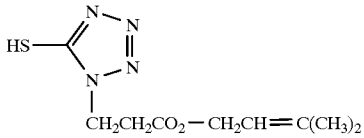

As described previously, a compound represented by formula (I) is preferably represented by formula (II). Preferable combinations of A and DI in formula (II) will be described below.

In a compound represented by formula (II), it is preferable that a group represented by A be formula (Cp-1), (Cp-2), (Cp-6), (Cp-7), (Cp-8), or (Cp-11) and DI be formula (DI-1), (DI-2), or (DI-3). It is more preferable that a group represented by A be formula (Cp-1) or (Cp-8) and DI be formula (DI-1) or (DI-2).

Practical examples of a coupler represented by formula (I) of the present invention are presented below, but the present invention is not limited to these examples.

(1)
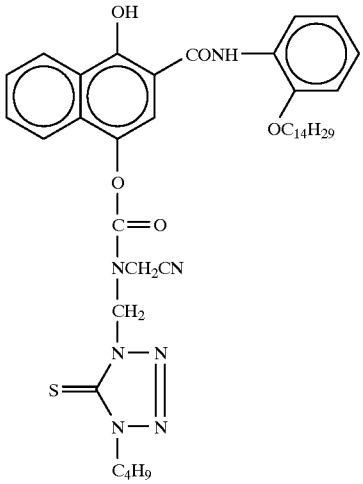
(2)
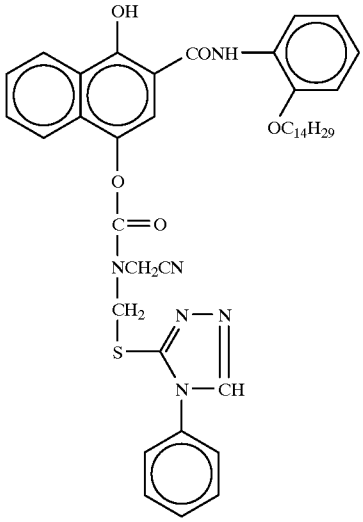
(3)
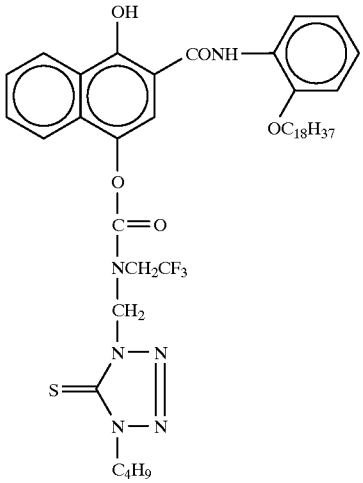

-continued
(4)
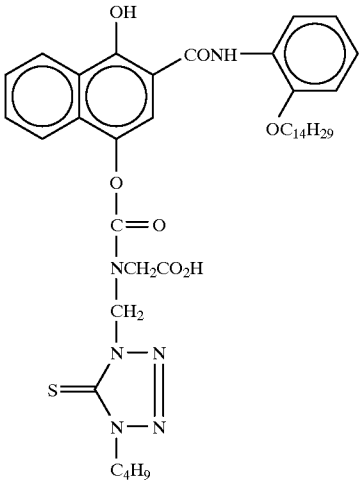
(5)
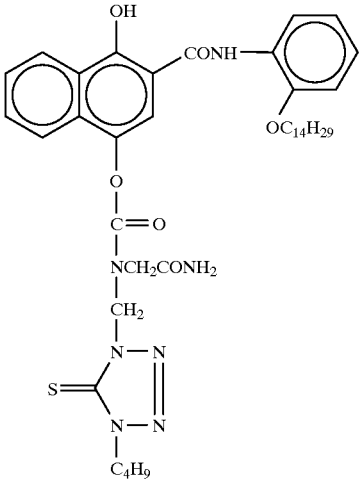
(6)
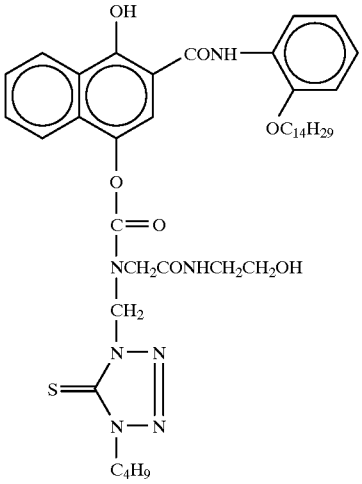

-continued
(7)
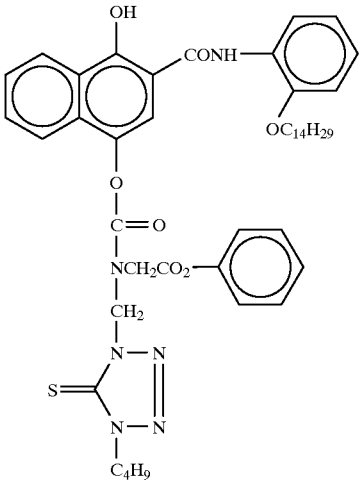
(8)
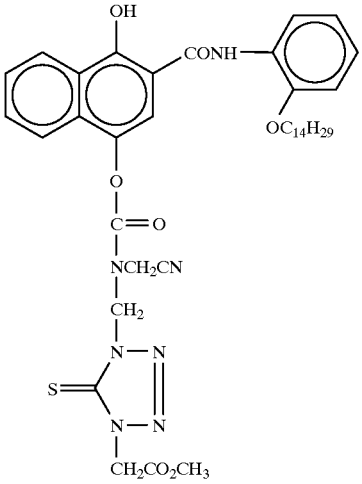
(9)
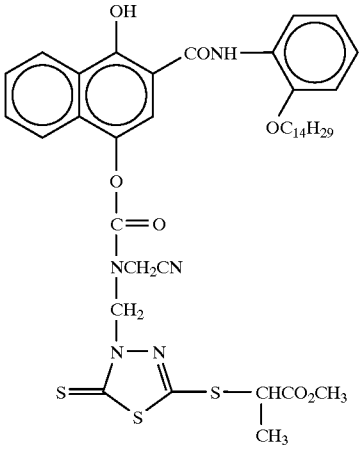

-continued
(10)
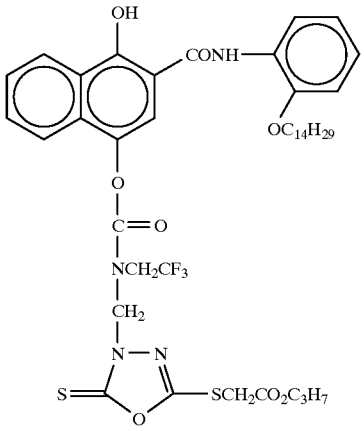
(11)
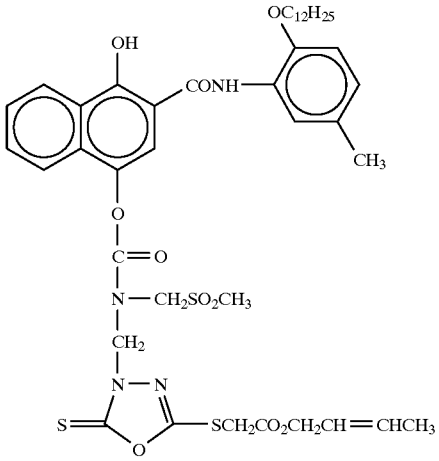
(12)
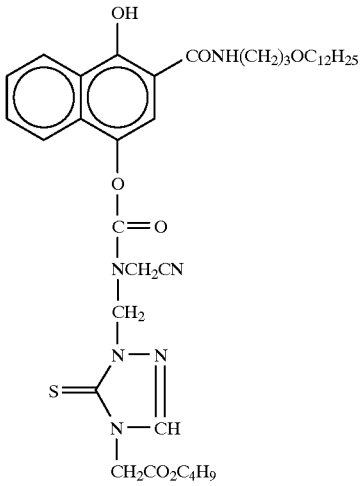

-continued
(13)
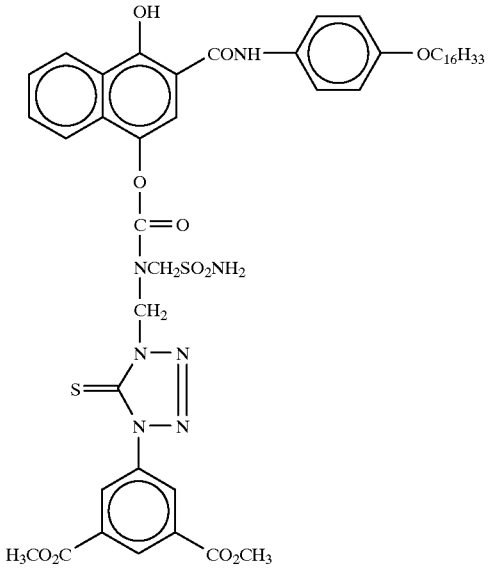
(14)
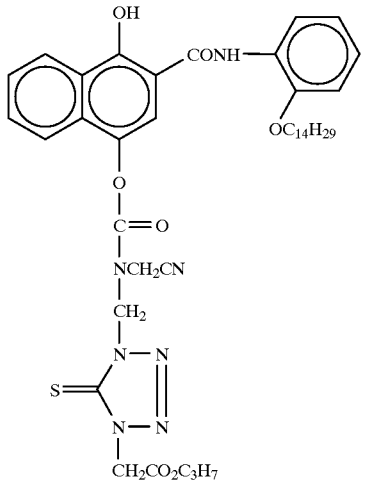
(15)
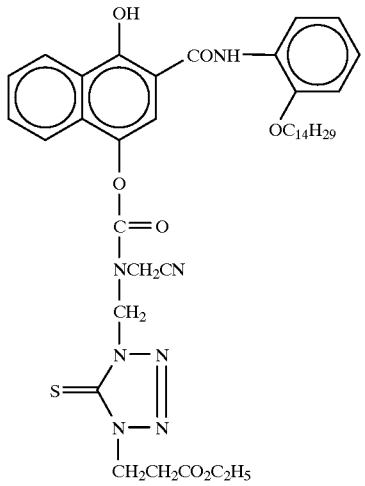

-continued
(16)
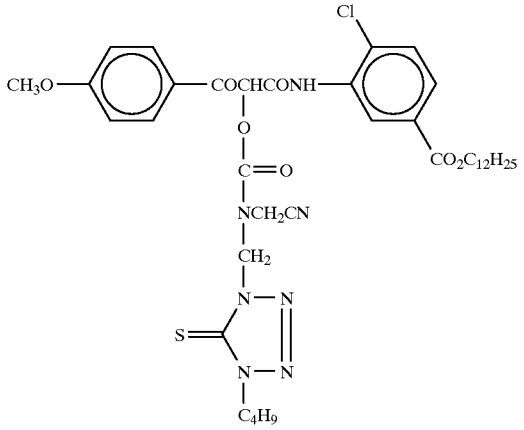
(17)
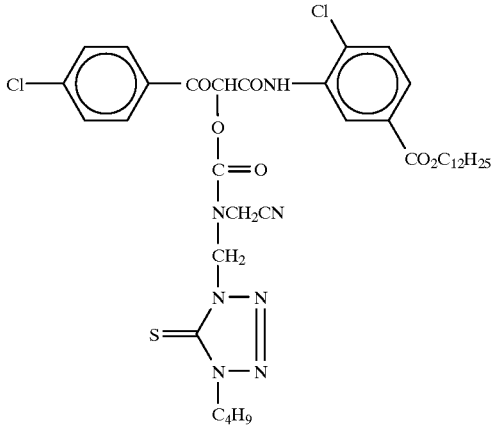
(18)
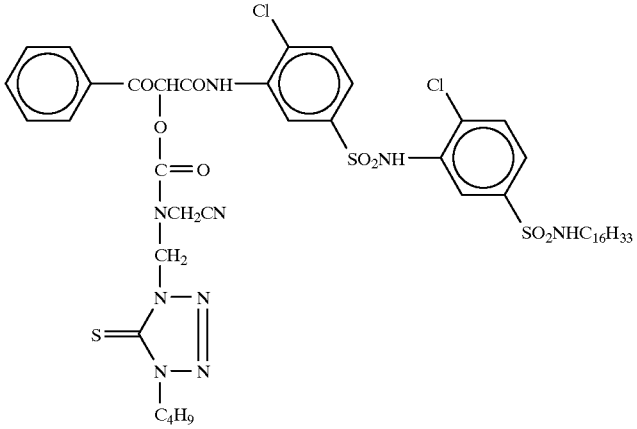

-continued
(19)
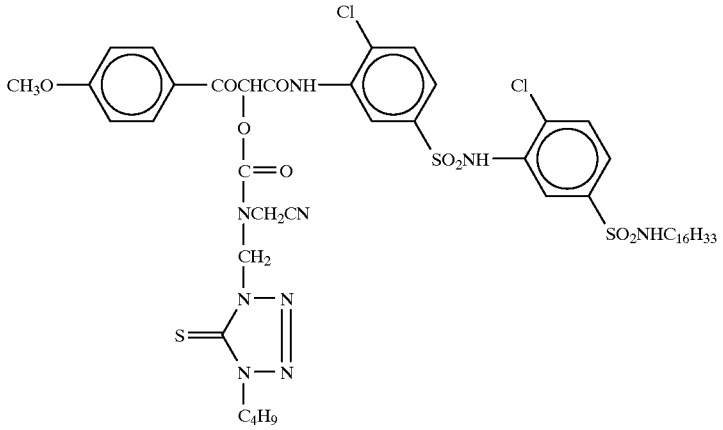
(20)
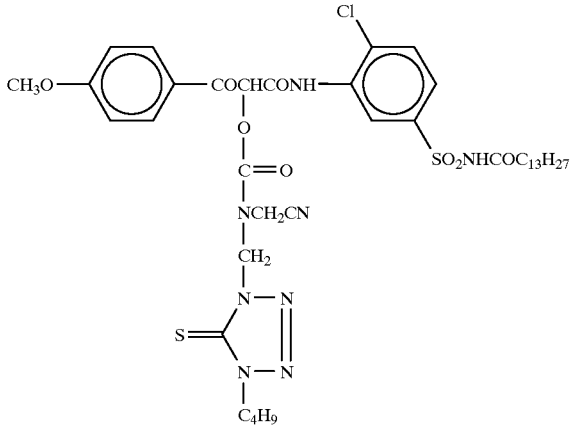
(21)
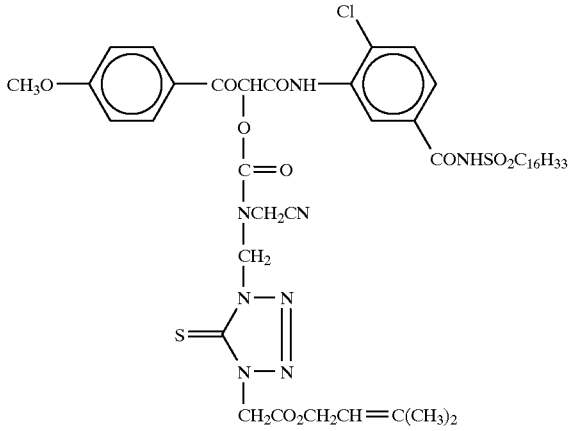

-continued
(22)
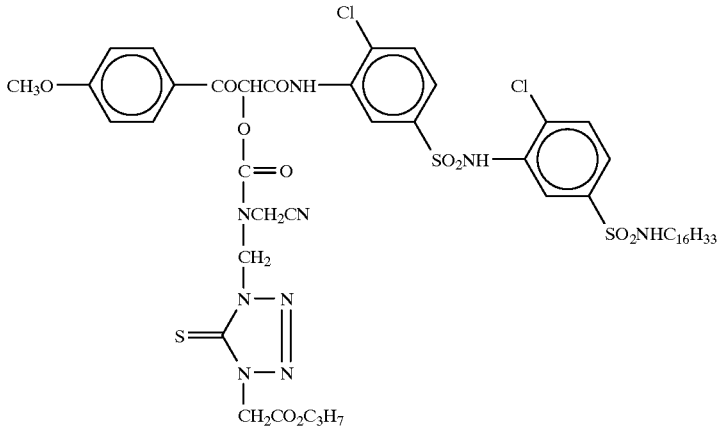
(23)
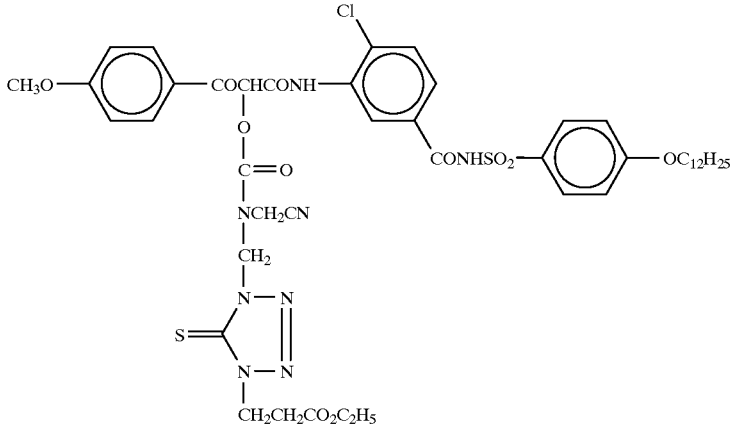
(24)
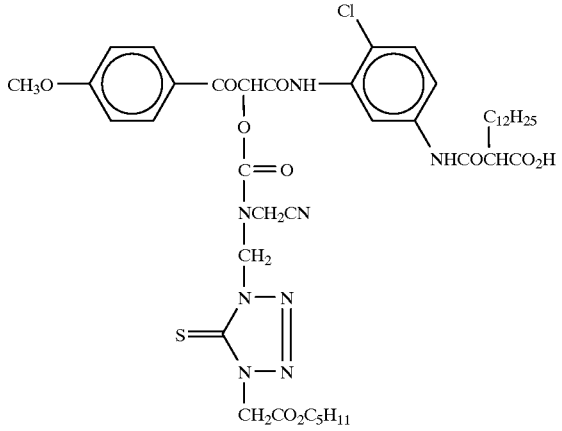

-continued
(25)
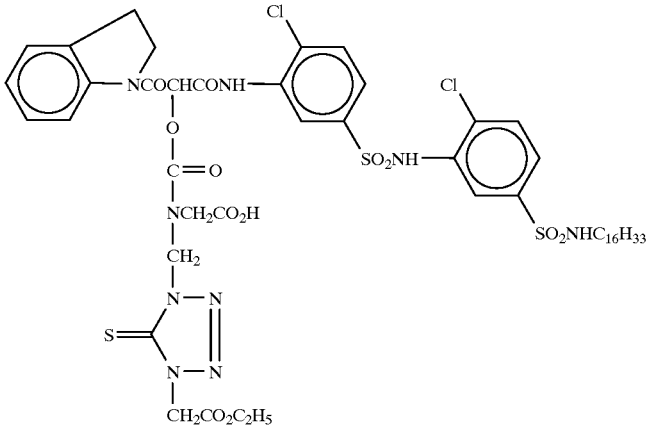
(26)
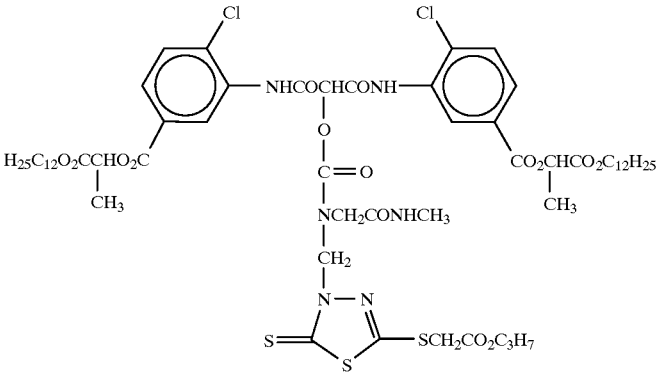
(27)
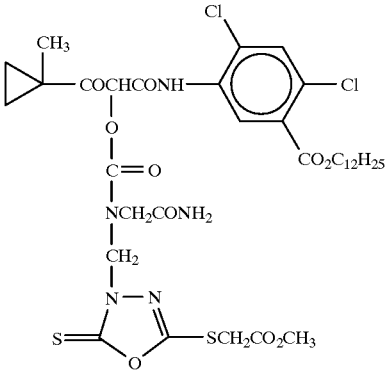

-continued
(28)
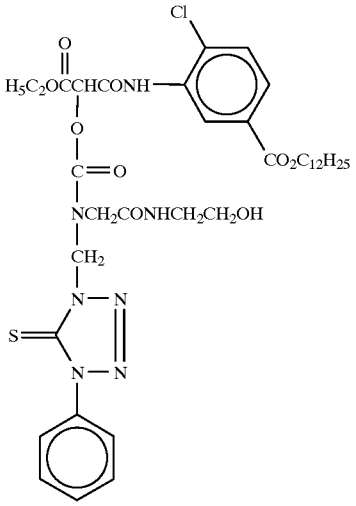
(29)
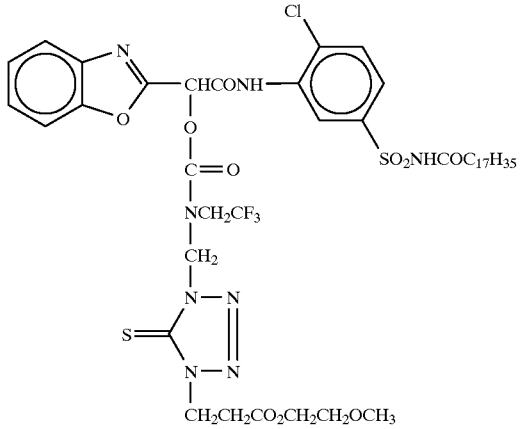
(30)
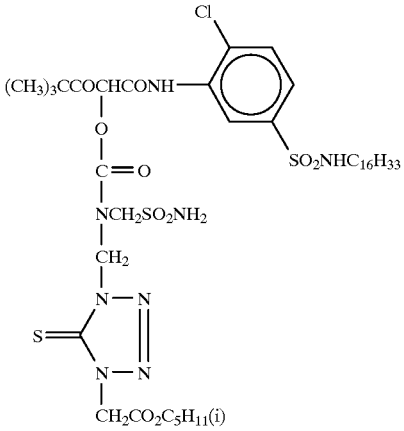

-continued
(31)
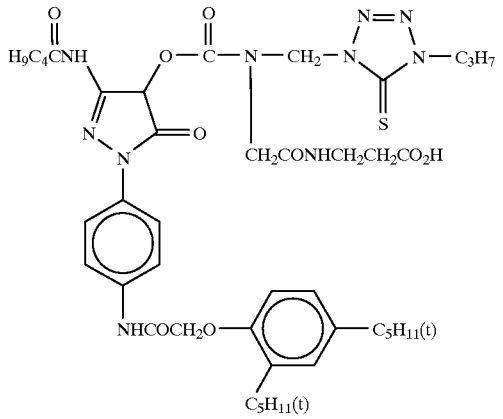
(32)
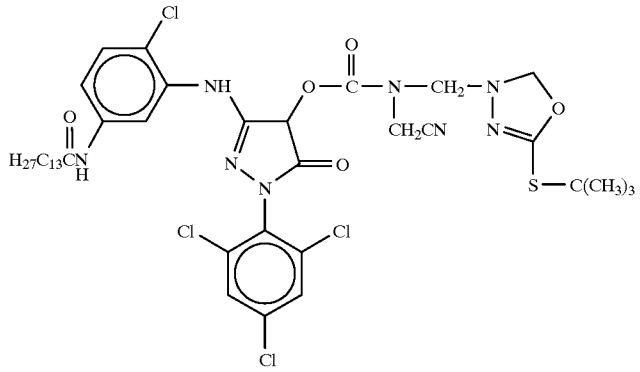
(33)
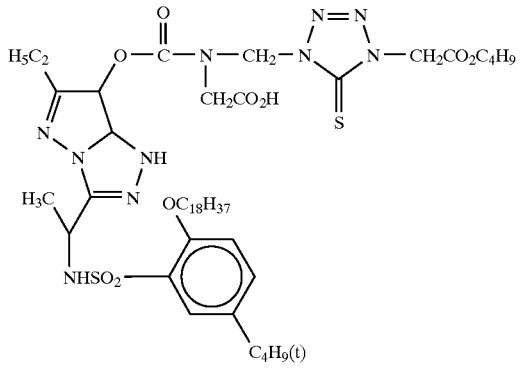
(34)
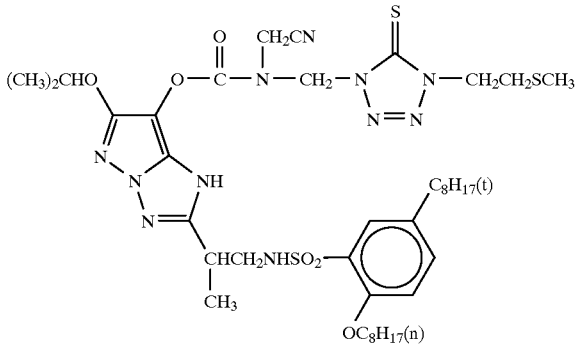

-continued
(35)
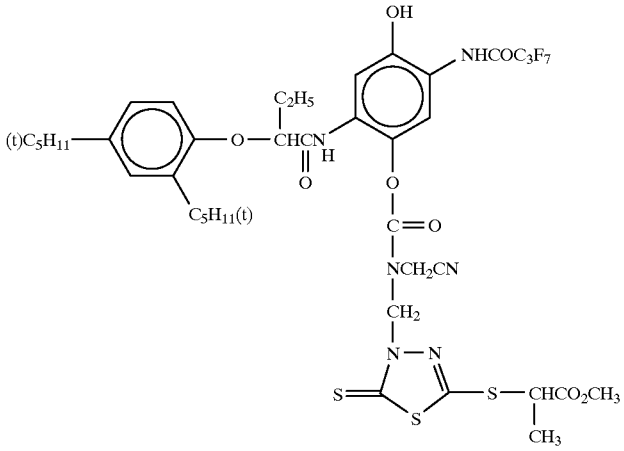
(36)
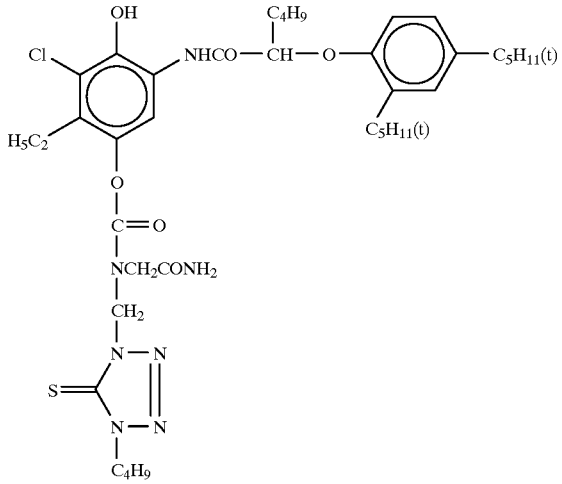
(37)
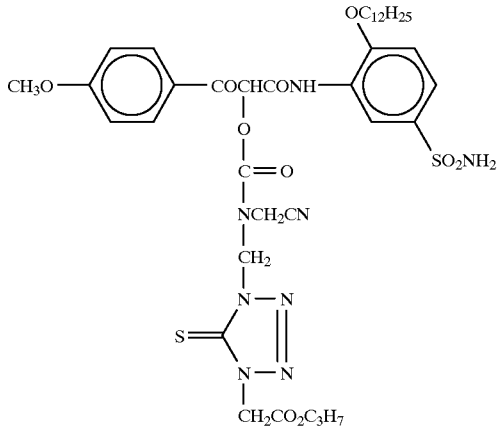

-continued
(38)
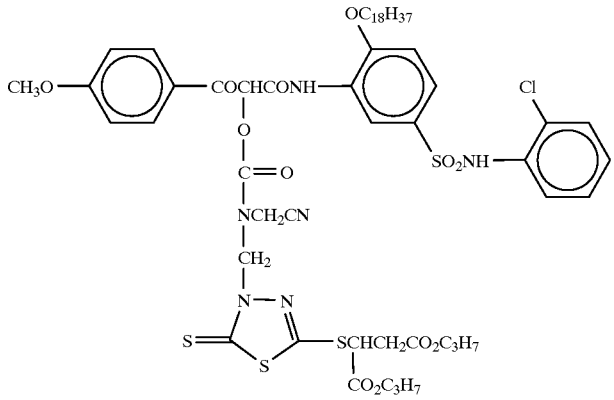
(39)
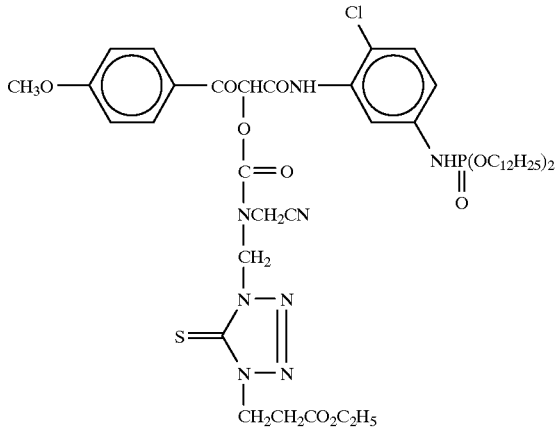
(40)
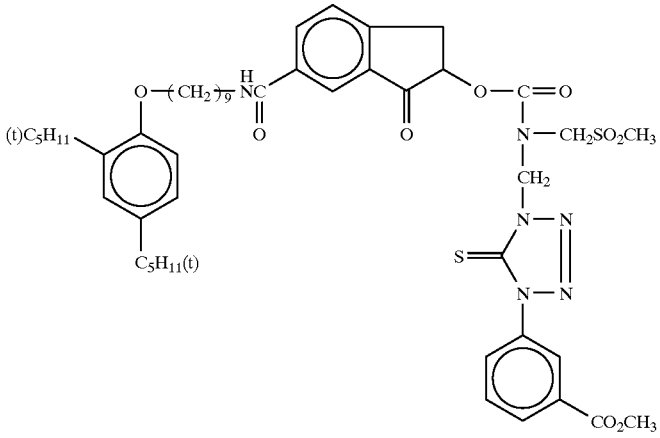

-continued
(41)
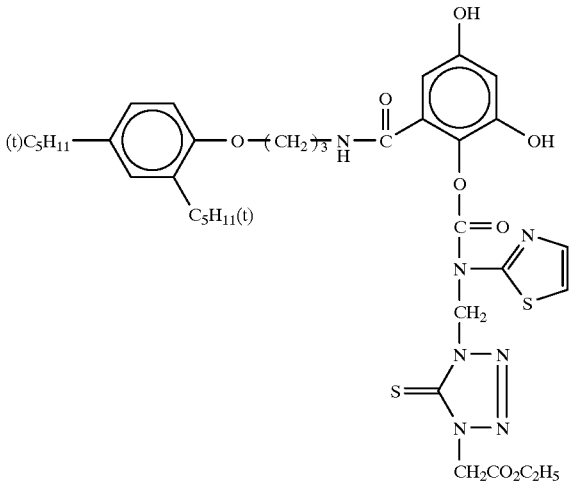
(42)
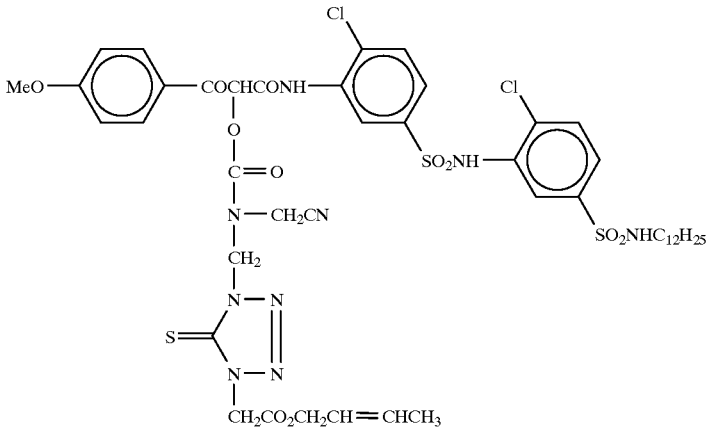
(43)
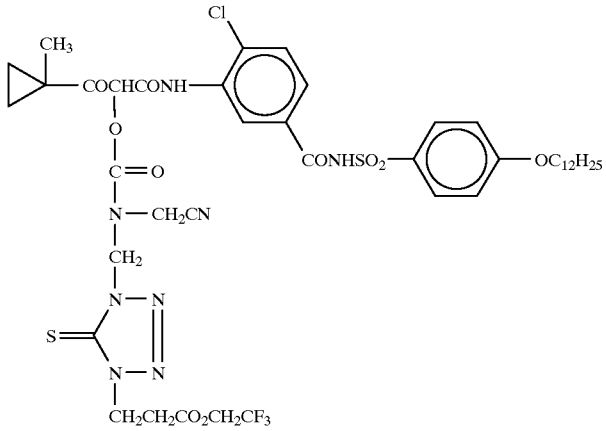

-continued
(44)
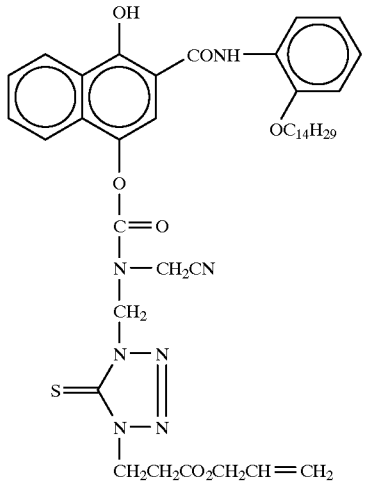
(45)
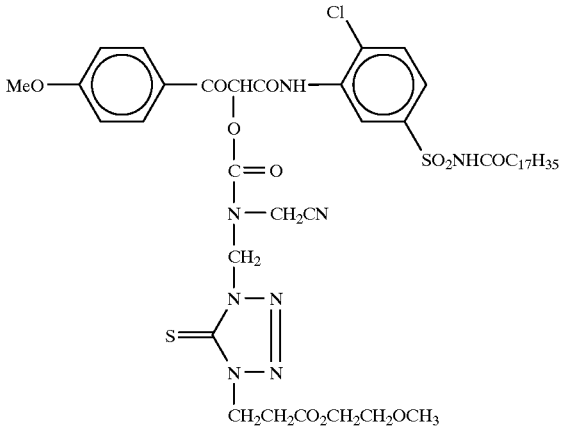
(46)
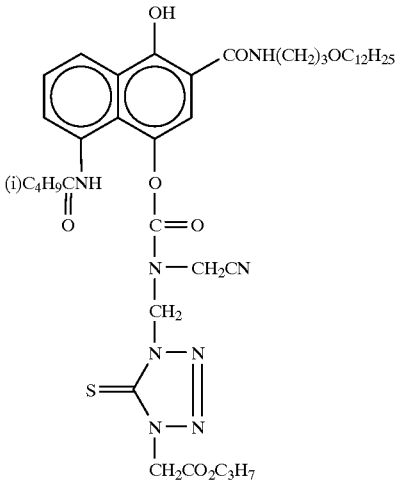

-continued (47)

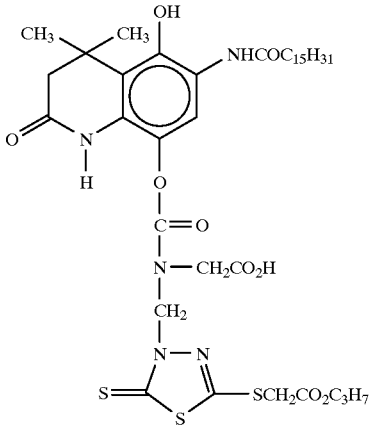

(48)

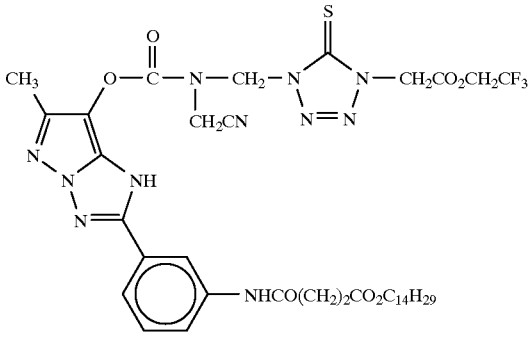

Compounds of the present invention can be synthesized in accordance with methods described in Jpn. Pat. Appln. KOKAI Publication Nos. 5-313322 (JP-A-5-313322) and 5-331145.

Practical synthesis examples of compounds of the present invention will be described below. Synthesis example 1 (synthesis of example compound (1))

An example compound (1) was synthesized by the following reaction formula.

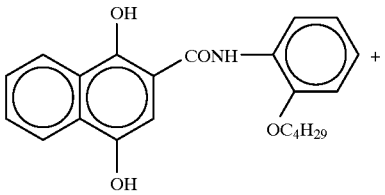

(I-1)

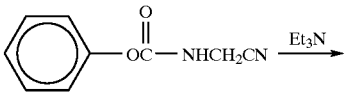

(I-2)

-continued

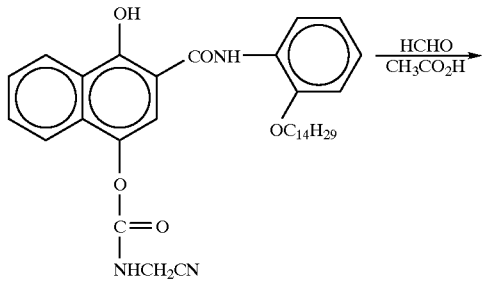

(I-3)

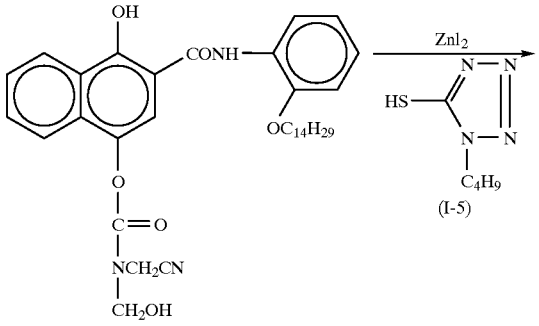

(I-4)

(I-5)

Example compound (1)

Synthesis of Intermediate (I-3)

40.0 g of (I-1) and 17.5 g of (I-2) were dissolved in 300 ml of ethyl acetate, and 23 ml of triethylamine were added to the solution. The resultant mixture was stirred at 80° C. for 3 hr. The reaction mixture was cooled with ice, and 200 ml of 1 N hydrochloric acid and 300 ml of hexane were sequentially added. The precipitated crystal was filtered, washed with hexane, and dried to obtain an intermediate (I-3) weighing 18.0 g (yield 37%).

Synthesis of Intermediate (I-4)

A mixture of 18.0 g of (I-3), 10.0 g of paraformaldehyde, 30 ml of acetic acid, and 100 ml of 1,2-dichloroethane was heated and reacted under reflux for 10 hr. After being cooled to room temperature, the reaction solution was washed with water and dried with anhydrous sodium sulfate. Thereafter, the solvent was distilled off. The residue was refined through a silica gel column chromatography to obtain an intermediate (I-4) weighing 7.0 g (yield 37%). The structure of the resultant intermediate (I-4) compound was checked by $^1$HNMR and a mass spectrum.

$^1$HNMR ($CDCl_3$), δ0.90 (3H, t), 1.0–1.6 (22H, m), 1.90 (2H, m), 4.07 (2H, br t), 4.40, 4.52 (2H, s in total because of a stereoisomer mixture), 5.05, 5.28 (2H, s in total), 6.79 (1H, d), 6.97 (1H, t), 7.08 (1H, t), 7.28 (1H, s), 7.50–7.80 (3H, m), 8.33 (1H, d), 8.45 (1H, br), 8.63 (1H, br), 13.64 (1H, br). MS m/z 603 ($M^+$)

Synthesis of Example Compound (1)

14.4 g of zinc iodide were added to a mixture of 6.5 g of (I-4), 3.4 g of (I-5), and 100 ml of dichloroethane at room temperature, and the resultant material was reacted for 15 hr. After 50 ml of 1 N hydrochloric acid were added, the organic layer was sequentially washed with water and saturated salt water. The organic layer was dried with anhydrous sodium sulfate, and the solvent was distilled off. The residue was refined through a silica gel column chromatography to obtain an example compound (I) weighing 3.8 g (yield 48%). The melting point was 100 to 102° C. The structure of the resultant example compound (I) was checked by $^1$HNMR and a mass spectrum.

$^1$HNMR ($CDCl_3$), δ0.90 (3h, t), 1.02 (3H, t), 1.1–1.6 (24H, m), 1.93 (4H, m), 4.10 (2H, m), 4.31 (2H, m), 4.70, 4.93 (2H, s in total because of a stereoisomer mixture), 6.05, 6.22 (2H, s in total), 6.98 (1H, d), 7.05 (1H, t), 7.12 (1H, t), 7.38, 7.40 (1H, s in total), 7.62 (1H, t), 7.70 (1H, t), 7.85, 7.92 (1H, d in total), 8.40 (1H, d), 8.53 (1H, d), 8.70 (1H, s), 13.65 (1H, s) MS m/z 743 ($M^+$)

Synthesis Example 2 (synthesis of example compound (18))

An example compound (18) was synthesized by the following reaction formula.

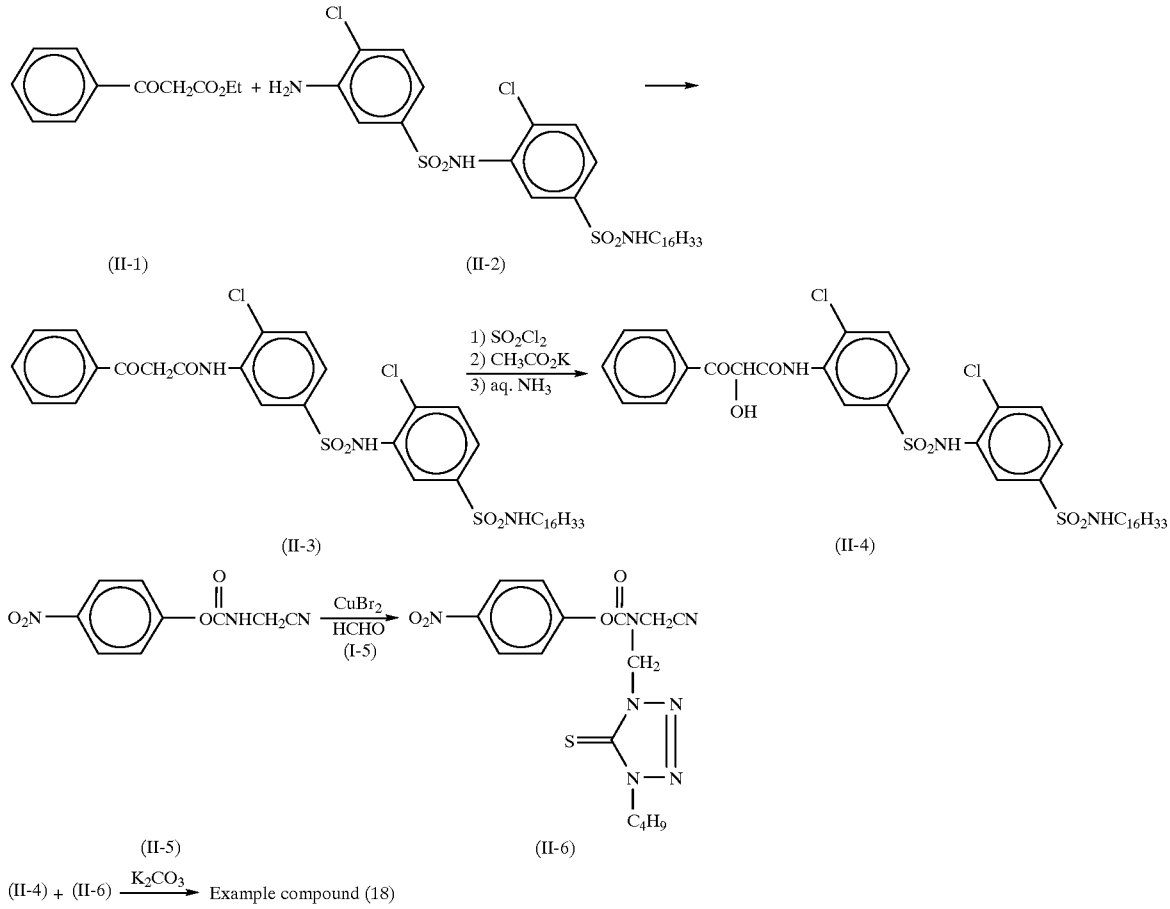

Synthesis of Intermediate (II-3)

A mixture of 100 ml of (II-1) and 200 g of (II-2) was stirred under reduced pressure with an aspirator at 130° C. for 8 hr. The reaction mixture was cooled to 60° C., 800 ml of methanol and 40 ml of water were added to the mixture, and the resultant mixture was again heated and dissolved.

After the resultant material was cooled with standing, the precipitated crystal was filtered, washed with methanol, and dried to obtain an intermediate (II-3) weighing 176 g (yield 71%).

Synthesis of Intermediate (II-4)

120 g of (II-3) were dissolved in 600 ml of dichloromethane, and 12.8 ml of sulfuryl chloride were added to the solution at room temperature. After being stirred at room temperature for 1 hr, the reaction solution was sequentially washed with water and saturated salt water. The organic layer was dried with anhydrous sodium sulfate, and the solvent was distilled off. The residue was dissolved in 130 ml of N,N-dimethylacetamide and 70 ml of acetic acid, 60 g of anhydrous potassium acetate were added to the solution, and the resultant material was stirred at 55° C. for 1 hr. After the reaction mixture was cooled with standing, 800 ml of ethyl acetate were added to the mixture, and the resultant material was sequentially washed with water and saturated salt water. The organic layer was dried with anhydrous sodium sulfate, and the solvent was distilled off. The residue was dissolved in 300 ml of methanol, and 90 ml of 30% ammonia water were added under nitrogen stream. The resultant mixture was heated to 40° C. and reacted for 2 hr. The reaction solution was cooled with ice, and 120 ml of 6 N hydrochloric acid were added. The reaction solution was extracted with ethyl acetate and sequentially washed with water and saturated salt water. The organic layer was dried with anhydrous sodium sulfate, and the solvent was distilled off to obtain a coarse product of an intermediate (II-4) weighing 122 g. This product was directly used in the subsequent reaction without being refined.

Synthesis of Intermediate (II-6)

A mixture of 60 g of (II-5), 8.6 g of paraformaldehyde, 42.9 g of (I-5), 30.3 g of anhydrous copper(II) bromide, and 500 ml of 1,2-dichloroethane was stirred at 45° C. for 10 hr. The reaction mixture was cooled to room temperature, and 300 ml of 1 N hydrochloric acid were added. The organic layer was sequentially washed with water and saturated salt water and dried with anhydrous sodium sulfate, and the solvent was distilled off. The residue was refined through a silica gel column chromatography to obtain an intermediate (II-6) weighing 53 g (yield 50%).

Synthesis of Example Compound (18)

26.7 g of (II-4) and 11.1 g of (II-6) were dissolved in 80 ml of N,N-dimethylformamide, and 18.8 g of anhydrous potassium carbonate were added to the solution under nitrogen stream. The resultant mixture was reacted at room temperature for 3 hr, and 600 ml of ethyl acetate and 300 ml of water were added. The organic layer was sequentially washed with an aqueous potassium carbonate solution, 0.5 N hydrochloric acid, water, and saturated salt water, and dried with anhydrous sodium sulfate. The solvent was distilled off, and the residue was refined through a silica gel column chromatography to obtain an example compound (18) weighing 14.7 g (yield 50%). Amorphous. The structure of the resultant example compound (18) was checked by $^1$HNMR and a mass spectrum.

$^1$HNMR ($CDCl_3$), δ0.95 (3H, t), 1.00 (3H, t), 1.1–1.5 (30H, m), 1.92 (2H, m), 2.90 (2H, m), 4.30 (2H, t), 4.80 (2H, m), 5.09 (1H, t), 6.02 (2H, m), 6.52, 6.63 (1H, s in total because of a stereoisomer mixture), 7.25–7.77 (8H, m), 8.0–8.2 (3H, m), 8.57, 8.70 (1H, s in total), 8.83, 9.15 (1H, s in total) MS m/z 1034 ($M^+$+1)

A compound represented by formula (I) of the present invention is used in a light-sensitive material to improve the color reproduction by giving a satisfactory interlayer effect to a layer or improve the sharpness. The addition amount is $1\times10^{-6}$ to $1\times10^{-2}$ mol, preferably $5\times10^{-5}$ to $1\times10^{-3}$ mol per 1 $m^2$ of a light-sensitive material.

A compound represented by formula (I) can be used in any of blue-sensitive emulsion layers, green-sensitive emulsion layers, red-sensitive emulsion layers, and non-light-sensitive layers (e.g., interlayers, protective layers, antihalation layers, and white pigment layers). The compound is preferably used in an underlying layer (formed close to a support) of layers constituting a light-sensitive material. The compound is particularly preferable in development when the color development time of the present invention is shortened.

As a compound represented by formula (I), the same compound can be used in a plurality of layers, different compounds can be used in the same layer, or different compounds can be used in different layers in accordance with the intended use. Furthermore, these compounds can be used together with well-known DIR compounds (e.g., DIR compounds described in R. D. No. 307105).

A compound represented by formula (I) of the present invention is characterized by $X_1$ in formula (I) with respect to practical compounds described in Jpn. Pat. Appln. KOKAI Publication No. 5-31332 described previously.

Practical compounds equal to $X_1$ in formula (I) of the present invention are described in Jpn. Pat. Appln. KOKAI Publication No. 7-133259 (JP-A-7-133259). However, these compounds are different from the compounds of the present invention in that a portion corresponding to DI is limited to an azole development inhibitor. Additionally, Jpn. Pat. Appln. KOKAI Publication No. 7-133259 relates to methods of compound synthesis and does not refer to effects on photographic properties at all.

The present invention well achieved the object of the present invention by specifying $X_1$ in formula (I) and combining mercaptoazole development inhibitors as DI.

In the light-sensitive material of the present invention, at least one light-sensitive layer need only be formed on a support. A typical example is a silver halide photographic light-sensitive material having, on its support, at least one light-sensitive layer constituted by a plurality of silver halide emulsion layers which are sensitive to essentially the same color but have different sensitivities. This light-sensitive layer is a unit sensitive layer which is sensitive to one of blue light, green light, and red light. In a multilayered silver halide color photographic light-sensitive material, such unit light-sensitive layers are generally arranged in the order of red-, green-, and blue-sensitive layers from a support. However, according to the intended use, this arrangement order may be reversed, or light-sensitive layers sensitive to the same color may sandwich another light-sensitive layer sensitive to a different color. Non-light-sensitive layers can be formed between the silver halide light-sensitive layers and as the uppermost layer and the lowermost layer. These non-light-sensitive layers can contain, e.g., couplers, DIR compounds, and color amalgamation preventives to be described later. As a plurality of silver halide emulsion layers constituting each unit light-sensitive layer, as described in West German Patent No. 1,121,470 or British Patent No. 923,045, high- and low-speed emulsion layers are preferably arranged such that the sensitivity is sequentially decreased toward a support. In addition, as described in Jpn. Pat. Appln. KOKAI Publication Nos. 57-112751, 62-200350, 62-206541, and 62-206543, layers may be arranged such that a low-speed emulsion layer is formed farther from a support and a high-speed layer is formed close to the support.

More specifically, layers may be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL, or the order of BH/BL/GH/GL/RL/RH.

In addition, as described in Jpn. Pat. Appln. KOKOKU Publication No. 55-34932, layers may be arranged from the farthest side from a support in the order of blue-sensitive layer/GH/RH/GL/RL. Furthermore, as described in Jpn. Pat. Appln. KOKAI Publication Nos. 56-25738 and 62-63936, layers may be arranged from the farthest side from a support in the order of blue-sensitive layer/GL/RL/GH/RH.

As described in Jpn. Pat. Appln. KOKOKU Publication No. 49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in the order of medium-speed emulsion layer/high-speed emulsion layer/low-speed emulsion layer from the farthest side from a support in a layer sensitive to one color as described in Jpn. Pat. Appln. KOKAI Publication No. 59-202464.

In addition, the order of high-speed emulsion layer/low-speed emulsion layer/medium-speed emulsion layer or low-speed emulsion layer/medium-speed emulsion layer/high-speed emulsion layer may be adopted. Furthermore, the arrangement can be changed as described above even when four or more layers are formed.

In order to improve the color reproduction, a donor layer (CL) with an interlayer effect, which is described in U.S. Pat. No. 4,663,271, 4,705,744, or 4,707,436, or Jpn. Pat. Appln. KOKAI Publication No. 62-160448 or 63-89580 and different from the main light-sensitive layers BL, GL, and RL in spectral sensitivity distribution, is preferably formed adjacent to or close to the main light-sensitive layers.

A preferable silver halide used in the present invention is silver iodobromide, silver iodochloride, or silver iodochlorobromide containing about 1 mol % to about 30 mol % of silver iodide. A particularly preferable silver halide is silver iodobromide or silver iodochlorobromide containing about 2 mol % to about 10 mol % of silver iodide.

Silver halide grains contained in the photographic emulsion may have regular crystals such as cubic, octahedral, or tetradecahedral crystals, irregular crystals such as spherical or tabular crystals, crystals having crystal defects such as twinned crystal faces, or composite shapes thereof.

A silver halide can consist of fine grains having a grain size of about 0.2 $\mu$m or less or large grains having a projected area diameter of about 10 $\mu$m, and an emulsion may be either a polydisperse or monodisperse emulsion.

A silver halide photographic emulsion which can be used in the present invention can be prepared by methods described in, e.g., "I. Emulsion preparation and types," Research Disclosure (RD) No. 17643 (December, 1978), pp. 22 and 23, RD No. 18716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394 and British Patent No. 1,413,748 are also preferable.

Also, tabular grains having an aspect ratio of about 3 to 40 can be used in the present invention. Tabular grains can be easily prepared by methods described in, e.g., Gutoff, "Photographic Science and Engineering", Vol. 14, pp. 248 to 257 (1970); U.S. Pat. Nos. 4,434,226, 4,414,310, 4,433,048, and 4,439,520, and British Patent No. 2,112,157.

A crystal structure can be uniform, can have different halogen compositions in the interior and the surface layer thereof, or can be a layered structure. Alternatively, a silver halide having a different composition can be bonded by an epitaxial junction, or a compound except for a silver halide such as silver rhodanide or zinc oxide can be bonded. A mixture of grains having various types of crystal shapes can also be used.

The above emulsion can be any of a surface latent image type emulsion which mainly forms a latent image on the surface of a grain, an internal latent image type emulsion which forms a latent image in the interior a grain, and an emulsion of another type which has latent images on the surface and in the interior of a grain. However, the emulsion must be a negative type emulsion. The internal latent image type emulsion can be a core/shell internal latent image type emulsion described in Jpn. Pat. Appln. KOKAI Publication No. 63-264740. A method of preparing this core/shell internal latent image type emulsion is described in Jpn. Pat. Appln. KOKAI Publication No. 59-133542. Although the thickness of a shell of this emulsion depends on, e.g., development conditions, it is preferably 3 to 40 nm, and most preferably 5 to 20 nm.

A silver halide emulsion layer is normally subjected to physical ripening, chemical ripening, and spectral sensitization steps before it is used. Additives for use in these steps are described in RD Nos. 17643, 18716, and 307105, and they are summarized in a table presented later.

In the light-sensitive material of the present invention, it is possible to simultaneously use, in a single layer, two or more types of emulsions different in at least one of the characteristics of a light-sensitive silver halide emulsion, i.e., the grain size, grain size distribution, halogen composition, grain shape, and sensitivity.

It is also possible to preferably use surface-fogged silver halide grains described in U.S. Pat. No. 4,082,553, internally fogged silver halide grains described in U.S. Pat. No. 4,626,498 and Jpn. Pat. Appln. KOKAI Publication No. 59-214852, and colloidal silver, in light-sensitive silver halide emulsion layers and/or essentially non-light-sensitive hydrophilic colloid layers. The internally fogged or surface-fogged silver halide grain means a silver halide grain which can be developed uniformly (non-imagewise) regardless of whether the location is a non-exposed portion or an exposed portion of the light-sensitive material. Methods of preparing the internally fogged or surface-fogged silver halide grain are described in U.S. Pat. No. 4,626,498 and Jpn. Pat. Appln. KOKAI Publication No. 59-214852. A silver halide which forms the core of an internally fogged core/shell type silver halide grain can have a different halogen composition. As the internally fogged or surface-fogged silver halide, any of silver chloride, silver chlorobromide, silver iodobromide, and silver iodochlorobromide can be used. The grain size of these fogged silver halide grains is preferably 0.01 to 0.75 $\mu$m, and particularly preferably 0.05 to 0.6 $\mu$m. The grains can also be regular grains, and the emulsion can be a polydisperse emulsion. However, the emulsion is preferably a monodisperse emulsion (in which at least 95% of the weight or number of grains of silver halide grains have grain sizes within ±40% of an average grain size).

In the present invention, it is preferable to use a non-light-sensitive fine grain silver halide. The non-light-sensitive fine grain silver halide preferably consists of fine silver halide grains which are not exposed during imagewise exposure for obtaining a dye image and are not essentially developed during development. These fine silver halide grains are preferably not fogged in advance. The fine grain silver halide contains 0 to 100 mol % of silver bromide and can also contain silver chloride and/or silver iodide if necessary. The fine grain silver halide preferably contains 0.5 to 10 mol % of silver iodide. The average grain size (the average value of equivalent circle diameters of projected areas) of the fine grain silver halide is preferably 0.01 to 0.5 μm, and more preferably 0.02 to 0.2 μm.

The fine grain silver halide can be prepared following the same procedures as for a common light-sensitive silver halide. In this case, the surface of each silver halide grain need not be optically sensitized nor spectrally sensitized. However, before the silver halide grains are added to a coating solution, it is preferable to add a well-known stabilizer such as a triazole-based compound, an azaindene-based compound, a benzothiazolium-based compound, a mercapto-based compound, or a zinc compound. Colloidal silver can be added to this fine grain silver halide-containing layer.

The silver coating amount of the light-sensitive material of the present invention is preferably 0.1 g/m$^2$ to 6.0 g/m$^2$, and most preferably 0.2 g/m$^2$ to 4.5 g/m$^2$.

Photographic additives usable in the present invention are also described in RDs, and the corresponding portions are summarized in the following table.

| | Additives | RD17643 | RD18716 |
|---|---|---|---|
| 1. | Chemical sensitizers | page 23 | page 648, right column |
| 2. | Sensitivity increasing agents | | page 648, right column |
| 3. | Spectral sensitizers, super sensitizers | pages 23–24 | page 648, right column to page 649, right column |
| 4. | Brighteners | page 24 | page 647, right column |
| 5. | Light absorbent, filter dye, ultraviolet absorbents | pages 25–26 | page 649, right column to page 650, left column |
| 6. | Binder | page 26 | page 651, left column |
| 7. | Plasticizers, lubricants | page 27 | page 650, right column |
| 8. | Coating aids, surface active agents | pages 26–27 | page 650, right column |
| 9. | Antistatic agents | page 27 | page 650, right column |
| 10. | Matting agent | | |
| | **Additives** | **RD307105** | |
| 1. | Chemical sensitizers | page 866 | |
| 2. | Sensitivity increasing agents | | |
| 3. | Spectral sensitizers, super sensitizers | pages 866–868 | |
| 4. | Brighteners | page 868 | |
| 5. | Light absorbent, filter dye, ultraviolet absorbents | page 873 | |
| 6. | Binder | pages 873–874 | |

-continued

| | Additives | RD17643 | RD18716 |
|---|---|---|---|
| 7. | Plasticizers, lubricants | page 876 | |
| 8. | Coating aids, surface active agents | pages 875–876 | |
| 9. | Antistatic agents | pages 876–877 | |
| 10. | Matting agent | pages 878–879 | |

Various dye forming couplers can be used in the light-sensitive material of the present invention, and the following couplers are particularly preferable.

Yellow couplers: couplers represented by formulas (I) and (II) in EP 502,424A; couplers (particularly Y-28 on page 18) represented by formulas (1) and (2) in EP 513,496A; a coupler represented by formula (I) in claim 1 of EP 568,037A; a coupler represented by Formula (I) in column 1, lines 45 to 55, in U.S. Pat. No. 5,066,576; a coupler represented by formula (I) in paragraph 0008 of Jpn. Pat. Appln. KOKAI Publication No. 4-274425; couplers (particularly D-35 on page 18) described in claim 1 on page 40 in EP 498,381A1; couplers (particularly Y-1 (page 17) and Y-54 (page 41)) represented by formula (Y) on page 4 in EP 447,969A1; and couplers (particularly II-17, II-19 (column 17), and II-24 (column 19)) represented by formulas (II) to (IV) in column 7, lines 36 to 58, in U.S. Pat. No. 4,476,219.

Magenta couplers: Jpn. Pat. Appln. KOKAI Publication No. 3-39737 (L-57 (page 11, lower right column), L-68 (page 12, lower right column), and L-77 (page 13, lower right column); (A-4)-63 (page 134), and (A-4)-73 and (A-4)-75 (page 139) in EP 456,257; M-4 and M-6 (page 26), and M-7 (page 27) in EP 486,965; M-45 (page 19) in EP 571,959A; (M-1) (page 6) in Jpn. Pat. Appln. KOKAI Publication No. 5-204106; and M-22 in paragraph 0237 of Jpn. Pat. Appln. KOKAI Publication No. 4-362631.

Cyan couplers: CX-1, CX-3, CX-4, CX-5, CX-11, CX-12, CX-14, and CX-15 (pages 14 to 16) in Jpn. Pat. Appln. KOKAI Publication No. 4-204843; C-7 and C-10 (page 35), C-34 and C-35 (page 37), and (I-1) and (I-17) (pages 42 and 43) in Jpn. Pat. Appln. KOKAI Publication No. 4-43345; and couplers represented by formulas (Ia) and (Ib) in claim 1 of Jpn. Pat. Appln. KOKAI Publication No. 6-67385.

Polymer couplers: P-1 and P-5 (page 11) in Jpn. Pat. Appln. KOKAI Publication No. 2-44345.

Couplers for forming a colored dye with a proper diffusibility are preferably those described in U.S. Pat. No. 4,366,237, GB 2,125,570, EP 96,873B, and DE 3,234,533.

Couplers for correcting unnecessary absorption of a colored dye are preferably yellow colored cyan couplers (particularly YC-86 on page 84) represented by formulas (CI), (CII), (CIII), and (CIV) described on page 5 in EP 456,257A1; yellow colored magenta couplers ExM-7 (page 202), EX-1 (page 249), and EX-7 (page 251) in EP 456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers (particularly example compounds on pages 36 to 45) represented by formula (A) in claim 1 of WO 92/11575.

Examples of a compound (including a coupler) which reacts with a developing agent oxidized form and releases a photographically useful compound residue are as follows. Development inhibitor release compounds: compounds (particularly T-101 (page 30), T-104 (page 31), T-113 (page 36), T-131 (page 45), T-144 (page 51), and T-158 (page 58))

represented by formulas (I), (II), (III), and (IV) described on page 11 in EP 378,236A1, compounds (particularly D-49 (page 51) represented by formula (I) described on page 7 in EP 436,938A2, compounds (particularly (23) (page 11) represented by formula (1) in EP 568,037A, and compounds (particularly I-(1) on page 29) represented by formulas (I), (II), and (III) described on pages 5 and 6 in EP 440,195A2; bleaching accelerator release compounds: compounds (particularly (60) and (61) on page 61) represented by formulas (I) and (I') on page 5 of EP 310,125A2, and compounds (particularly (7) (page 7)) represented by formula (I) in claim 1 of Jpn. Pat. Appln. KOKAI Publication No. 6-59411; ligand release compound: compounds (particularly compounds in column 12, lines 21 to 41) represented by LIG-X described in claim 1 of U.S. Pat. No. 4,555,478; leuco dye release compounds: compounds 1 to 6 in columns 3 to 8 of U.S. Pat. No. 4,749,641; fluorescent dye release compounds: compounds (particularly compounds 1 to 11 in columns 7 to 10) represented by COUP-DYE in claim 1 of U.S. Pat. No. 4,774,181; development accelerator or fogging agent release compounds: compounds (particularly (I-22) in column 25) represented by formulas (1), (2), and (3) in column 3 of U.S. Pat. No. 4,656,123, and ExZK-2 on page 75, lines 36 to 38, in EP 450,637A2; compounds which release a group which does not function as a dye unless it splits off: compounds (particularly Y-1 to Y-19 in columns 25 to 36) represented by formula (I) in claim 1 of U.S. Pat. No. 4,857,447.

Preferable examples of additives other than couplers are as follows.

Dispersants of an oil-soluble organic compound: P-3, P-5, P-16, P-19, P-25, P-30, P-42, P-49, P-54, P-55, P-66, P-81, P-85, P-86, and P-93 (pages 140 to 144) in Jpn. Pat. Appln. KOKAI Publication No. 62-215272; impregnating latexes of an oil-soluble organic compound: latexes described in U.S. Pat. No. 4,199,363; developing agent oxidized form scavengers: compounds (particularly I-(1), I-(2), I-(6), and I-(12) (columns 4 and 5)) represented by formula (I) in column 2, lines 54 to 62, in U.S. Pat. No. 4,978,606, and formulas (particularly compound 1 (column 3)) in column 2, lines 5 to 10, in U.S. Pat. No. 4,923,787; stain inhibitors: formulas (I) to (III) on page 4, lines 30 to 33, particularly I-47, I-72, III-1, and III-27 (pages 24 to 48) in EP 298321A; brown inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP 298321A, II-III-23, particularly III-10, in columns 25 to 38 of U.S. Pat. No. 5,122,444, I-1 to III-4, particularly II-2, on pages 8 to 12 in EP 471347A, and A-1 to A-48, particularly A-39 and A-42, in columns 32 to 40 of U.S. Pat. No. 5,139,931; materials which reduce the use amount of a color enhancer or a color amalgamation preventives: I-1 to II-15, particularly I-46, on pages 5 to 24 in EP 411324A; formalin scavengers: SCV-1 to SCV-28, particularly SCV-8, on pages 24 to 29 in EP 477932A; film hardeners: H-1, H-4, H-6, H-8, and H-14 on page 17 in Jpn. Pat. Appln. KOKAI Publication No. 1-214845, compounds (H-1 to H-54) represented by formulas (VII) to (XII) in columns 13 to 23 of U.S. Pat. No. 4,618,573, compounds (H-1 to H-76), particularly H-14, represented by formula (6) on page 8, lower right column, in Jpn. Pat. Appln. KOKAI Publication No. 2-214852, and compounds described in claim 1 of U.S. Pat. No. 3,325,287;

development inhibitor precursors: P-24, P-37, and P-39 (pages 6 and 7) in Jpn. Pat. Appln. KOKAI Publication No. 62-168139; compounds described in claim 1, particularly 28 and 29 in column 7, of U.S. Pat. No. 5,019,492; antiseptic agents and mildewproofing agents: I-1 to III-43, particularly II-1, II-9, II-10, II-18, and III-25, in columns 3 to 15 of U.S. Pat. No. 4,923,790; stabilizers and antifoggants: I-1 to (14), particularly I-1, I-60, (2), and (13), in columns 6 to 16 of U.S. Pat. No. 4,923,793, and compounds 1 to 65, particularly compound 36, in columns 25 to 32 of U.S. Pat. No. 4,952,483; chemical sensitizers: triphenylphosphine selenide and compound 50 in Jpn. Pat. Appln. KOKAI Publication No. 5-40324; dyes: a-1 to b-20, particularly a-1, a-12, a-18, a-27, a-35, a-36, and b-5, on pages 15 to 18 and V-1 to V-23, particularly V-1, on pages 27 to 29 in Jpn. Pat. Appln. KOKAI Publication No. 3-156450, F-I-1 to F-II-43, particularly F-I-11 and F-II-8, on pages 33 to 55 in EP 445627A, III-1 to III-36, particularly III-1 and III-3, on pages 17 to 28 in EP 457153A, fine crystal dispersions of Dye-1 to Dye-124 on pages 8 to 26 in WO 88/04794, compounds 1 to 22, particularly compound 1, on pages 6 to 11 in EP 319999A, compounds D-1 to D-87 (pages 3 to 28) represented by formulas (1) to (3) in EP 519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788; UV absorbents: compounds (18b) to (18r) and 101 to 427 (pages 6 to 9) represented by formula (1) in Jpn. Pat. Appln. KOKAI Publication No. 46-3335, compounds (3) to (66) (pages 10 to 44) and compounds HBT-1 to HBT-10 (page 14) represented by formula (III) in EP 520938A, and compounds (1) to (31) (columns 2 to 9) represented by formula (1) in EP 521823A.

The present invention can be applied to various color light-sensitive materials such as a color negative film for a general purpose or a movie, a color reversal film for a slide or a television, color paper, a color positive film, and color reversal paper. The present invention is also suited to film units with lens described in Jpn. Pat. Appln. KOKOKU Publication No. 2-32615 and Jpn. Utility Model Appln. KOKOKU Publication No. 3-39784.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the total film thickness of all hydrophilic colloid layers on the side having emulsion layers is preferably 28 $\mu$m or less, more preferably 23 $\mu$m or less, particularly preferably 18 $\mu$m or less, and most preferably 16 $\mu$m or less. A film swell speed $T_{1/2}$ is preferably 30 sec or less, and more preferably, 20 sec or less. $T_{1/2}$ is defined as a time which the film thickness requires to reach ½ of a saturation film thickness which is 90% of a maximum swell film thickness reached when processing is performed by using a color developer at 30° C. for 3 min and 15 sec. The film thickness means the thickness of a film measured under moisture conditioning at a temperature of 25° C. and a relative humidity of 55% (two days). $T_{1/2}$ can be measured by using a swell meter described in Photogr. Sci. Eng., A. Green et al., Vol. 19, No. 2, pp. 124 to 129. $T_{1/2}$ can be adjusted by adding a film hardening agent to gelatin as a binder or changing aging conditions after coating. The swell ratio is preferably 150 to 400%. The swell ratio can be calculated from the maximum swell film thickness under the conditions mentioned above by using (maximum swell film thickness—film thickness)/film thickness.

In the light-sensitive material of the present invention, hydrophilic colloid layers (called back layers) having a total dried film thickness of 2 to 20 $\mu$m are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The lubrication ratio of the back layers is preferably 150 to 500%.

The light-sensitive material of the present invention can be developed by conventional methods described in RD. No. 17643, pages 28 and 29, RD. No. 18716, page 651, left column to right column, and RD. No. 307105, pages 880 and 881.

Processing solutions used for color negative films in the present invention will be described below.

Compounds described in Jpn. Pat. Appln. KOKAI Publication No. 4-121739, page 9, upper right column, line 1 to page 11, lower left column, line 4 can be used in color developers used in the present invention. In performing rapid processing, color developing agents are preferably 2-methyl-4-(N-ethyl-N-(2-hydroxyethyl)amino)aniline, 2-methyl-4-(N-ethyl-N-(3-hydroxypropyl)amino)aniline, and 2-methyl-4-(N-ethyl-N-(4-hydroxybutyl)amino)aniline.

The use amount of these color developing agents is preferably 0.01 to 0.08 mol, more preferably 0.015 to 0.06 mol, and most preferably 0.02 to 0.05 mol per 1l of a color developer. A replenishment solution of the color developer is made contain a color developing agent whose concentration is preferably 1.1 to 3 times, and particularly preferably 1.3 to 2.5 times the above concentration.

Hydroxylamine can be extensively used as a preservative of the color developer. When a higher preservability is necessary, hydroxylamine derivatives having substituent groups such as an alkyl group, a hydroxyalkyl group, a sulfoalkyl group, and a carboxyalkyl group are preferable. Practical preferable examples are N,N-di(sulfoethyl) hydroxylamine, monomethylhydroxylamine, dimethylhydroxylamine, monoethylhydroxylamine, diethylhydroxylamine, N,N-di(carboxyethyl) hydroxylamine. Of these hydroxylamine derivatives, N,N-di(sulfoethyl)hydroxylamine is particularly preferable. Although these hydroxylamine derivatives can be used together with hydroxylamine, it is preferable that any of these derivatives be used in combination with one or more different types of derivatives instead of hydroxylamine.

The use amount of the preservative is preferably 0.02 to 0.2 mol, more preferably 0.03 to 0.15 mol, and most preferably 0.04 to 0.1 mol per 1 l. Also, as in the case of the color developing agent, a replenishment solution is preferably made contain a preservative whose concentration is 1.1 to 3 times the concentration of a mother solution (processing tank solution).

In the color developer, sulfite is used as a tar preventing agent for an oxidized form of the color developing agent. The use amount of sulfite is preferably 0.01 to 0.05 mol, and particularly preferably 0.02 to 0.04 mol per 1 l. In a replenishment solution, the concentration of sulfite is preferably 1.1 to 3 times the above value.

The pH of the color developer is preferably 9.8 to 11.0, and particularly preferably 10.0 to 10.5. In a replenishment solution, the pH is preferably higher by 0.1 to 1.0 than these values. To stably maintain such pH, well-known buffering agents such as carbonate, phosphate, sulfosalicylate, and borate are used.

The quantity of replenisher of the color developer is preferably 80 to 1300 ml per 1 $m^2$ of a light-sensitive material. To reduce environmental contamination, however, the quantity of replenisher is preferably as low as possible. More specifically, the quantity of replenisher is preferably 80 to 600 ml, and more preferably 80 to 400 ml.

A bromide ion concentration in the color developer is usually 0.01 to 0.06 mol per l. However, to suppress the fog and improve the discrimination and graininess while holding the sensitivity, the bromide ion concentration is preferably set at 0.015 to 0.03 mol per l. To set the bromide ion concentration in this range, it is only necessary to add bromide ion calculated by the following equation to the replenishment solution. If C is negative, it is preferable that no bromide ion be contained in the replenishment solution.

$$C=A-W/V$$

C: a bromide ion concentration (mol/l) in a color developer replenishment solution.

A: a target bromide ion concentration (mol/l) in a color developer.

W: an amount (mol) of bromide ion dissolves from a light-sensitive material into a color developer when 1 $m^2$ of a light-sensitive material is color-developed.

V: a quantity of replenisher (l) of a color developer replenishment solution per 1 $m^2$ of a light-sensitive material.

To increase the sensitive when the quantity of replenisher is decreased or a high bromide ion concentration is set, it is also preferable to use development accelerators such as pyrazolidones represented by 1-phenyl-3-pyrazolidone and 1-phenyl-2-methyl-2-hydroxymethyl-3-pyrazolidone and a thioether compound represented by 3,6-dithia-1,8-octanediol.

As the developing agents used in the present invention, hydrazine type developing agents can also be used in addition to the above-mentioned developing agents. More specifically, hydrazine type compounds described in Japanese Patent Application Nos. 7-63572, 7-343190, 7-334192, 7-334197, and 7-344396 can be preferably used.

As a method of development using these agents, it is possible to use wet methods such as a method by which development is performed by using a developer containing a conventional alkali agent and the developing agent and a method by which the developing agent is contained in a light-sensitive material and development is performed by using an activator solution, e.g., an alkali solution, containing no developing agent. In addition to these wet method, a heat development method can also be used.

When the activator method is used, it is also preferable to use a development method in which image amplification processing (intensification processing) using hydrogen peroxide is performed by reducing the silver coating amount in a light-sensitive material. More specifically, image formation methods using an activator solution containing hydrogen peroxide described in Japanese Patent Application Nos. 7-63587 and 7-334202 are preferably used.

Compounds and processing conditions described in Jpn. Pat. Appln. KOKAI Publication No. 4-125558, page 4, lower left column, line 16 to page 7, lower left column, line 6 can be applied to the processing solution with bleaching capacity according to the present invention.

The bleaching agent preferably has an oxidation reduction potential of 150 mV or more, and practical preferable examples are described in Jpn. Pat. Appln. KOKAI Publication Nos. 5-72694 and 5-173312. In particular, 1,3-diaminopropane tetraacetic acid and ferric complex salt of a compound of Example 1 on page 7 of Jpn. Pat. Appln. KOKAI Publication No. 5-173312 are preferable.

To improve the biodegradability of the bleaching agent, it is preferable to use any of compound ferric complex salts described in Jpn. Pat. Appln. KOKAI Publication Nos. 4-251845 and 4-268552, European Patent Nos. 588,289 and 591,934, and Jpn. Pat. Appln. KOKAI Publication No.

6-208213 as the bleaching agent. The concentration of these bleaching agents is preferably 0.05 to 0.3 mol per 1 l of the solution with bleaching capacity. To reduce the amount exhausted to the environment, the concentration is preferably designed to be 0.1 to 0.15 mol. If the solution with bleaching capacity is a bleaching solution, preferably 0.2 to 1 mol, and more preferably 0.3 to 0.8 mol of a bromide is contained per l.

A replenishment solution of the solution with bleaching capacity is basically made contain components at concentrations calculated by the following equation. This keeps the concentration in a mother solution constant.

$$C_R=C_T\times(V_1+V_2)/V_1+C_p$$

$C_R$: a concentration of a component in a replenishment solution.

$C_T$: a concentration of a component in a mother solution (processing tank solution).

$C_P$: a concentration of a component consumed during processing.

$V_1$: a quantity of replenisher (ml) of a replenishment solution with bleaching capacity per 1 $m^2$ of a light-sensitive material.

$V_2$: an amount (ml) carried over from a preceding bath by $m^2$ of a light-sensitive material.

In addition, the bleaching solution is preferably made contain a pH buffering agent, particularly dicarboxylic acid having little odor such as succinic acid, maleic acid, malonic acid, glutaric acid, or adipic acid. It is also preferable to use well-known bleaching accelerators described in Jpn. Pat. Appln. KOKAI Publication No. 53-95630, RD No. 17129, and U.S. Pat. No. 3,893,858.

It is preferable to replenish preferably 50 to 1000 ml, more preferably 80 to 500 ml, and most preferably 100 to 300 ml of a bleaching replenishment solution to the bleaching solution per 1 $m^2$ of a light-sensitive material. Furthermore, aeration is preferably performed for the bleaching solution.

Compounds and processing conditions described in Jpn. Pat. Appln. KOKAI Publication No. 4-125558, page 7, lower left column, line 10 to page 8, lower right column, line 19 can be applied to the processing solution with fixing capacity.

To improve the fixing speed and the preservability, compounds represented by formulas (I) and (II) in Jpn. Pat. Appln. KOKAI Publication No. 6-301169 are preferably added singly or jointly to the processing solution with fixing capacity. Also, the use of sulfinic acid such as p-toluenesulfinate described in Jpn. Pat. Appln. KOKAI Publication No. 1-224762 is preferable to improve the preservability.

In the solution with bleaching capacity and the solution with fixing capacity, the use of ammonium as cation is preferable to improve the desilvering characteristics. However, to reduce environmental contamination, ammonium is preferably reduced or not used.

In the bleaching, bleach-fix, and fixing steps, it is particularly preferable to perform jet stirring described in Jpn. Pat. Appln. KOKAI Publication No. 1-309059.

The quantity of replenisher of a replenishment solution in the bleach-fix or fixing step is 100 to 1000 ml, preferably 150 to 700 ml, and particularly preferably 200 to 600 ml per 1 $m^2$ of a light-sensitive material.

In the bleach-fix or fixing step, various silver recovery devices are preferably arranged as in-line or off-line devices to recover silver. When the in-line arrangement is used, processing can be performed while the silver concentration in a solution is decreased. As a consequence, the quantity of replenisher can be decreased. It is also preferable to recover silver by the off-line arrangement and reuse the residual solution as a replenishment solution.

The bleach-fix step or the fixing step can be constituted by a plurality of processing tanks, and these tanks are preferably cascaded to form a multistage counterflow system. To balance the size of a developing solution, a two-tank cascaded configuration is generally efficient. The processing time ratio of the preceding tank to the succeeding tank is preferably 0.5:1 to 1:0.5, and most preferably 0.8:1 to 1:0.8.

In the bleach-fix bath and the fixing solution, a free chelating agent which has not become a metal complex is preferably made exist to improve the preservability. As these chelating agents, the use of biodegradable chelating agents described above in connection with the bleaching solution is preferable.

The contents described in Jpn. Pat. Appln. KOKAI Publication No. 4-125558, page 12, lower right column, line 6 to page 13, lower right column, line 16 can be preferably applied to the washing and stabilization steps. To preserve the work environment, it is preferable to use azolylmethylamines described in European Patent Nos. 504,609 and 519,190 or N-methylolazoles described in Jpn. Pat. Appln. KOKAI Publication No. 4-362943, instead of formaldehyde, in the stabilizer, or to prepare a solution of a surfactant not containing an image stabilizing agent such as formaldehyde by making a magenta coupler divalent.

To reduce adhesion of dust to a magnetic recording layer applied on a light-sensitive material, a stabilizer described in Jpn. Pat. Appln. KOKAI Publication No. 6-289559 can be preferably used.

The quantity of replenisher of the washing solution and the stabilizer is preferably 80 to 1000 ml, more preferably 100 to 500 ml, and most preferably 150 to 300 ml per 1 $m^2$ of a light-sensitive material, in order to secure the washing or stabilizing function and reduce the waste solutions for environmental preservation. To prevent the propagation of bacteria and mildew in the processing performed with this quantity of replenisher, it is preferable to use well-known mildewproofing agents such as thiabendazole, 1,2-benzoisothiazoline-3-one, 5-chloro-2-methylisothiazoline-3-one, antibiotics such as gentamicin, and water deionized by using an ion exchange resin or the like. It is more effective to use deionized water in combination with mildewproofing agents or antibiotics.

It is also preferable to decrease the quantity of replenisher of the solution in the washing or stabilization tank by performing reverse osmotic film processing described in Jpn. Pat. Appln. KOKAI Publication Nos. 3-46652, 3-53246, 3-55542, 3-121448, and 3-126030. This reverse osmotic film is preferably a low-pressure reverse osmotic film.

In the processing of the present invention, it is particularly preferable to perform evaporation correction for a processing solution disclosed in JIII Journal of Technical Disclosure No. 94-4992. In particular, a method of performing correction on the basis of (equation-1) on page 2 by using the temperature and humidity information of a developing machine installation environment is preferable. Water used in evaporation correction is preferably taken from the washing replenishment tank. If this is the case, the use of deionized water as the washing replenishment water is preferable.

Processing agents described in the above-mentioned Journal of Technical Disclosure, page 3, right column, line 15 to page 4, left column, line 32 are preferably used in the present invention. As a developing machine used in the processing, a film processor described in page 3, right column, lines 22 to 28 is preferable.

Practical examples of processing agents, automatic processors, and evaporation correction methods preferably used in carrying out the present invention are described in the above-mentioned Journal of Technical Disclosure, page 5, right column, line 11 to page 7, right column, last line.

The supply form of a processing agent used in the present invention can be any of a liquid having the concentration of a solution to be used, a concentrated liquid, granules, a powder, pellets, a paste, and an emulsion. Examples of the processing agent are a liquid contained in a low-oxygen-permeability vessel disclosed in Jpn. Pat. Appln. KOKAI Publication No. 63-17453, vacuum-packed powders or granules disclosed in Jpn. Pat. Appln. KOKAI Publication Nos. 4-19655 and 4-230748, granules containing a water-soluble polymer disclosed in Jpn. Pat. Appln. KOKAI Publication No. 4-221951, pellets disclosed in Jpn. Pat. Appln. KOKAI Publication Nos. 51-61837 and 6-102628, and a paste processing agent disclosed in PCT No. 57-500485. Any of these forms can be preferably used. However, in respect of simplicity in use, the use of a liquid already prepared to have a concentration in use is preferable.

The material of vessels containing these processing agents can be any of polyethylene, polypropylene, polyvinylchloride, polyethyleneterephthalate, and nylon. These materials can be used singly or in the form of a composite material. The materials are so selected as to meet the level of a necessary oxygen permeability. Low-oxygen-permeability materials are suited to a solution such as a color developer which is readily oxidized. Practical examples are polyethyleneterephthalate and a composite material of polyethylene and nylon. The thickness of a vessel made from any of these materials is 500 to 1500 $\mu$m. The oxygen permeability is preferably 20 ml/m·24hrs·atm or less.

Processing solutions used for color reversal films in the present invention will be described below. The processing of color reversal films is described in detail in Known Techniques No. 6 (Apr. 1, 1991) issued by Aztec Limited Responsibility Company, page 1, line 5 to page 10, line 5, and page 15, line 8 to page 24, line 2. Any of the contents can be preferably applied.

In the processing of color reversal films, an image stabilizer is contained in a control bath or a final bath. Examples of this image stabilizer are formalin, sodium bisulfite formaldehyde, and N-methylolazoles. To preserve the work environment, the use of sodium bisulfite formaldehyde or N-methylolazoles is preferable, and N-methyloltriazole is particularly preferable among other N-methylolazoles. Also, the contents relating to the color developer, the bleaching solution, the fixer, and the washing water described in the processing of color negative films are preferably applicable to the processing of color reversal films.

Examples of color reversal film processing agents containing the above contents are an E-6 processing agent available from Eastman Kodak Co. and a CR-56 processing agent available from Fuji Photo Film Co., Ltd.

A magnetic recording layer used in the present invention will be described below.

A magnetic recording layer used in the present invention is formed by coating the surface of a support with an aqueous or organic solvent-based coating solution which is prepared by dispersing magnetic grains in a binder.

As the magnetic grains used in the present invention, it is possible to use grains of, e.g., ferromagnetic iron oxide such as $\gamma Fe_2O_3$, Co-deposited $\gamma Fe_2O_3$, Co-deposited magnetite, Co-containing magnetite, ferromagnetic chromium dioxide, a ferromagnetic metal, a ferromagnetic alloy, Ba ferrite of a hexagonal system, Sr ferrite, Pb ferrite, and Ca ferrite. Co-deposited ferromagnetic iron oxide such as Co-deposited $\gamma Fe_2O_3$ is preferable. The grain can take the shape of any of, e.g., a needle, a rice grain, a sphere, a cube, and a plate. A specific area is preferably 20 $m^2/g$ or more, and more specifically 30 $m^2/g$ or more as $S_{BET}$. The saturation magnetization ($\sigma s$) of the ferromagnetic substance is preferably $3.0\times10^4$ to $3.0\times10^5$ A/m, and most preferably $4.0\times10^4$ to $2.5\times10^5$ A/m. A surface treatment can be performed for the ferromagnetic grains by using silica and/or alumina or an organic material. Also, the surface of the ferromagnetic grain can be treated with a silane coupling agent or a titanium coupling agent as described in Jpn. Pat. Appln. KOKAI Publication No. 6-161032. A ferromagnetic grain whose surface is coated with an inorganic or organic substance, described in Jpn. Pat. Appln. KOKAI Publication No. 4-259911 or 5-81652, also can be used.

As the binder used in the magnetic grains, it is possible to use a thermoplastic resin described in Jpn. Pat. Appln. KOKAI Publication No. 4-219569, a thermosetting resin, a radiation-curing resin, a reactive resin, an acid, an alkali or biodegradable polymer, a natural polymer (e.g., a cellulose derivative and a sugar derivative), and their mixtures. Tg of the resin is −40° C. to 300° C., and its weight average molecular weight is 2000 to 1,000,000. Examples are a vinyl-based copolymer, cellulose derivatives such as cellulosediacetate, cellulosetriacetate, celluloseacetatepropionate, celluloseacetatebutylate, and cellulosetripropionate, an acrylic resin, and a polyvinylacetal resin. Gelatin is also preferable. Cellulosedi(tri)acetate is particularly preferable. The binder can be hardened by the addition of an epoxy-, aziridine-, or isocyanate-based crosslinking agent. Examples of the isocyanate-based crosslinking agent are isocyanates such as tolylenediisocyanate, 4,4'-diphenylmethanediisocyanate, hexamethylenediisocyanate, and xylylenediisocyanate, reaction products of these isocyanates and polyalcohol (e.g., a reaction product of 3 mol of tolylenediisocyanate and 1 mol of trimethilolpropane), and polyisocyanate produced by condensation of any of these isocyanates. These examples are described in Jpn. Pat. Appln. KOKAI Publication No. 6-59357.

As a method of dispersing the magnetic substance in the binder, as described in Jpn. Pat. Appln. KOKAI Publication No. 6-35092, the use of a kneader, a pin type mill, or an annular mill is preferable, and a combined use of these apparatuses also is preferable. Dispersants described in Jpn. Pat. Appln. KOKAI Publication No. 5-88283 and other known dispersants can be used. The thickness of the magnetic recording layer is 0.1 to 10 $\mu$m, preferably 0.2 to 5 $\mu$m, and more preferably 0.3 to 3 $\mu$m. The weight ratio of the magnetic grains to the binder is preferably 0.5:100 to 60:100, and more preferably 1:100 to 30:100. The coating amount of the magnetic grains is 0.005 to 3 $g/m^2$, preferably 0.01 to 2 $g/m^2$, and more preferably 0.02 to 0.5 $g/m^2$. The transmission yellow density of the magnetic recording layer is preferably 0.01 to 0.50, more preferably 0.03 to 0.20, and most preferably 0.04 to 0.15. The magnetic recording layer used in the present invention can be formed in the whole area of, or into the shape of stripes on, the back surface of a photographic support by coating or printing. As a method of coating the magnetic recording layer, it is possible to use any of an air doctor, a blade, an air knife, squeegee, impregnation, a reverse roll, a transfer roll, gravure, kiss, cast, spray, dip, a bar, and extrusion. A coating solution described in Jpn. Pat. Appln. KOKAI Publication No. 5-341436 is preferable.

The magnetic recording layer can be given a lubricating property improving function, a curling adjusting function, an antistatic function, an adhesion preventing function, and a head polishing function. Alternatively, another functional layer can be formed and these functions can be given to that layer. A polishing agent in which at least one type of grains are aspherical inorganic grains having a Mohs hardness of 5 or more is preferable. The composition of the aspherical inorganic grain is preferably an oxide such as aluminum oxide, chromium oxide, silicon dioxide, titanium dioxide, and silicon carbide, a carbide such as silicon carbide and titanium carbide, or a fine powder of diamond. The surfaces of the grains constituting these polishing agents can be treated with a silane coupling agent or a titanium coupling agent. These grains can be added to the magnetic recording layer or overcoated (as, e.g., a protective layer or a lubricant layer) on the magnetic recording layer. The binder used together with the grains can be any of those described above and is preferably the same binder as in the magnetic recording layer. Light-sensitive materials having the magnetic recording layer are described in U.S. Pat. Nos. 5,336,589, 5,250,404, 5,229,259, and 5,215,874, and European Patent No. 466,130.

A polyester support used in the present invention will be described below. Details of the polyester support and light-sensitive materials, processing, cartridges, and examples (to be described later) are described in Journal of Technical Disclosure No. 94-6023 (JIII; Mar. 15, 1994). Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferable. Polyethylene-2,6-naphthalate is most preferable among other polymers. The average molecular weight ranges between about 5,000 and 200,000. Tg of the polyester of the present invention is 50° C. or higher, preferably 90° C. or higher.

To give the polyester support a resistance to curling, the polyester support is heat-treated at a temperature of 40° C. to less than Tg, more preferably Tg—20° C. to less than Tg. The heat treatment can be performed at a fixed temperature within this range or can be performed together with cooling. The heat treatment time is 0.1 to 1500 hr, more preferably 0.5 to 200 hr. The heat treatment can be performed for a roll-like support or while a support is conveyed in the form of a web. The surface shape also can be improved by forming undulations (e.g., coating conductive inorganic fine grains such as $SnO_2$ or $Sb_2O_5$ grains) on the surface. It is desirable to knurl and slightly raise the end portion, thereby preventing the cut edge of the core portion from being photographed. These heat treatments can be performed in any stage after support film formation, after surface treatment, after back layer coating (e.g., an antistatic agent or a lubricating agent), and after undercoating. A preferable timing is after the antistatic agent is coated.

An ultraviolet absorbent can be incorporated into this polyester. Also, light piping can be prevented by incorporating dyes or pigments such as Diaresin manufactured by Mitsubishi Kasei Corp. or Kayaset manufactured by NIPPON KAYAKU CO. LTD. commercially available for polyester.

In the present invention, it is preferable to perform a surface treatment in order to adhere the support and the light-sensitive material constituting layers. Examples of the surface treatment are surface activation treatments such as a chemical treatment, a mechanical treatment, a corona discharge treatment, a flame treatment, an ultraviolet treatment, a high-frequency treatment, a glow discharge treatment, an active plasma treatment, a laser treatment, a mixed acid treatment, and an ozone oxidation treatment. Among other surface treatments, the ultraviolet irradiation treatment, the flame treatment, the corona treatment, and the glow treatment are preferable.

The undercoating layer can consist of a single layer or two or more layers. Examples of the undercoating layer binder are copolymers formed by using, as the starting material, a monomer selected from vinylchloride, vinylidenechloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells the support. Examples of a gelatin hardener added to the undercoating layer are chromium salt (e.g., chromium alum), aldehydes (e.g., formaldehyde and glutaraldehyde), isocyanates, an active halogen compound (e.g., 2,4-dichloro-6-hydroxys-triazine), an epichlorohydrin resin, and an active vinylsulfone compound. $SiO_2$, $TiO_2$, inorganic fine grains, or polymethylmethacrylate copolymer fine grains (0.01 to 10 $\mu$m) can also be contained as a matting agent.

In the present invention, antistatic agents are preferably used. Examples of these antistatic agents are carboxylic acid and carboxylate, a macromolecule containing sulfonate, a cationic macromolecule, and an ionic surfactant compound.

As the antistatic agent, it is most preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$ and having a volume resistivity of $10^7$ Ω·cm or less, more preferably $10^5$ Ω·cm or less and a grain size of 0.001 to 1.0 $\mu$m, fine grains of composite oxides (e.g., Sb, P, B, In, S, Si, and C) of these metal oxides, fine grains of sol metal oxides, or fine grains of composite oxides of these sol metal oxides. The content in the light-sensitive material is preferably 5 to 500 mg/m$^2$, and most preferably 10 to 350 mg/m$^2$. The ratio of a conductive crystalline oxide or its composite oxide to the binder is preferably 1/300 to 100/1, and more preferably 1/100 to 100/5.

The light-sensitive material of the present invention preferably has a slip property. Slip agent-containing layers are preferably formed on the surfaces of both a light-sensitive layer and a back layer. A preferable slip property is 0.01 to 0.25 as a coefficient of kinetic friction. This represents a value obtained when a stainless steel sphere 5 mm in diameter is conveyed at a speed of 60 cm/min (25° C., 60%RH). In this evaluation, a value of nearly the same level is obtained even when the surface of a light-sensitive layer is used as the sample to be measured.

Examples of the slip agent usable in the present invention are polyorganocyloxane, higher fatty acid amide, higher fatty acid metal salt, and esters of higher fatty acid and higher alcohol. As the polyorganocyloxane, it is possible to use polydimethylcyloxane, polydiethylcyloxane, polystyrylmethylcyloxane, and polymethylphenylcyloxane. A layer to which the slip agent is added is preferably the outermost emulsion layer or the back layer. Polydimethylcyloxane or ester having a long-chain alkyl group is particularly preferable.

The light-sensitive material of the present invention preferably contains a matting agent. The matting agent can be added to either the emulsion surface or the back surface and is most preferably added to the outermost emulsion layer. The matting agent can be either soluble or insoluble in processing solutions, and the use of both types of matting agents is preferable. Preferable examples are polymethylmethacrylate grains, poly(methylmethacrylate/methacrylic acid=9/1 or 5/5 (molar ratio)) grains, and polystyrene grains. The grain size is preferably 0.8 to 10 $\mu$m, and a narrow grain size distribution is preferable. It is preferable that 90% or more of all grains have grain sizes 0.9 to 1.1 times the average grain size. To increase the matting property, it is preferable to simultaneously add fine grains with a grain size of 0.8 $\mu$m or smaller. Examples are polymethylmethacrylate grains (0.2 $\mu$m), poly(methylmethacrylate/methacrylic acid=9/1 (molar ratio, 0.3 $\mu$m)) grains, polystyrene grains (0.25 $\mu$m), and colloidal silica grains (0.03 $\mu$m).

A film magazine used in the present invention will be described below. The principal material of the cartridge used in the present invention can be a metal or synthetic plastic.

Preferable plastic materials are polystyrene, polyethylene, polypropylene, and polyphenylether. The cartridge of the present invention can also contain various antistatic agents. For this purpose, carbon black, metal oxide grains, nonion-, anion-, cation-, and betaine-based surfactants, or a polymer can be preferably used. These antistatic cartridges are described in Jpn. Pat. Appln. KOKAI Publication Nos. 1-312537 and 1-312538. It is particularly preferable that a resistance at 25° C. and 25%RH be $10^{12}$ Ω or less. Commonly, plastic cartridges are manufactured by using plastic into which carbon black or pigments are incorporated in order to give a light-shielding property. The cartridge size can be a presently available 135 size. To miniaturize cameras, it is effective to decrease the diameter of a 25-mm cartridge of 135 size to 22 mm or less. The volume of a cartridge case is 30 $cm^3$ or less, preferably 25 $cm^3$ or less. The weight of plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. Nos. 4,834,306 and 5,226,613. Photographic films used in the present invention can be so-called raw films before being developed or developed photographic films. Also, raw and developed photographic films can be accommodated in the same new cartridge or in different cartridges.

EXAMPLES

The present invention will be described in more detail below by way of its examples. However, the present invention is not limited to these examples.

Example 1

1) Support

A support used in this example was formed as follows.

100 parts by weight of a commercially available polyethylene-2,6-naphthalate polymer and 2 parts by weight of Tinuvin P.326 (manufactured by Ciba-Geigy Co.) as an ultraviolet absorbent were dried by a conventional method, melted at 300° C., and extruded from a T-die. The resultant material was longitudinally oriented by 3.0 times at 140° C., laterally oriented by 3.0 times at 130° C., and thermally fixed at 250° C. for 6 sec. The result was a 90-$\mu$m thick PEN film.

A portion of the PEN film was wound around a stainless steel core 20 cm in diameter and given a thermal history of 110° C. and 48 hr.

2) Coating of undercoat layer

The two surfaces of the support were subjected to corona discharge, UV discharge, glow discharge, and a flame treatment, and coated with an undercoat solution having the composition described below, thereby forming undercoat layers on sides at a high temperature upon orientation. The corona discharge processing was performed for a 30-cm wide support at 20 m/min by using a solid state color processor 6KVA manufactured by Pillar Co. It was found from the readings of the current and voltage that processing of 0.375 KV·A·min/$m^2$ was performed for the object to be processed. During the processing, the discharge frequency was 9.6 KHz, and the gap clearance between the electrode and the dielectric roll was 1.6 mm. The UV discharge processing was done by heating the support at 75° C. The glow discharge processing was done by irradiating the support at 3000 W for 30 sec by using a columnar electrode.

| | | |
|---|---|---|
| Gelatin | 3 | g |
| Distilled water | 25 | ml |
| Sodium α-sulfo-di-2-ethylhexylsuccinate | 0.05 | g |
| Formaldehyde | 0.02 | g |
| Salicylic acid | 0.1 | g |
| Diacetylcellulose | 0.5 | g |
| p-chlorophenol | 0.5 | g |
| Resorcin | 0.5 | g |
| Cresol | 0.5 | g |
| $(CH_2{=}CHSO_2CH_2CH_2NHCO)_2CH_2$ | 0.2 | g |
| Aziridine three-time molar adduct of trimethylolpropane | 0.2 | g |
| Three-time molar adduct of trimethylolpropane-toluenediisocyanate | 0.2 | g |
| Methanol | 15 | ml |
| Acetone | 85 | ml |
| Formaldehyde | 0.01 | g |
| Acetic acid | 0.01 | g |
| Concentrated hydrochloric acid | 0.01 | g |

3) Coating of back layers

On one surface of the undercoated support, an antistatic layer, a magnetic recording layer, and a slip layer having the following compositions were coated as back layers.

3-1) Coating of antistatic layer 3-1-1) Preparation of conductive fine grain dispersion (dispersion of tin oxide-antimony oxide composite material)

230 parts by weight of stannic chloride hydrate and 23 parts by weight of antimony trichloride were dissolved in 3000 parts by weight of ethanol to prepare a uniform solution. An aqueous 1 N sodium hydroxide solution was dropped into the resultant solution until the pH of the solution became 3, thereby obtaining a co-precipitate of colloidal stannic oxide and antimony oxide. The resultant co-precipitate was left to stand at 50° C. for 24 hr to obtain a reddish brown colloidal precipitate.

The reddish brown colloidal precipitate was separated by centrifugal separation. To remove excess ion, water is added to the precipitate and the precipitate was washed with the water by centrifugal separation. This operation was repeated three times to remove excess ion.

200 parts by weight of the colloidal precipitate from which excess ion was removed were again dispersed in 1500 parts by weight of water, and the dispersion was sprayed into a sintering furnace heated to 650° C. The result was a bluish fine grain powder with an average grain size of 0.005 μm of a tin oxide-oxide antimony composite material. The specific resistance of this fine grain powder was 5 Ω·cm.

The pH of a solution mixture of 40 parts by weight of the fine grain powder and 60 parts by weight of water was adjusted to 7.0, and the mixture was coarsely dispersed by using a stirrer. Thereafter, the coarse dispersion was dispersed by a horizontal sand mill (Dynomill (tradename); manufactured by WILLYA. BACHOFENAG) until the retention time was 30 min. The average grain size of the secondary aggregate was about 0.04 μm.

3-1-2) Coating of conductive layer

A conductive layer having the following composition was coated such that the dry film thickness was 0.2 μm, and dried at 115° C. for 60 sec.

| | |
|---|---|
| Conductive fine grain dispersion prepared in 3-1-1) | 20 parts by weight |
| Gelatin | 2 parts by weight |
| Water | 27 parts by weight |
| Methanol | 60 parts by weight |
| p-chlorophenol | 0.5 part by weight |
| Resorcin | 2 parts by weight |
| Polyoxyethylenenonylphenylether | 0.01 part by weight |

The resistance of the resultant conductive film was $10^{8.0}$ (100 v), i.e., the conductive film had excellent antistatic properties.

3-2) Coating of magnetic recording layer 1100 g of magnetic substance Co-deposited γ-$Fe_2O_3$ (needles having a major axis of 0.14 μm and a minor axis of 0.03 μm, specific area 41 $m^2$/g, saturation magnetization 89 emu/g, the surface was treated with 2 wt % of $Fe_2O_3$ by using aluminum oxide and silicon oxide, coercive force 930 Oe, $Fe^{+2}/Fe^{+3}$=6/94), 220 g of water, and 150 g of a silane coupling agent made from polyoxyethylenepropyltrimethoxysilane (polymerization degree 16), and the mixture was well kneaded in an open kneader for 3 hr. The resultant coarsely dispersed viscous solution was dried at 70° C. for 24 hr to remove water. Thereafter, the resultant material was heated at 110° C. for a whole day and night to form surface-treated magnetic grains.

The following composition was again kneaded by the open kneader.

| | |
|---|---|
| Above-mentioned surface-treated magnetic grains | 1000 g |
| Diacetylcellulose | 17 g |
| Methylethylketone | 100 g |
| Cyclohexanone | 100 g |

Furthermore, the following composition was finely dispersed at 200 rpm for 4 hr by a sand mill (¼ G).

| | |
|---|---|
| Above-mentioned kneaded product | 100 g |
| Diacetylcellulose | 60 g |
| Methylethylketone | 300 g |
| Cyclohexanone | 300 g |

Additionally, 20 wt % of diacetylcellulose and a three-time molar adduct of trimethylolpropane-toluenediisocyanate as a hardener were added to the binder. The resultant solution was diluted by equal quantities of methylethylketone and cyclohexanone so that the viscosity of the solution was about 80 cp. Coating was done on the conductive layer by using a bar coater so that the film thickness was 1.2 μm and the amount of the magnetic substance was 0.6 g/$m^2$. 10 mg/$m^2$ of silica grains (0.3 μm) were added as a matting agent, and 10 mg/$m^2$ of aluminum oxide (0.5 μm) were added as a polishing agent. Drying was performed at 115° C. for 6 min (all rollers and conveyors in the drying zone were at 115° C.).

An increase in the color density of $D^8$ of the magnetic recording layer measured by using a blue filter in status M of X-light was about 0.1. The saturation magnetization moment, coercive force, and squareness ratio of the magnetic recording layer were 4.2 emu/$m^2$, 923 Oe, and 65%, respectively.

3-3) Preparation of slip layer

A solution having the following composition was coated such that the solid coating amounts of the compounds were as follows, and dried at 110° C. for 5 min to obtain a slip layer.

| | |
|---|---|
| Diacetylcellulose | 25 mg/$m^2$ |
| $C_6H_{13}CH(OH)C_{10}H_{20}COOC_{40}H_{81}$ (compound a) | 6 mg/$m^2$ |
| $C_{50}H_{101}O(CH_2CH_2O)_{16}H$ (compound b) | 9 mg/$m^2$ |

Note that the compound a/compound b (6:9) mixture was dissolved in an xylene-propyleneglycolmonomethylether (volume ratio 1:1) solvent by heating to 105° C. The resultant solution was injected into a tenfold amount of propyleneglycolmonomethylether (25° C.) to prepare a fine dispersion. The dispersion was diluted in a fivefold amount of acetone, and the diluted solution was redispersed by a high-pressure homogenizer (200 atm) and formed into a dispersion (average grain size 0.01 μm) before being added.

The resultant slip layer was found to have excellent characteristics; that is, the coefficient of kinetic friction was 0.06 (5 mmø stainless steel hard sphere, load 100 g, speed 6 cm/min), and the coefficient of static friction was 0.07 (clip method). Also, the coefficient of kinetic friction between an emulsion surface (to be described later) and the slip layer was 0.12.

4) Coating of sensitive layers

On the side away from the back layers formed as above, a plurality of layers having the following compositions were coated to manufacture a color negative film. The film is called a sample 101.

(Compositions of light-sensitive layers)

The main materials used in the individual layers are classified as follows.

| | |
|---|---|
| ExC: Cyan coupler | UV : Ultraviolet absorbent |
| ExM: Magenta coupler | HBS: High-boiling organic solvent |
| ExY: Yellow coupler | H : Gelatin hardener |
| ExS: Sensitizing dye | |

The number corresponding to each component indicates the coating amount in units of g/$m^2$. The coating amount of a silver halide is represented by the amount of silver. The coating amount of each sensitizing dye is represented in units of mols per mol of a silver halide in the same layer.

(Sample 101)

1st layer (1st antihalation layer)

| | |
|---|---|
| Black colloidal silver | silver 0.08 |
| Gelatin | 58 |

2nd layer (2nd antihalation layer)

| | | |
|---|---|---|
| Black colloidal silver | silver | 0.09 |
| Gelatin | | 0.64 |
| ExM-1 | | 0.12 |
| ExF-1 | | $2.0 \times 10^{-3}$ |
| Solid dispersion dye ExF-2 | | 0.030 |
| Solid dispersion dye ExF-3 | | 0.040 |
| HBS-1 | | 0.15 |
| HBS-2 | | 0.02 |

3rd layer (Interlayer)

| | |
|---|---|
| ExC-2 | 0.05 |
| Polyethylacrylate latex | 0.20 |
| Gelatin | 0.47 |

4th layer (Low-speed red-sensitive emulsion layer)

| | | |
|---|---|---|
| Silver iodobromide emulsion A | silver | 0.23 |
| Silver iodobromide emulsion B | silver | 0.26 |
| silver iodobromide emulsion C | silver | 0.10 |
| ExS-1 | | $4.3 \times 10^{-4}$ |
| ExS-2 | | $1.8 \times 10^{-5}$ |
| ExS-3 | | $5.9 \times 10^{-4}$ |
| ExC-1 | | 0.33 |
| ExC-2 | | 0.02 |
| ExC-3 | | 0.06 |
| ExC-4 | | 0.014 |
| ExC-5 | | 0.021 |
| ExC-6 | | 0.002 |
| Cpd-2 | | 0.033 |
| HBS-1 | | 0.13 |
| Gelatin | | 1.37 |

5th layer (Medium-speed red-sensitive emulsion layer)

| | | |
|---|---|---|
| Emulsion C | silver | 0.15 |
| Emulsion D | silver | 0.46 |
| ExS-1 | | $4.0 \times 10^{-4}$ |
| ExS-2 | | $2.1 \times 10^{-5}$ |
| ExS-3 | | $5.7 \times 10^{-4}$ |
| ExC-1 | | 0.23 |
| ExC-2 | | 0.02 |
| ExC-3 | | 0.03 |
| ExC-4 | | 0.017 |
| ExC-5 | | 0.02 |
| ExC-6 | | 0.001 |
| Cpd-4 | | 0.030 |
| Cpd-2 | | 0.05 |
| HBS-1 | | 0.10 |
| Gelatin | | 0.93 |

6th layer (High-speed red-sensitive emulsion layer)

| | | |
|---|---|---|
| Silver iodobromide emulsion E | silver | 1.47 |
| ExS-1 | | $2.8 \times 10^{-4}$ |
| ExS-2 | | $1.2 \times 10^{-5}$ |
| ExS-3 | | $4.1 \times 10^{-4}$ |
| ExC-1 | | 0.12 |
| ExC-3 | | 0.10 |
| ExC-4 | | 0.037 |
| ExC-6 | | 0.003 |
| ExC-7 | | 0.010 |
| Cpd-2 | | 0.059 |
| Cpd-4 | | 0.020 |
| HBS-1 | | 0.22 |
| HBS-2 | | 0.050 |
| Gelatin | | 1.40 |

7th layer (Interlayer)

| | |
|---|---|
| Cpd-1 | 0.060 |
| Solid dispersion dye ExF-4 | 0.030 |
| HBS-1 | 0.040 |
| Polyethylacrylate latex | 0.15 |
| Gelatin | 1.10 |

8th layer (Low-speed green-sensitive emulsion layer)

| | | |
|---|---|---|
| Silver iodobromide emulsion F | silver | 0.22 |
| Silver iodobromide emulsion G | silver | 0.35 |
| ExS-7 | | $6.2 \times 10^{-4}$ |
| ExS-8 | | $1.4 \times 10^{-4}$ |
| ExS-4 | | $2.7 \times 10^{-5}$ |
| ExS-5 | | $7.0 \times 10^{-5}$ |
| ExS-6 | | $2.7 \times 10^{-4}$ |
| ExM-3 | | 0.38 |
| ExM-4 | | 0.084 |
| ExC-4 | | 0.002 |
| ExY-1 | | 0.040 |
| ExY-5 | | 0.003 |
| HBS-1 | | 0.30 |
| HBS-3 | | 0.015 |
| Cpd-4 | | 0.010 |
| Gelatin | | 1.07 |

9th layer (Medium-speed green-sensitive emulsion layer)

| | | |
|---|---|---|
| Silver iodobromide emulsion G | silver | 0.56 |
| Silver iodobromide emulsion H | silver | 0.56 |
| ExS-4 | | $5.6 \times 10^{-5}$ |
| ExS-7 | | $1.09 \times 10^{-3}$ |
| ExS-8 | | $2.5 \times 10^{-4}$ |
| ExC-4 | | 0.004 |
| ExC-8 | | 0.002 |
| ExM-3 | | 0.126 |
| ExM-4 | | 0.035 |
| ExY-1 | | 0.008 |
| ExY-4 | | 0.010 |
| ExY-5 | | 0.0050 |
| Cpd-4 | | 0.011 |
| HBS-1 | | 0.13 |
| HBS-3 | | $4.4 \times 10^{-3}$ |
| Gelatin | | 1.02 |

10th layer (High-speed green-sensitive emulsion layer)

| | | |
|---|---|---|
| Silver iodobromide emulsion I | silver | 1.34 |
| ExS-4 | | $4.6 \times 10^{-5}$ |
| ExS-7 | | $5.5 \times 10^{-4}$ |
| ExS-8 | | $1.2 \times 10^{-4}$ |
| ExC-9 | | 0.019 |
| ExM-1 | | 0.010 |
| ExM-2 | | 0.030 |
| ExM-5 | | 0.0070 |
| ExM-6 | | 0.0050 |
| Cpd-3 | | 0.015 |
| Cpd-4 | | 0.031 |
| HBS-1 | | 0.25 |
| Polyethylacrylate latex | | 0.15 |
| Gelatin | | 1.29 |

11th layer (Yellow filter layer)

| | | |
|---|---|---|
| Yellow colloidal silver | silver | 0.030 |
| Cpd-1 | | 0.10 |
| Solid dispersion dye ExF-5 | | 0.060 |
| Solid dispersion dye ExF-6 | | 0.060 |

-continued

| | |
|---|---|
| Oil-soluble dye ExF-7 | 0.010 |
| HBS-1 | 0.60 |
| Gelatin | 0.69 |

12th layer (Low-speed blue-sensitive emulsion layer)

| | |
|---|---|
| Silver iodobromide emulsion J | silver 0.09 |
| Silver iodobromide emulsion K | silver 0.10 |
| Silver iodobromide emulsion L | silver 0.25 |
| ExS-9 | $8.4 \times 10^{-4}$ |
| ExC-9 | 0.01 |
| ExC-8 | $7.0 \times 10^{-3}$ |
| ExC-6 | 0.024 |
| ExY-1 | 0.050 |
| ExY-2 | 0.75 |
| ExY-3 | 0.40 |
| ExY-4 | 0.040 |
| Cpd-2 | 0.10 |
| Cpd-4 | 0.01 |
| Cpd-3 | $4.0 \times 10^{-3}$ |
| HBS-1 | 0.28 |
| Gelatin | 2.45 |

13th layer (High-speed blue-sensitive emulsion layer)

| | |
|---|---|
| Silver iodobromide emulsion M | silver 0.51 |
| ExS-9 | $3.1 \times 10^{-4}$ |
| ExY-2 | 0.070 |
| ExY-3 | 0.070 |
| ExY-4 | 0.0050 |
| Cpd-2 | 0.019 |
| Cpd-3 | $1.0 \times 10^{-3}$ |
| Cpd-4 | 0.02 |
| HBS-1 | 0.070 |
| Gelatin | 0.50 |

14th layer (1st protective layer)

| | |
|---|---|
| Silver iodobromide emulsion N | silver 0.10 |
| UV-1 | 0.13 |
| UV-2 | 0.10 |
| UV-3 | 0.16 |
| UV-4 | 0.025 |
| ExF-8 | 0.001 |
| ExF-9 | 0.002 |
| HBS-1 | $5.0 \times 10^{-2}$ |

-continued

| | |
|---|---|
| HBS-4 | $5.0 \times 10^{-2}$ |
| Gelatin | 1.99 |

15th layer (2nd protective layer)

| | |
|---|---|
| H-1 | 0.40 |
| B-1 (diameter 1.7 μm) | 0.06 |
| B-2 (diameter 1.7 μm) | 0.09 |
| B-3 | 0.13 |
| ES-1 | 0.20 |
| Gelatin | 0.74 |

In addition to the above components, to improve the storage stability, processability, resistance to pressure, antiseptic and mildewproofing properties, antistatic properties, and coating properties, the individual layers contained W-1 to W-3, B-4 to B-6, F-1 to F-18, iron salt, lead salt, gold salt, platinum salt, palladium salt, iridium salt, and rhodium salt.

TABLE 1 below shows the average AgI contents and the grain sizes of the emulsions A to M used in the manufacture of the sample 101.

TABLE 1

| Emulsion | Average AgI content (%) | Equivalent sphere diameter of average grain size (μm) | Variation coefficient according to grain size (%) | Equivalent circle diameter of projected area (μm) | Diameter/ thickness ratio | Flatness |
|---|---|---|---|---|---|---|
| A | 2.5 | 0.37 | 10 | 0.40 | 2.4 | 14 |
| B | 3.1 | 0.40 | 18 | 0.51 | 3.2 | 20 |
| C | 5.0 | 0.55 | 20 | 0.86 | 6.2 | 45 |
| D | 5.4 | 0.66 | 23 | 1.10 | 7.0 | 45 |
| E | 4.2 | 0.81 | 19 | 1.20 | 6.9 | 40 |
| F | 2.7 | 0.37 | 19 | 0.58 | 3.2 | 18 |
| G | 3.3 | 0.42 | 18 | 0.80 | 5.9 | 44 |
| H | 4.0 | 0.61 | 20 | 1.10 | 6.5 | 38 |
| I | 4.2 | 0.80 | 20 | 1.09 | 7.1 | 46 |
| J | 3.2 | 0.35 | 19 | 0.56 | 6.9 | 85 |
| K | 3.3 | 0.34 | 21 | 0.56 | 7.1 | 90 |
| L | 6.0 | 0.62 | 20 | 0.83 | 8.9 | 95 |
| M | 6.3 | 1.00 | 19 | 1.30 | 6.0 | 28 |
| N | 1.0 | 0.07 | 15 | — | 1.0 | — |

In TABLE 1, (1) The emulsions J to L were subjected to reduction sensitization during grain preparation by using thiourea dioxide and thiosulfonic acid in accordance with the examples in Jpn. Pat. Appln. KOKAI Publication No. 2-191938.

(2) The emulsions C to E, G to I, and M were subjected to gold sensitization, sulfur sensitization, and selenium sensitization in the presence of the spectral sensitizing dyes described in the individual light-sensitive layers and sodium thiocyanate in accordance with the examples in Jpn. Pat. Appln. KOKAI Publication No. 3-237450.

(3) The tabular grains were prepared by using low-molecular weight gelatin in accordance with the examples in Jpn. Pat. Appln. KOKAI Publication No. 1-158426.

(4) Dislocation lines as described in Jpn. Pat. Appln. KOKAI Publication No. 3-237450 were observed in tabular grains when a high-voltage electron microscope was used.

(5) The emulsions A to E, G, H, and J to L contained optimum amounts of Rh, Ir, and Fe.

Also, assuming that the average equivalent circle diameter of the projected areas of tabular grains is $D_c$ and the average thickness of the tabular grains is t, the flatness is represented by flatness=$D_c/t^2$.

Preparation of dispersions of organic solid dispersion dyes

The dye ExF-2 described below was dispersed by the following method. That is, 21.7 ml of water, 3 ml of a 5% aqueous solution of p-octylphenoxyethoxyethoxyethanesulfonic acid soda, and 0.5 g of a 5% aqueous solution of p-octylphenoxypolyoxyethyleneether (polymerization degree 10) were placed in a 700-ml pot mill, and 5.0 g of the dye ExF-2 and 500 ml of zirconium oxide beads (diameter 1 mm) were added to the mill. The contents were dispersed for 2 hr. This dispersion was done by using a BO type oscillating ball mill manufactured by Chuo Koki K.K. The dispersion was removed from the mill and added to 8 g of a 12.5% aqueous solution of gelatin. The beads were removed from the resultant material by filtration, obtaining a gelatin dispersion of the dye. The average grain size of the fine dye grains was 0.44 μm.

Following the same procedure as above, solid dispersions of the dyes ExF-3, ExF-4, and ExF-6 described below were obtained. The average grain sizes of these fine dye grains were 0.24, 0.45, and 0.52 μm, respectively. ExF-5 was dispersed by a micro-precipitation dispersion method described in Example 1 of EP 549,489A. The average grain size was found to be 0.06 μm.

The compounds used in the formation of the above layers are presented below.

ExC-1

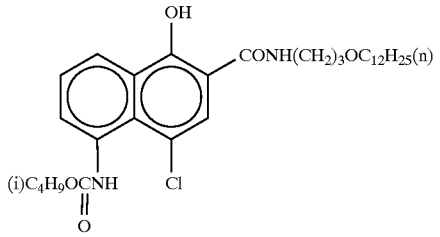

ExC-2

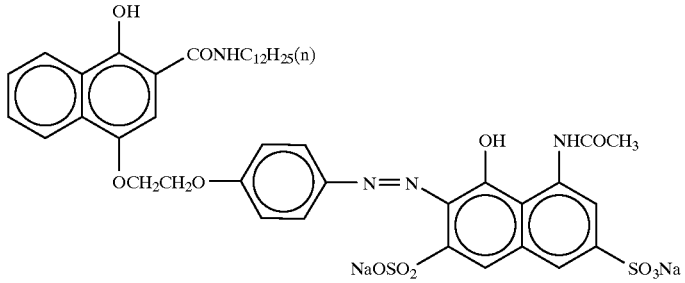

ExC-3

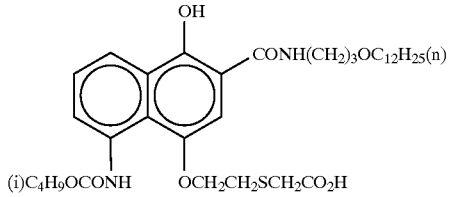

ExC-4

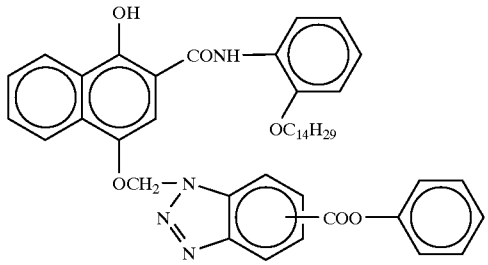

-continued
ExC-5
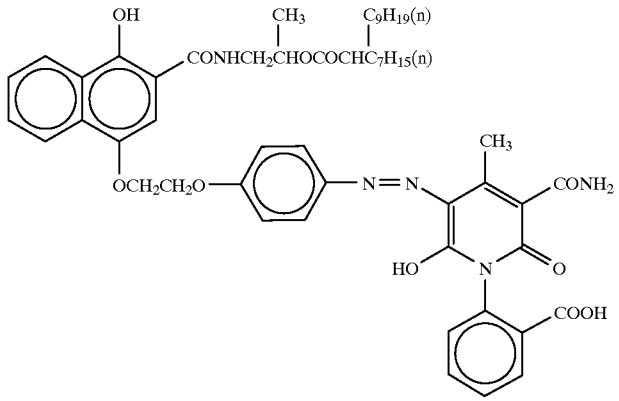
ExC-6
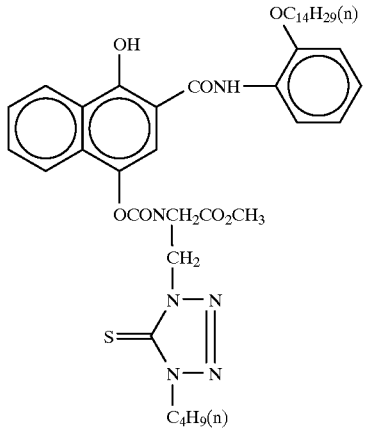
ExC-7
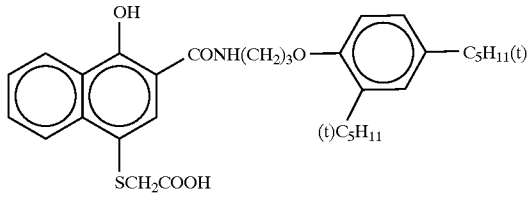
ExC-8
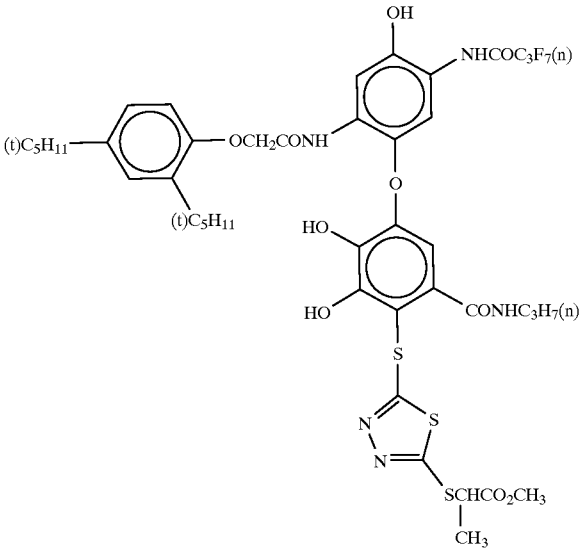

-continued
ExC-9
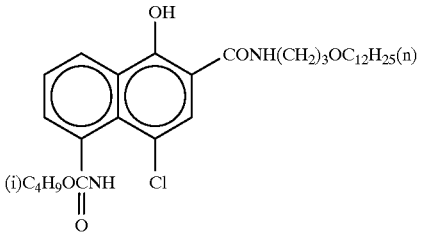
ExM-1
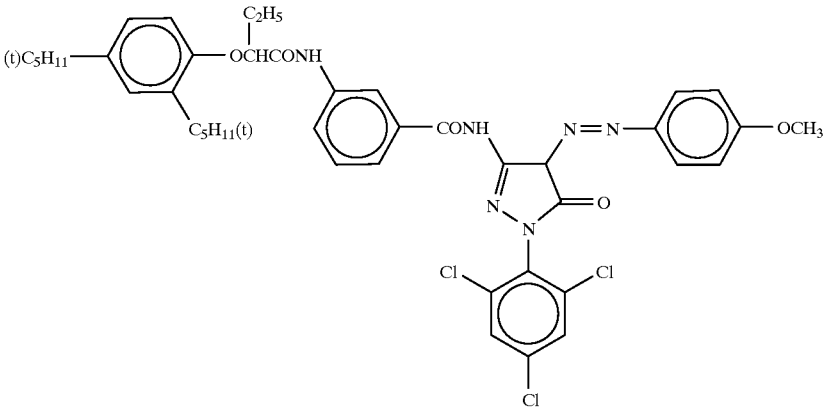
ExM-2
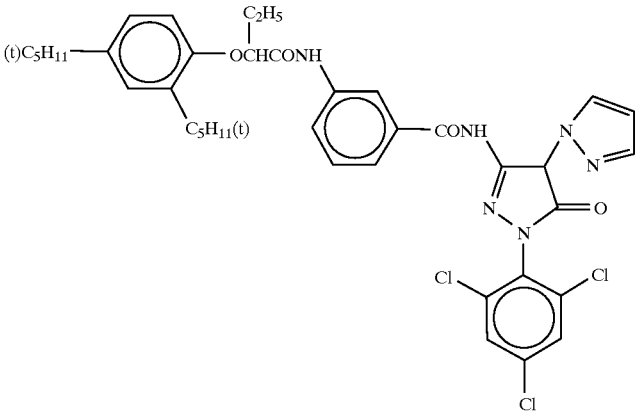
ExM-3
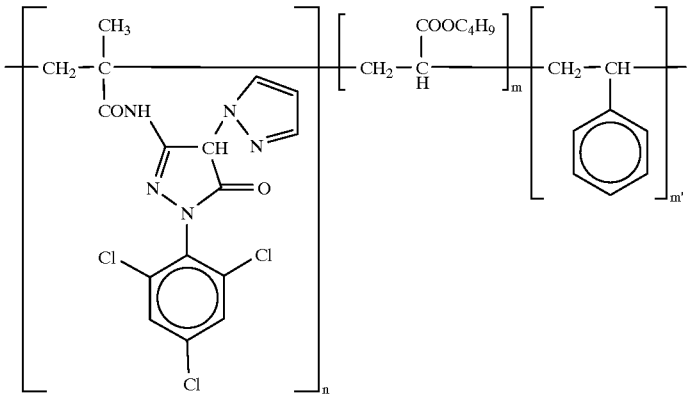
n = 50
m = 25
m' = 25
mol.wt. about 20,000

-continued
ExM-4
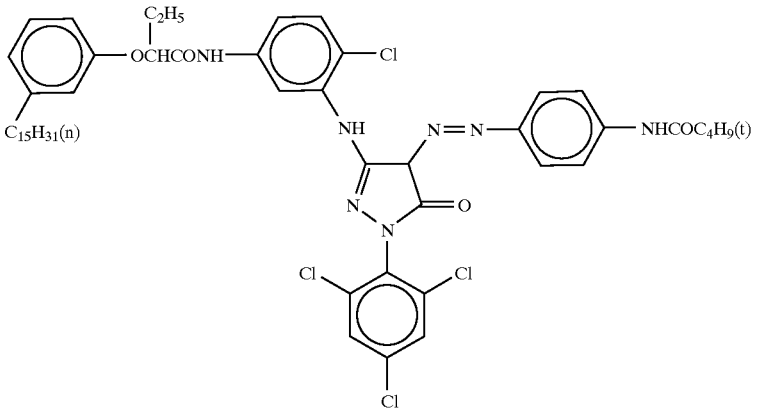
ExM-5
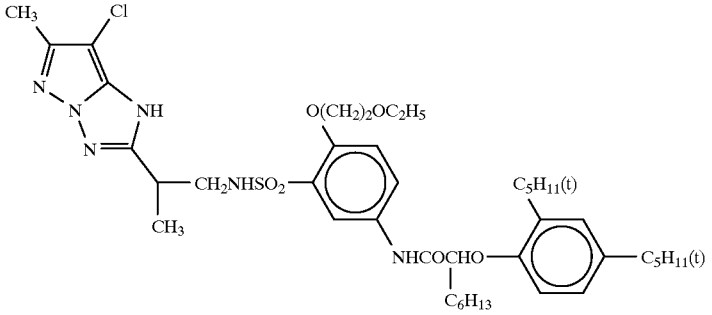
ExM-6
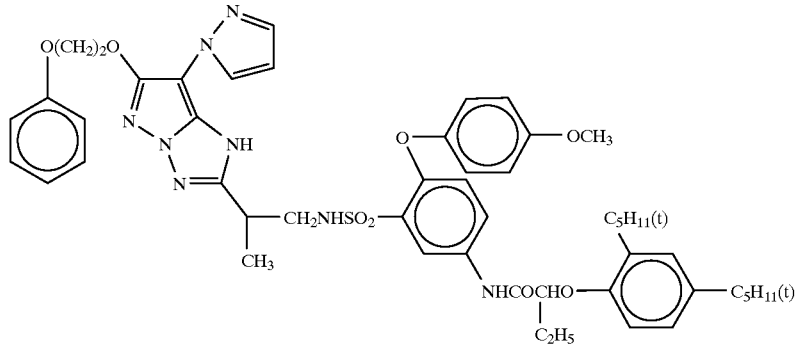
ExY-1
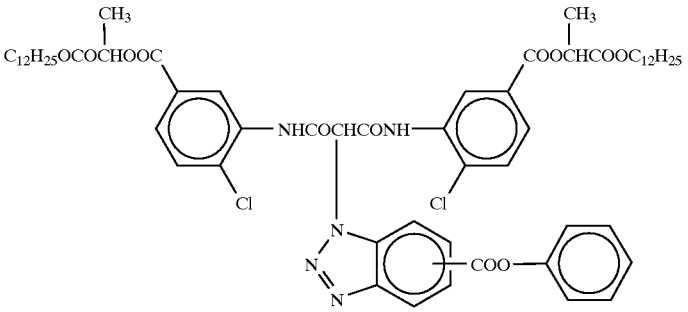

-continued
ExY-2
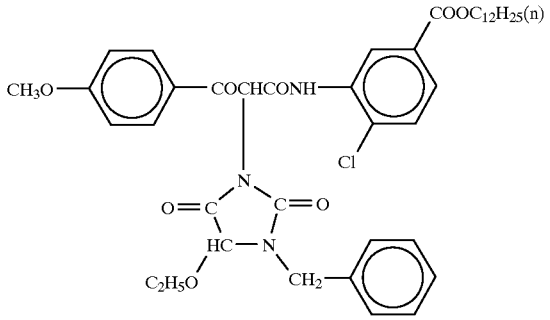
ExY-3
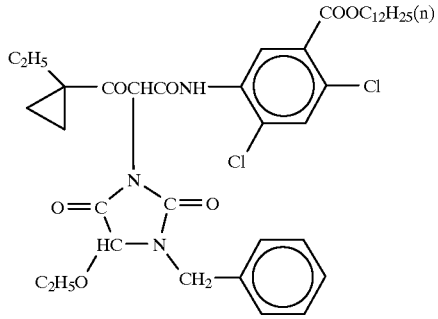
ExY-4
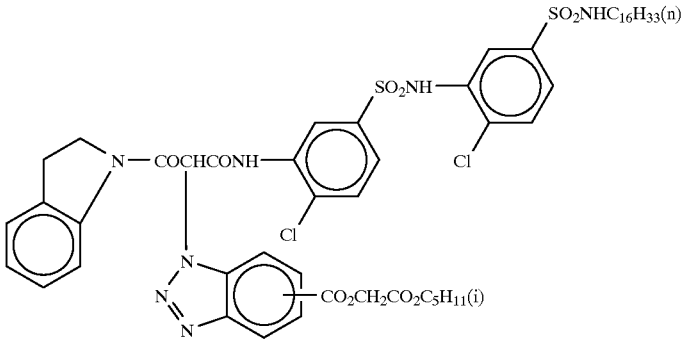
ExY-5
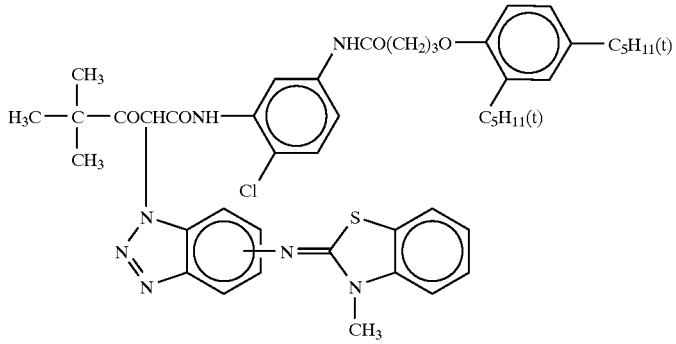
ExF-1
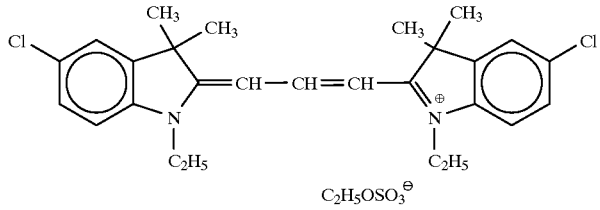

-continued
ExF-2
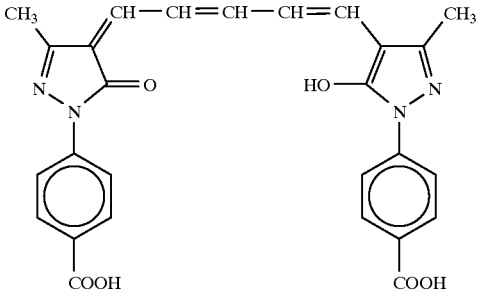
ExF-3
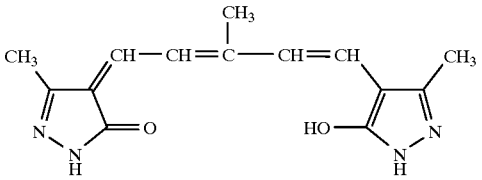
ExF-4
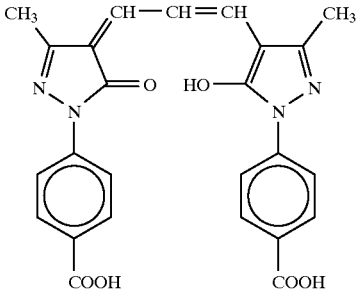
ExF-5
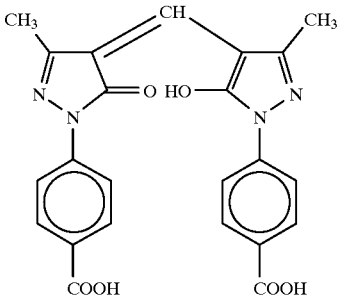
ExF-6
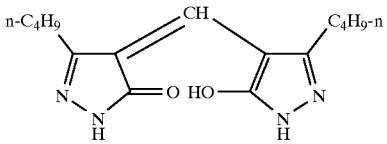
ExF-7
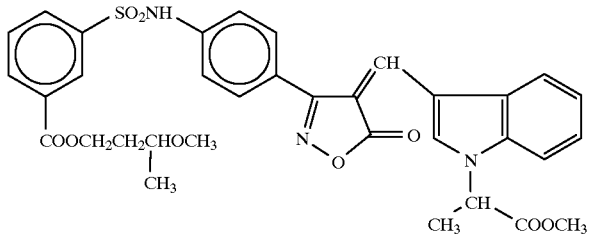

-continued
ExF-8
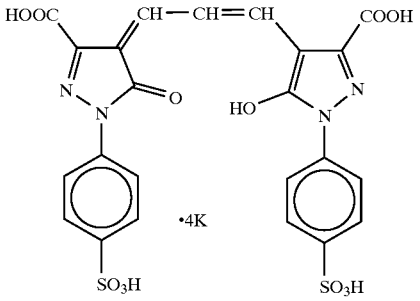
ExF-9
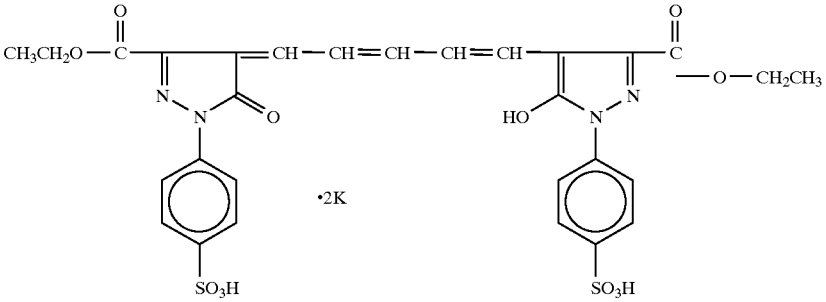
Cpd-1
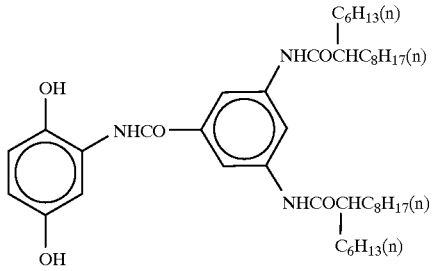
Cpd-2
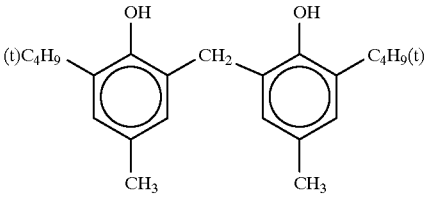
Cpd-3
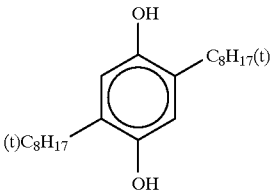
Cpd-4
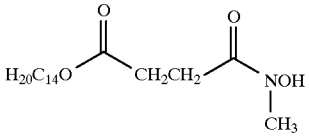
UV-1
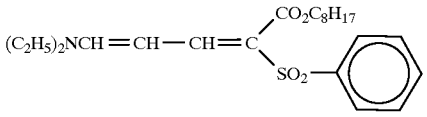

-continued
UV-2
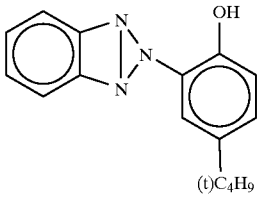
UV-3
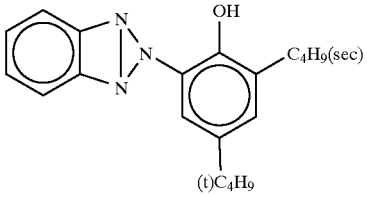
UV-4
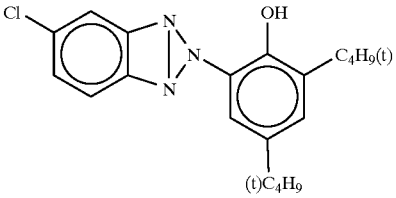
HBS-1
Tricresylphosphate
HBS-2
Di-n-bytylphthalate
HBS-3
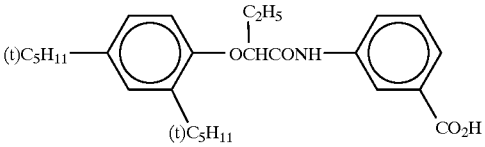
HBS-4
Tri(2-ethylhexyl)phosphate
ExS-1
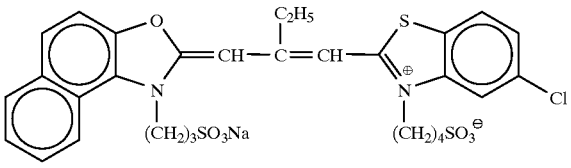
ExS-2
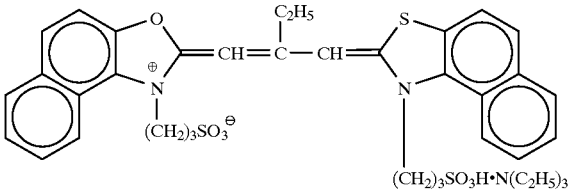
ExS-3
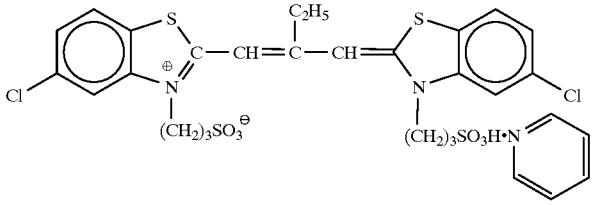

-continued
ExS-4
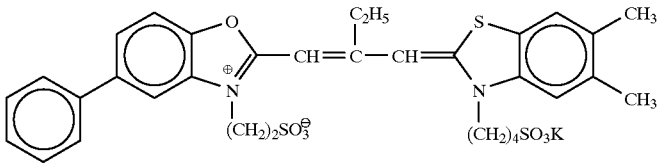
ExS-5
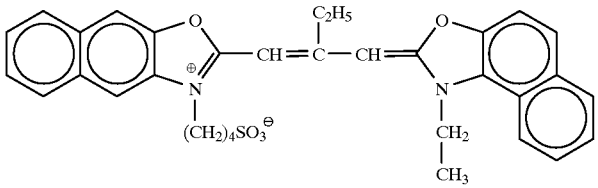
ExS-6
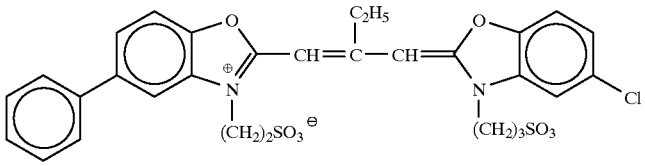
ExS-7
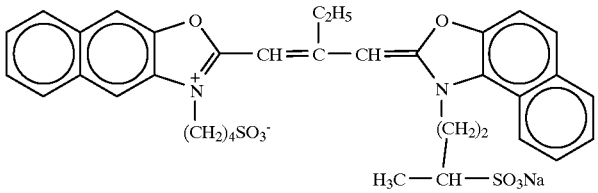
ExS-8
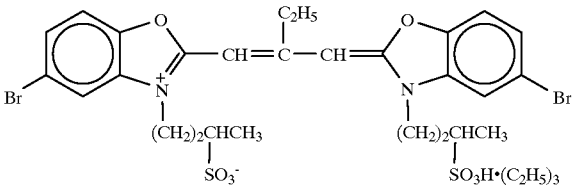
ExS-9
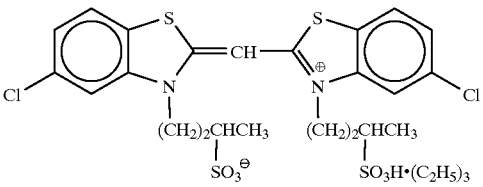
S-1
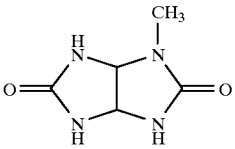
H-1
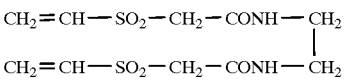
B-1
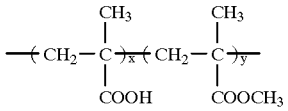
x/y = 10/90

-continued
B-2
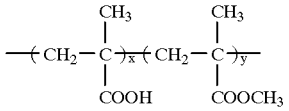
x/y = 40/60
B-3
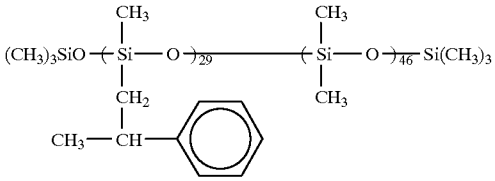
B-4
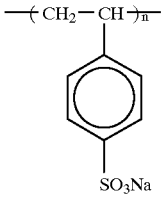
B-5
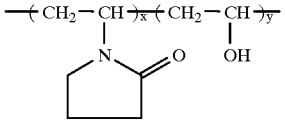
x/y = 70/30
B-6
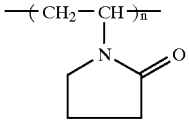
(mol. wt. about 10,000)
W-1
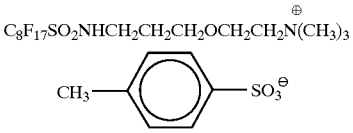
W-2
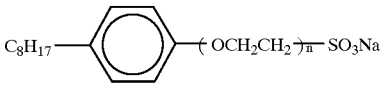
n = 2–4
W-3
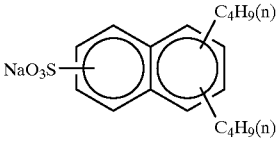
F-1
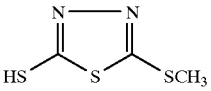

-continued
F-2
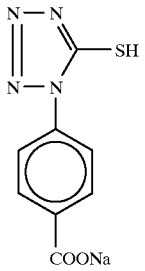
F-3
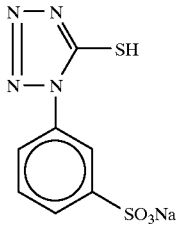
F-4
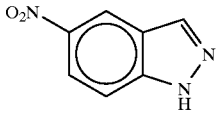
F-5
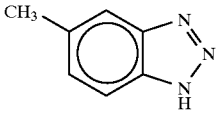
F-6
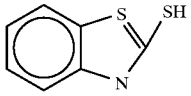
F-7
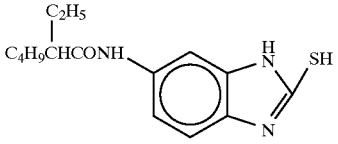
F-8
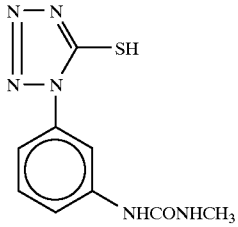
F-9
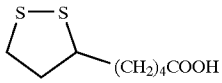
F-10
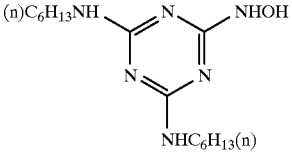

-continued

F-11

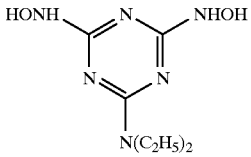

F-12

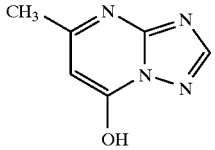

F-13

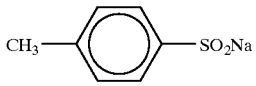

F-14

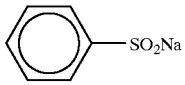

F-15

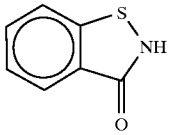

F-16

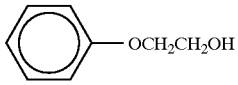

F-17

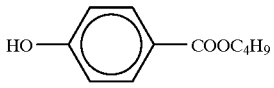

F-18

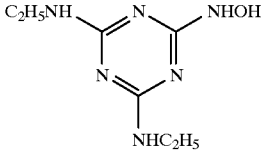

Samples 102 to 112 (see TABLE 2 below) were formed by replacing the coupler ExC-4 used in the fourth, fifth, and sixth layers of the sample 101 with comparative compounds (1) to (3) presented below and the compounds of the present invention.

Note that the addition amounts of the couplers used were so adjusted that the cyan image gradation of each sample was equal to that of the sample 101.

Comparative compound (1): Compound (4) disclosed in JP-A-5-313322

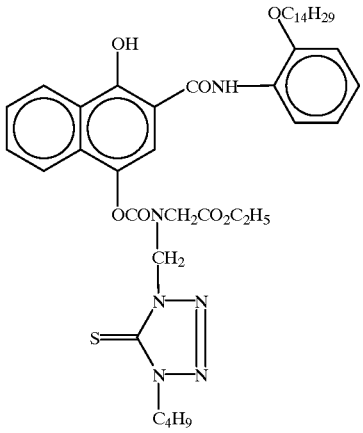

Comparative compound (2): Compound (1) disclosed in JP-A-5-313322

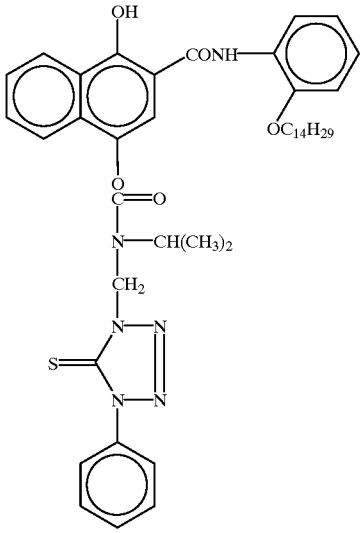

Comparative compound (3): Compound (2) disclosed in JP-A-5-313322

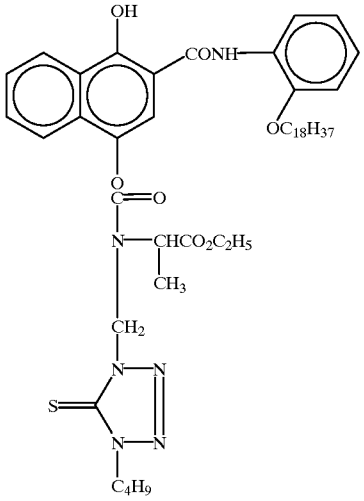

Subsequently, each sample was cut into 24 mm wide and 160 cm long, and two square perforations of 2 mm side were formed at an interval of 5.8 mm in a position 0.7 mm away from one side in the longitudinal direction of the sample. These pairs of perforations were formed at intervals of 32 mm, and the film was accommodated in a plastic film cartridge explained in FIGS. 1 to 7 of U.S. Pat. No. 5,296,887.

An FM signal was recorded between the perforations at a feed speed of 100 mm/s from the magnetic recording layer coated side of these samples by using a head having a head gap of 5 $\mu$m and the number of turns of 2000 and capable of input and output. After the FM signal was recorded, exposure corresponding to the property evaluations described below was given from the light-sensitive layer side, and the following development was performed to evaluate the individual properties. In each development processing, running processing was performed (until the accumulated replenisher volume of the color developer was three times the tank volume) by using a processing machine for motion picture film.

The processing steps and the compositions of the processing solutions were as follows.

(Processing steps)

| Step volume | Time | Temperature | Quantity of replenisher* | Tank |
|---|---|---|---|---|
| Color development | 3 min. 5 sec. | 38.0° C. | 20 ml | 17l |
| Bleaching | 50 sec. | 38.0° C. | 5 ml | 5l |
| Fixing (1) | 50 sec. | 38.0° C. | — | 5l |
| Fixing (2) | 50 sec. | 38.0° C. | 8 ml | 5l |
| Washing | 30 sec. | 38.0° C. | 17 ml | 3.5l |
| Stabilization (1) | 20 sec. | 38.0° C. | — | 3l |
| Stabilization (2) | 20 sec. | 38.0° C. | 15 ml | 3l |
| Drying | 1 min.30 sec. | 60.0° C. | | |

* The quantity of replenisher is represented by a value per 1.1m of a 35-mm wide sample (equivalent to one 24 Ex. film).

The stabilizer was counterflowed from (2) to (1), and the overflow of washing water was entirely introduced to fixing (2). The fixer was also counterflow-piped from (2) to (1).

Note that the amounts of the developer, the bleaching solution, and the fixer carried over to the bleaching step, the fixing step, and the washing step were 2.5 ml, 2.0 ml, and 2.0 ml, respectively, per 1.1 m of a 35-mm wide light-sensitive material.

Note also that each crossover time was 6 sec, and this time was included in the processing time of each preceding step.

The aperture area of the processor was 100 $cm^2$ for the color developer, 120 $cm^2$ for the bleaching solution, and approximately 100 $cm^2$ for the other processing solutions.

The compositions of the processing solutions are presented below.

| (Color developer) | Tank solution (g) | Replenishnient solution (g) |
|---|---|---|
| Diethylenetriamine pentaacetic acid | 2.0 | 2.0 |
| 1-hydroxyethylidene-1,1-diphosphonic acid | 2.0 | 2.0 |
| Sodium sulfite | 3.9 | 5.3 |
| Potassium carbonate | 37.5 | 39.0 |
| Potassium bromide | 1.4 | 0.4 |
| Potassium iodide | 1.3 mg | — |
| Disodium-N,N-bis(sulfonate ethyl)hydroxylamine | 8.0 | 11.0 |
| 2-methyl-4-(N-ethyl-N-β-hydroxyethyl)amino) aniline sulfate | 4.5 | 6.4 |
| Water to make | 1.0l | 1.0l |
| pH (adjusted by potassium hydroxide and sulfuric acid) | 10.05 | 10.18 |
| (Bleaching solution) | | |
| Ferric ammonium 1,3-diaminopropanetetra acetate monohydrate | 118 | 180 |
| Ammonium bromide | 80 | 115 |
| Ammonium nitrate | 14 | 21 |
| Succinic acid | 40 | 60 |
| Maleic acid | 33 | 50 |
| Water to make | 1.0l | 1.0l |
| pH (adjusted by ammonia water) | 4.4 | 4.0 |
| (Fixer) | | |
| Ammonium methane sulfinate | 10 | 30 |

-continued

| (Color developer) | Tank solution (g) | Replenishnient solution (g) |
|---|---|---|
| Ammonium methane thiosulfonate | 4 | 12 |
| Aqueous ammonium thiosulfate solution (700 g/l) | 280 ml | 840 ml |
| Imidazole | 7 | 20 |
| Ethylenediamine tetraacetic acid | 15 | 45 |
| Water to make | 1.0l | 1.0l |
| pH (adjusted by ammonia water and acetic acid) | 7.4 | 7.45 |

(Washing water)

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of sodium isocyanuric acid dichloride and 150 mg/l of sodium sulfate were added. The pH of the solution ranged from 6.5 to 7.5.

| (Stabilizer) common to tank solution and replenishment solution | (g) |
|---|---|
| Sodium p-toluenesulfinate | 0.03 |
| Polyoxyethylene-p-monononylphenylether (average polymerization degree 10) | 0.2 |
| Disodium ethylenediaminetetraacetate | 0.05 |
| 1,2,4-triazole | 1.3 |
| 1,4-bis(1,2,4-triazole-1-ylmethyl) piperazine | 0.75 |
| 1,2-benzoisothiazoline-3-one | 0.10 |
| Water to make | 1.0l |
| pH | 8.5 |

The sharpness and color turbidity of each resultant sample were evaluated by the following methods.

(Sharpness)

The sharpness was evaluated by a conventional MTF (Modulation Transfer Function) method. That is, MTF values at 10 cycles/mm of cyan and magenta images were obtained and represented by relative values assuming that the value of the sample 101 was 100.

Note that the MTF measurement was done by a method described in "Journal of Applied Photographic Engineering", Vol. 6(1), 1 to 8 (1980).

(Color turbidity)

The color turbidity of magenta with respect to a cyan density was evaluated in accordance with the following method.

(1) Double exposure was given to each sample as follows.

| | |
|---|---|
| First exposure | Imagewise exposure was given with red light. |
| Second exposure | Uniform exposure was given to each sample with green light by an exposure amount by which the magenta density in a portion not exposed to red light of the sample 101 1.7. |

(2) Processing was performed by the same processing steps as described above.

(3) For each processed sample, a magenta density in a cyan-fogged portion was subtracted from a magenta density at a point at which a cyan density of 1.8 was given, and the obtained value was evaluated as the color turbidity.

The smaller the value, the lower the color turbidity and the higher the color saturation of a sensitive material.

The results are shown in TABLE 2.

TABLE 2

| Sample No. | Coupler in fourth layer | Coupler in fifth layer | Coupler in sixth layer | MTF values Cyan density | MTF values Magenta density | Color turbidity | Remarks |
|---|---|---|---|---|---|---|---|
| 101 | ExC-4 | ExC-4 | ExC-4 | 100 | 100 | −0.23 | Comparative example |
| 102 | Comparative compound (1) | Comparative compound (1) | Comparative compound (1) | 99 | 98 | −0.26 | " |
| 103 | Comparative compound (2) | Comparative compound (2) | Comparative compound (2) | 97 | 97 | −0.24 | " |
| 104 | Comparative compound (3) | Comparative compound (3) | Comparative compound (3) | 94 | 94 | −0.20 | " |
| 105 | (1) | (1) | (1) | 106 | 106 | −0.30 | Present invention |
| 106 | (2) | (2) | (2) | 107 | 106 | −0.30 | " |
| 107 | (3) | (3) | (3) | 106 | 106 | −0.29 | " |
| 108 | (10) | (10) | (10) | 107 | 106 | −0.30 | " |
| 109 | (12) | (12) | (12) | 107 | 107 | −0.30 | " |
| 110 | (35) | (35) | (35) | 106 | 106 | −0.30 | " |
| 111 | (44) | (44) | (44) | 107 | 106 | −0.30 | " |
| 112 | (44) | (44) | (1) | 107 | 106 | −0.29 | " |

As is apparent from the results shown in TABLE 2, when the compounds of the present invention were used the sharpness was significantly improved not only in the layer in which the compounds were used but also in other layers, and the color turbidity was also improved.

Example 2

Samples 201 to 213 were formed by replacing the DIR compound ExY-1 in the eighth layer, ExY-1 and ExY-4 in the ninth layer, and ExY-1 in the twelfth layer of the sample 101 formed in Example 1 with comparative compounds (4), (5), and (6) presented below and the compounds of the present invention, and by controlling their addition amounts such that the gradation of the green-sensitive layer of each sample was equal to that of the sample 101. The sharpness of each resultant sample was evaluated by obtaining the MTF value at 10 cycles/mm of a magenta image following the same procedure as in Example 1.

Comparative compound (4): Compound (22) disclosed in JP-A-5-313322

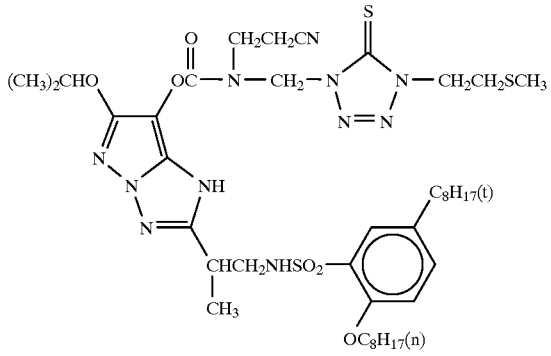

Comparative compound (5): Compound (15) disclosed in JP-A-7-133259

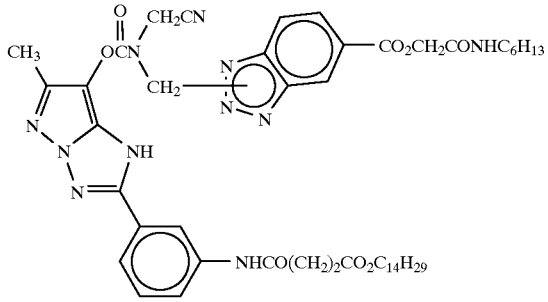

Comparative compound (6)

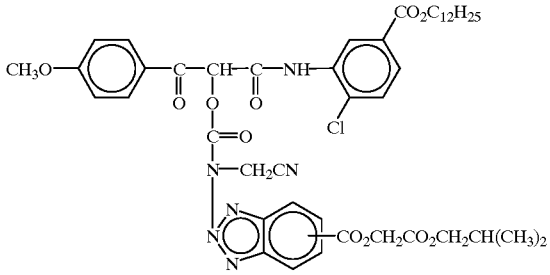

TABLE 3

| Sample No. | Coupler in eighth layer | Coupler in ninth layer | Coupler in twelfth layer | MTF value (magenta density) | Remarks |
|---|---|---|---|---|---|
| 101 | ExY-1 | ExY-1, ExY-4 | ExY-1 | 100 | Comparative example |
| 201 | Comparative compound (4) | Comparative compound (4) | ExY-1 | 97 | " |
| 202 | Comparative compound (5) | Comparative compound (5) | ExY-1 | 96 | " |
| 203 | Comparative compound (6) | Comparative *compound (6) | Comparative compound (6) | 95 | " |
| 204 | (16) | (16) | ExY-1 | 108 | Present invention |
| 205 | (18) | (18) | " | 108 | " |
| 206 | (23) | (23) | " | 109 | " |
| 207 | (24) | (24) | " | 108 | " |
| 208 | (34) | (34) | " | 106 | " |
| 209 | (45) | (45) | " | 108 | " |
| 210 | (48) | (48) | " | 107 | " |
| 211 | ExY-1 | ExY-1, ExY-4 | (18) | 104 | " |
| 212 | (18) | (18) | (42) | 109 | " |
| 213 | (34) | (34) | (43) | 109 | " |

As can be seen from TABLE 3, a startling effect of improving the sharpness was obtained as in Example 1 even when the compounds of the present invention were used in green- and blue-sensitive layers.

Effect of the Invention

The present invention can provide a silver halide color photographic light-sensitive material which forms images having a high sharpness and a high color reproduction.

We claim:

1. A silver halide color photographic light-sensitive material containing a compound represented by formula (II) below:

Formula (II)

$$A—O—C(=O)—N(—CH_2—Y)—CH_2—DI$$

wherein A represents a coupler residue, Y represents an $—SO_2R^1$, $—SO_2NR_1R^2$, $—CONR^1R^2$, $—CO_2Z$, —CN, $—CF_3$, $—CCl_3$, or $—NO_2$ group, and DI represents a development inhibitor residue which is bonded by a hetero atom and released to form mercaptoazole, wherein each of $R_1$ and $R^2$ independently represents a hydrogen atom or a substituted or nonsubstituted alkyl, cycloalkyl, alkenyl, aryl, or heterocyclic group or $R^1$ and $R^2$ bond to each other to form a nitrogen-containing ring, and Z represents a hydrogen atom or a substituted or nonsubstituted cycloalkyl, alkenyl, aryl, or heterocyclic group.

2. The material according to claim 1, wherein Y is a $—CONR^1R^2$, $—CO_2Z$, —CN, or $CF_3$ group.

3. The material according to claim 2, wherein Y is a —CN group.

4. The material according to claim 1, wherein said DI is represented by formulas DI-1 or DI-2 below:

DI-1

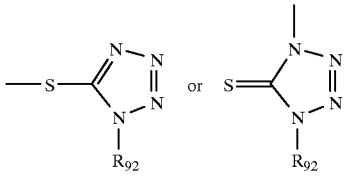

DI-2

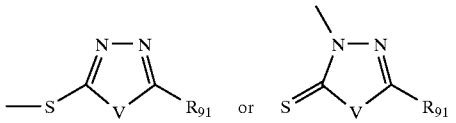

wherein $R_{91}$ represents a halogen atom, or a substituted or nonsubstituted alkyl, cycloalkyl, aryl, heterocyclic, alkoxy, cycloalkyloxy, aryloxy, heterocyclic oxy, silyloxy, acyloxy, alkoxycarbonyloxy, cycloalkyloxycarbonyloxy, aryloxycarbonyloxy, carbamoyloxy, sulfamoyloxy, alkanesulfonyloxy, arenesulfonyloxy, amide, alkanesulfonamide, arenesulfonamide, alkoxycarbonylamino, cycloalkyloxycarbonylamino, aryloxycarbonylamino, ureido, nitro, acyl, alkoxycarbonyl, cycloalkyloxycarbonyl, aryloxycarbonyl, carbamoyl, cyano, alkylthio, arylthio, alkanesulfonyl, arenesulfonyl, alkoxysulfonyl, cycloalkyloxysulfonyl, aryloxysulfonyl, or sulfamoyl group, $R_{92}$ represents an alkyl, cycloalkyl, aryl, or heterocyclic group, and V represents an oxygen atom, a sulfur atom, or $—N(R_{93})—$ wherein $R_{93}$ represents a group having the same meaning as $R_{92}$.

5. The material according to claim 1, wherein said coupler residue represented by A in formula (II) is coupler residue represented by formula (Cp-1), (Cp-2), (Cp-6), (Cp-7), (Cp-8), or (Cp-11) below, and said development inhibitor represented by DI in formula (II) is development inhibitor residue represented by formula (DI-1), (DI-2), or (DI-3) below, (Cp-1)

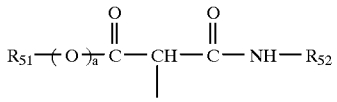

(Cp-2)

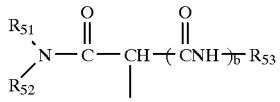

(Cp-6)

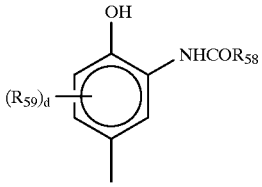

(Cp-7)

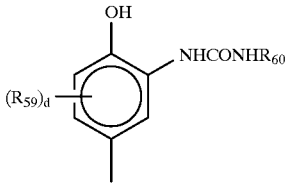

(Cp-8)

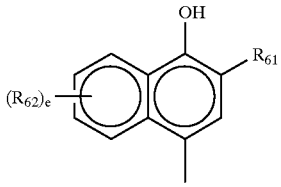

(Cp-11)

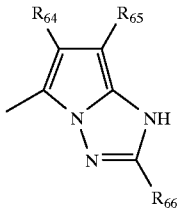

DI-1

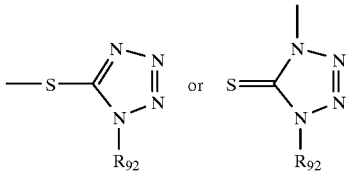

DI-2

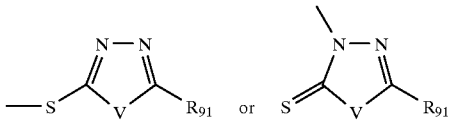

-continued

DI-3

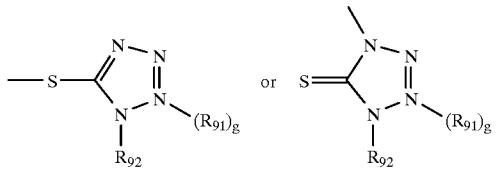

wherein $R_{51}$ represents an alkyl group, a cycloalkyl group, an aryl group, or a heterocyclic group, a represents 0 or 1, each of $R_{52}$ and $R_{53}$ independently represents a hydrogen atom, an alkyl group, a cycloalkyl group, an aryl group, or a heterocyclic group, and b represents 0 or 1, each of $R_{58}$ and $R_{60}$ independently represents an alkyl group, a cycloalkyl group, an aryl group, or a heterocyclic group, $R_{59}$ represents an alkyl group, a cycloalkyl group, an aryl group, a heterocyclic group, a silyl group, a carbonamide group, a sulfonamide group, an amino group, an anilino group, an alkylthio group, a cycloalkylthio group, an arylthio group, an alkoxy group, a cycloalkyloxy group, an aryloxy group, a ureido group, an alkoxycarbonylamino group, a cycloalkyloxycarbonylamino group, or a halogen atom, and d represents any integer from 0 to 3, if d is a plural number, a plurality of $R_{59}$'s represent the same substituent group or different substituent groups, $R_{61}$ represents an alkyl group, a cycloalkyl group, an aryl group, a heterocyclic group, a carbamoyl group, an alkoxycarbonyl group, a cycloalkyloxycarbonyl group, an aryloxycarbonyl group, a cyano group, a sulfamoyl group, a carbonamide group, a ureido group, an alkoxycarbonylamino group, a cycloalkyloxycarbonylamino group, an aryloxycarbonylamino group, or a sulfonamide group, $R_{62}$ represents an alkyl group, a cycloalkyl group, an aryl group, a heterocyclic group, a carbonamide group, a sulfonamide group, an amino group, an anilino group, an alkylthio group, a cycloalkylthio group, an arylthio group, an alkoxy group, a cycloalkyloxy group, an aryloxy group, a ureido group, an alkoxycarbonylamino group, a cycloalkyloxycarbonylamino group, or a halogen atom, and e represents any integer from 0 to 4, if e is a plural number, a plurality of $R_{62}$'s represent the same group or different groups, each of $R_{64}$ and $R_{65}$ independently represents a carbamoyl group, an alkoxycarbonyl group, a cycloalkyloxycarbonyl group, an aryloxycarbonyl group, a cyano group, a sulfamoyl group, an alkanesulfonyl group, an arenesulfonyl group, or a nitro group, $R_{66}$ represents a hydrogen atom, an alkyl group, a cycloalkyl group, an aryl group, or a heterocyclic group, wherein $R_{91}$ represents a halogen atom, or a substituted or nonsubstituted alkyl, cycloalkyl, aryl, heterocyclic, alkoxy, cycloalkyloxy, aryloxy, heterocyclic oxy, silyloxy, acyloxy, alkoxycarbonyloxy, cycloalkyloxycarbonyloxy, aryloxycarbonyloxy, carbamoyloxy, sulfamoyloxy, alkanesulfonyloxy, arenesulfonyloxy, amide, alkanesulfonamide, arenesulfonamide, alkoxycarbonylamino, cycloalkyloxycarbonylamino, aryloxycarbonylamino, ureido, nitro, acyl, alkoxycarbonyl, cycloalkyloxycarbonyl, aryloxycarbonyl, carbamoyl, cyano, alkylthio, arylthio, alkanesulfonyl, arenesulfonyl, alkoxysulfonyl, cycloalkyloxysulfonyl, aryloxysulfonyl, or sulfamoyl group, $R_{92}$ represents an alkyl, cycloalkyl, aryl, or heterocyclic group, and V represents an oxygen atom, a sulfur atom, or —N($R_{93}$)— wherein $R_{93}$ represents a group having the same meaning as $R_{92}$.

6. The material according to claim 5, wherein said coupler residue represented by A in formula (II) is coupler residue represented by formula (Cp-1) or (Cp-8), and said development inhibitor residue represented by DI in formula (II) is development inhibitor residue represented by (DI-1) or (DI-2).

7. The material according to claim 4, wherein $R_{92}$ is an alkyl, or aryl group.

8. The material according to claim 7, wherein $R_{92}$ is represented by —$CH_2CO_2$—R or —$CH_2CH_2CO_2$—R, wherein R represents —$C_4$—$H_9$, —$C_5H_{11}$—n, —$C_5H_{11}$—i, —$CH_2CH$═$CHCH_3$, or —$CH_2CH$═$C(CH_3)_2$.

9. The material according to claim 4, wherein V is an oxygen atom or sulfur atom, and $R_{91}$ is an alkylthio group or an arylthio group.

10. The material according to claim 9, wherein $R_{91}$ is represented by —$SCH_2CO_2$—R, —$SCH_2CH_2CO_2$—R, or —$SCH(CH_3)CO_2$—R, wherein R has the same meaning as $R_{92}$.

11. The material according to claim 4, wherein Y is a —$CONR^1R^2$, —$CO_2Z$, —CN, or —$CF_3$ group.

12. The material according to claim 11, wherein Y is a —CN group.

13. The material according to claim 1, wherein each of $R^1$ and $R^2$ is independently a hydrogen atom or a substituted or nonsubstituted alkyl group.

14. The material according to claim 13, wherein each of $R^1$ and $R^2$ independently represents a hydrogen atom or an alkyl group which has a hydroxyl group and/or a carboxyl group as a substituent and has 10 or less carbon atoms.

15. The material according to claim 1, wherein Z represents a hydrogen atom or a substituted or nonsubstituted aryl group.

16. The material according to claim 15, wherein Z represents a hydrogen atom or a substituted aryl group having 10 or less carbon atoms.

* * * * *